US012048867B2

(12) United States Patent
Burk

(10) Patent No.: US 12,048,867 B2
(45) Date of Patent: Jul. 30, 2024

(54) PLAY AND PRACTICE APPARATUS, SYSTEM AND USE

(71) Applicant: Jonathan Burk, Huntington Beach, CA (US)

(72) Inventor: Jonathan Burk, Huntington Beach, CA (US)

( * ) Notice: Subject to any disclaimer, the term of this patent is extended or adjusted under 35 U.S.C. 154(b) by 221 days.

(21) Appl. No.: 17/649,784

(22) Filed: Feb. 2, 2022

(65) Prior Publication Data

US 2022/0241662 A1 Aug. 4, 2022

Related U.S. Application Data

(60) Provisional application No. 63/144,846, filed on Feb. 2, 2021.

(51) Int. Cl.
*A63B 69/00* (2006.01)
*A63B 71/00* (2006.01)
*A63B 71/02* (2006.01)

(52) U.S. Cl.
CPC ..... *A63B 69/0097* (2013.01); *A63B 71/0036* (2013.01); *A63B 71/022* (2013.01); *A63B 69/0095* (2013.01); *A63B 2210/50* (2013.01)

(58) Field of Classification Search
CPC ..... A63B 2210/50; A63B 71/022; A63B 69/0097
USPC ..... 473/435; 273/407, 410
See application file for complete search history.

(56) References Cited

U.S. PATENT DOCUMENTS 2,104,375 A * 1/1938 Perry ..... A63F 9/0402 D25/123
3,001,790 A 9/1961 Pratt
3,697,068 A 10/1972 Mcdougall
4,275,883 A * 6/1981 Grimaldi ..... A63B 47/025 473/432
4,415,154 A * 11/1983 Engelhardt ..... A63B 69/0097 473/456
4,830,369 A * 5/1989 Poitras ..... A63B 63/00 473/455
5,207,432 A 5/1993 Miller
5,566,934 A * 10/1996 Black ..... A63B 69/0002 473/431
5,573,239 A 11/1996 Ryker et al.
5,660,395 A 8/1997 Marshall
6,010,414 A * 1/2000 Snow ..... A63B 69/0053 473/434
6,213,900 B1 * 4/2001 Steyn ..... A63B 69/0097 473/434
6,659,893 B1 12/2003 Campbell et al.
(Continued)

*Primary Examiner* — Mitra Aryanpour
(74) *Attorney, Agent, or Firm* — UltimatEdge IP Law Group, P.C.; Dean G. Stathakis

(57) ABSTRACT

The present specification discloses a play and practice apparatus, system and associated methods of use and kits comprising such play and practice apparatus and/or system. In particular aspects, the play and practice apparatus, system and associated methods of use are utilized for practice and/or games utilizing a ball. In one aspect, the play and practice apparatus has a first playing surface and a second playing surface substantially opposing the first playing surface, and the ball can be a volleyball. In another aspect, the play and practice apparatus is useful as a training aid as well as for playing a game utilizing the play and practice apparatus.

20 Claims, 19 Drawing Sheets

(56) References Cited

U.S. PATENT DOCUMENTS

| | | | | |
|---|---|---|---|---|
| 6,837,809 | B2 * | 1/2005 | Majumdar | A63B 69/0002 473/422 |
| 7,445,568 | B1 | 11/2008 | Steffensmeier | |
| 7,662,053 | B1 | 2/2010 | Summers et al. | |
| 7,824,282 | B2 | 11/2010 | Wycoff | |
| 7,909,330 | B2 * | 3/2011 | Domjen | A63B 69/0097 473/435 |
| 7,998,003 | B2 | 8/2011 | Orr | |
| 8,371,964 | B2 | 2/2013 | Jones et al. | |
| 8,540,592 | B1 | 9/2013 | Coppenrath | |
| 9,039,012 | B2 | 5/2015 | O'Sullivan | |
| D739,488 | S | 9/2015 | Campbell et al. | |
| 9,302,166 | B2 | 4/2016 | Annapragada | |
| 9,427,648 | B2 | 8/2016 | Cingone | |
| 10,207,167 | B2 | 2/2019 | Downing | |
| 10,252,133 | B2 | 4/2019 | Campbell et al. | |
| 2004/0023735 | A1 * | 2/2004 | Janton | A63B 69/0097 473/434 |
| 2005/0049088 | A1 * | 3/2005 | Chang | A63B 69/38 473/434 |
| 2005/0134001 | A1 | 6/2005 | Rowan | |
| 2007/0135240 | A1 | 6/2007 | Carr | |
| 2009/0069125 | A1 * | 3/2009 | Porter | A63B 69/0097 473/435 |
| 2010/0292033 | A1 | 11/2010 | Sarver | |
| 2012/0190485 | A1 | 7/2012 | Aurbach | |
| 2013/0059681 | A1 | 3/2013 | Forlini et al. | |
| 2014/0296003 | A1 | 10/2014 | Mcdonald | |
| 2015/0190701 | A1 * | 7/2015 | Annapragada | A63B 69/0097 473/435 |
| 2017/0113114 | A1 | 4/2017 | Nugent | |
| 2020/0197770 | A1 | 6/2020 | Engler | |
| 2022/0241662 | A1 * | 8/2022 | Burk | A63B 71/022 473/435 |

* cited by examiner

FIG. 23
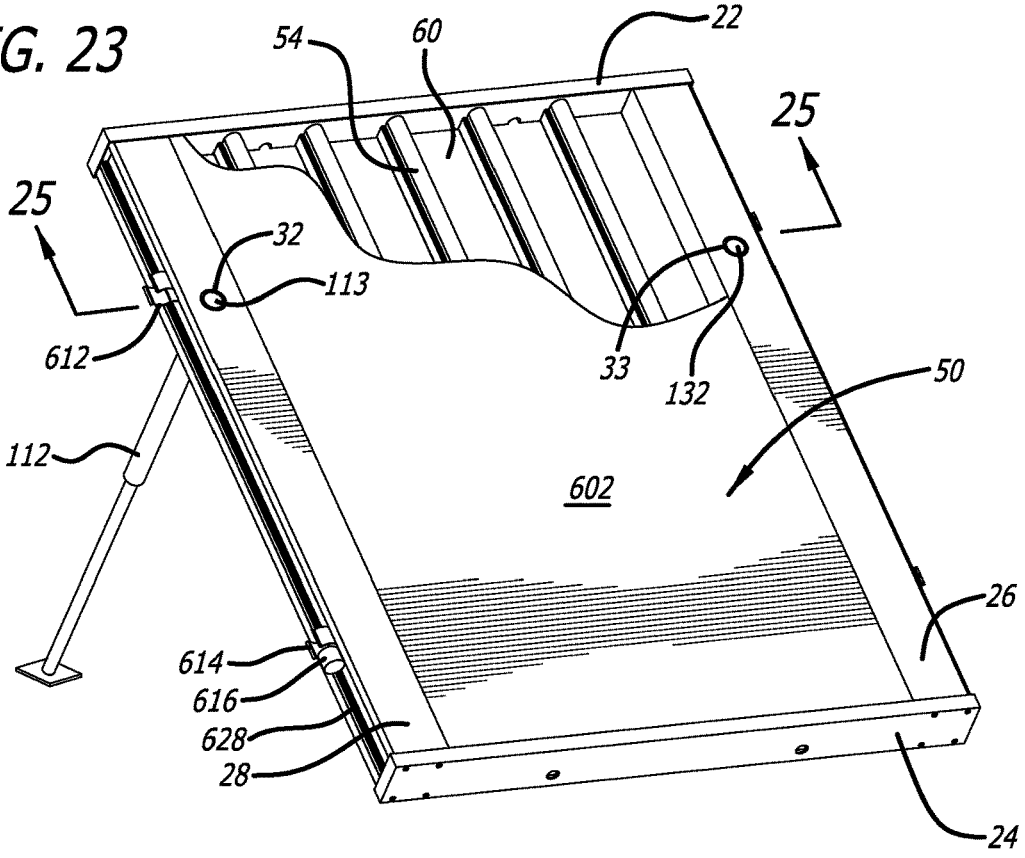
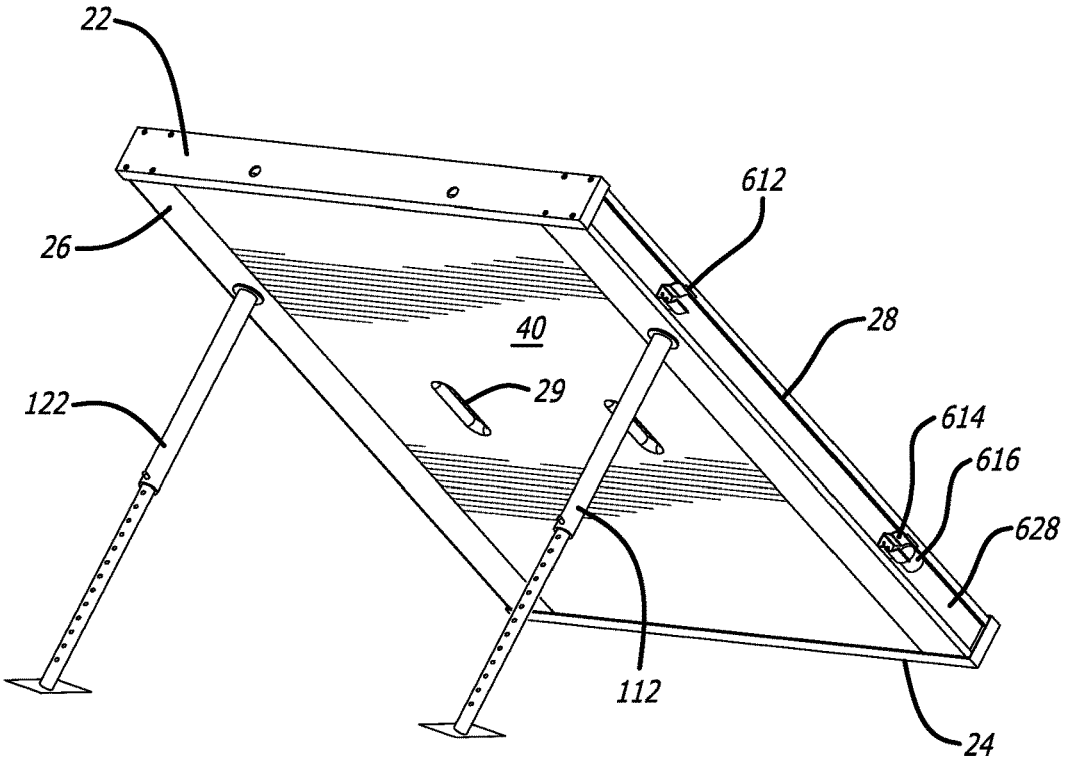
FIG. 24

PLAY AND PRACTICE APPARATUS, SYSTEM AND USE

This application claims the benefit of priority and is entitled to the filing date pursuant to 35 U.S.C. § 119(e) of U.S. Provisional Patent Application 63/144,846, filed Feb. 2, 2021, the content of which is hereby incorporated by reference in its entirety.

One ability that humans enjoy developing is the ability to track and interact with moving objects. This ability is most spectacularly displayed when people engage in various sporting activities that utilize some sort of moving object that a player or players must track and engage/react to, typically with speed and precision. This is made more difficult if the player or players are not privy to the moving object's path and/or speed. Indeed, this is the basis of many sporting activities that entail the tracking and engagement with, for example, a ball. Various sport activities utilize a ball that has imparted upon it a path, spin and/or velocity by opposing or team players requiring a quick, precise reaction from a player. Such reactions may include any one or combination of evading the ball, hitting the ball, passing the ball, catching the ball or hitting the ball with a hand/hands or arms or other sporting equipment, for example.

Various drills and practice to improve ball accuracy, ball placement, and ball striking techniques lead to the development of better players and success in many sporting activities. However, such repetitive practice is typically seen as tedious and may become less effective, as bad habits may take root when such drills are repetitive and lack variability in response from a player. Focusing on a visual moving target, such as a ball, can improve player concentration and interest. In particular, when players are younger and more likely to lose concentration and patience during such drills/practice, having an apparatus and methods for practicing ball tracking, anticipation, reflex speed, speed in hitting and accuracy that is non-repetitive and unpredictable not only improves such aspects of play, but also serves to provide non-monotonous, more engaging play and drilling. This is particularly useful if such play and/or practice drilling is done alone and without the encouragement and input into ball play that is typically provided by another player or players regardless of the age and skill of the user/player.

Thus, in one aspect it would be advantageous to have a convenient, re-positionable and transportable play and practice apparatus that provides a player/user with variable ball play that is imparted upon the ball by the surface of the apparatus upon which the ball contacts, and rebounds therefrom.

SUMMARY

Aspects of the present specification describes a portable ball play and practice apparatus comprising a board assembly and a stand assembly, and optionally a backstop assembly. A board assembly disclosed herein includes a first playing surface and a second playing surface substantially opposing the first playing surface where the first playing surface provides a different rebound effect when contacted by a ball in play relative to the second playing surface. In aspects, a board assembly disclosed herein can be a single component. In other aspects, a board disclosed herein can comprises two or more component parts. For example, a board assembly disclosed herein can include two component parts and further comprises a hinge mechanism connecting the two component parts and allowing the board assembly to be foldable along the hinge mechanism to define a transportable configuration. As another example, a board assembly disclosed herein can include two or more component parts and further comprises a connector system to create modular units that allow each component part to be reversibly coupled to another component part to create expanded first playing surface and a second playing surfaces.

A first playing surface disclosed herein can be a flat, planar surface having no projections. In aspects, a first playing surface disclosed herein can be defined by a first surface outer perimeter and a first surface playing region is enclosed by the first surface outer perimeter, where the first surface outer perimeter is provided to be substantially flush with the first surface playing region.

A second playing surface disclosed herein can comprise an irregular surface that provides an irregular rebound effect. In aspects, a second playing surface disclosed herein may include a second surface outer perimeter and a second surface playing region enclosed by the second surface outer perimeter, and the second surface perimeter comprising a frame projecting in a direction normal to a second surface playing region. In other aspects, a second playing surface disclosed herein comprises a plurality of spaced apart projections that defining furrows therebetween. In other aspects, the plurality of spaced apart projections can be elongated projections that are substantially parallel to one another and spaced apart at regular intervals to provide uniform furrows having substantially the same width and/or depth. Alternatively, the plurality of spaced apart projections can be elongated projections that are substantially parallel to one another and spaced apart at irregular intervals to provide non-uniform furrows having different widths and/or depths. In other aspects, the plurality of spaced apart projections can be elongated projections that are not parallel to one another and thus spaced apart at irregular intervals to provide non-uniform furrows having different widths and/or depths. In other aspects, a second playing surface disclosed herein comprises a pliable covering that conceals or otherwise masks the plurality of spaced apart projections.

A portable ball play and practice apparatus further comprises a stand assembly operationally affixed to a board assembly disclosed herein. A stand assembly disclosed herein can be non-adjustable (static) or adjustable. A stand assembly disclosed herein enabling the board assembly disclosed herein to be changeably positioned between a first position such that the first playing surface is positioned at a playable surface angle, and an alternate second position such that the substantially opposing second playing surface is positioned at the playable surface angle. The playable surface angle is defined by an angle of ninety degrees or more with respect to the horizon, i.e., the playable surface angle measured forwardly and from the playing surface upon which a ball is to be rebounded to a support surface upon which the stand assembly is disposed upon. Exemplary support surfaces include and are not limited to, in general, the ground, and in particular aspects a playing field, the sandy ground at a beach, an indoor court floor, and outdoor court floor or a grass playing field.

A portable ball play and practice apparatus further and optionally comprises a backstop assembly operationally affixed to a board assembly disclosed herein to prevent errant balls that fail to properly rebound off a board assembly disclosed herein from careening off away from a field of play. In aspects, a backstop assembly disclosed herein is a stand-alone component. In other aspects, a backstop assembly disclosed herein part of the portable ball play and practice apparatus.

Another aspect of the present specification describes a system comprising a portable ball play and practice apparatus disclosed herein and a ball capable of rebounding off of the first surface and off of the second surface. Exemplary balls can include, but are not limited to, any one or more of a volleyball, tennis ball, playground ball, racquetball, soccer ball or playground ball, or any combination thereof.

Another aspect of the present specification describes a kit that comprises a portable ball play and practice apparatus disclosed herein along with instructions on how to use a portable ball play and practice apparatus for practice drills and/or games. In aspects, a kit disclosed herein can further include a backstop assembly disclosed herein and/or a ball disclosed herein.

Another aspect of the present specification describes a method of using a portable ball play and practice apparatus disclosed herein, as well as game/drills that utilize the portable ball play and practice apparatus.

BRIEF DESCRIPTION OF DRAWINGS

The above and further advantages of this disclosure may be better understood by referring to the following description in conjunction with the accompanying drawings. The drawings illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention.

FIG. 6B showing an double inverted V-shaped configuration; and FIG. 6C showing a double V-shaped configuration;

FIG. 7B showing a projection having a generally tapered, curvilinear upper surface; and FIG. 7C shows a projection having a generally level, undulating or wavy upper surface.

FIG. 9B showing projections having an oblong cross-sectional shape; FIG. 9C showing projections having a polygonal cross-sectional shape; and FIG. 9D showing a combination of projections having different cross-sectional shaped geometries;

FIG. 10B showing a front plan view of a hinged board assembly disclosed herein also comprising removeable projections and securing lid; and FIG. 10C showing a top plan view of the hinged board assembly of FIG. 10B partially opened and showing a hinge;

FIG. 11B being a magnified top perspective view of the modular portable board assembly of FIG. 11A showing an exemplary mechanism for securing individual board assembly modules;

FIG. 23 is a front perspective view of a portable ball play and practice apparatus disclosed herein in an assembled state and showing a cutaway of a pliable covering to expose multi-component spaced apart projections;

FIG. 24 shows is a back perspective view of a portable ball play and practice apparatus of FIG. 23.

Figure 1:
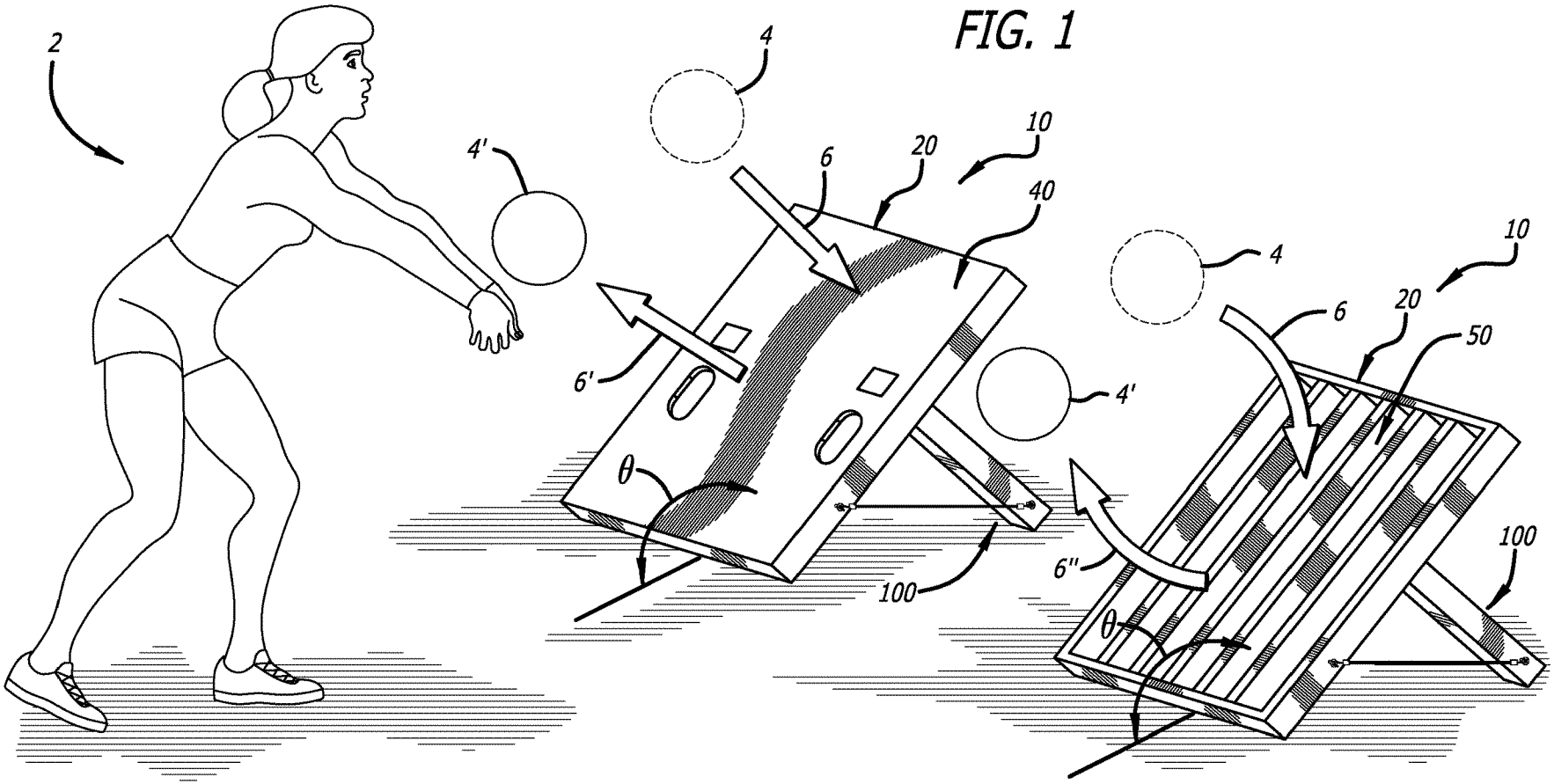
FIG. 1 shows an exemplary portable ball play and practice apparatus in two changeable positions, with one position having its first playing surface configured forwardly and in play position, the other position having its second playing surface configured forwardly and in play position.
Figure 2:
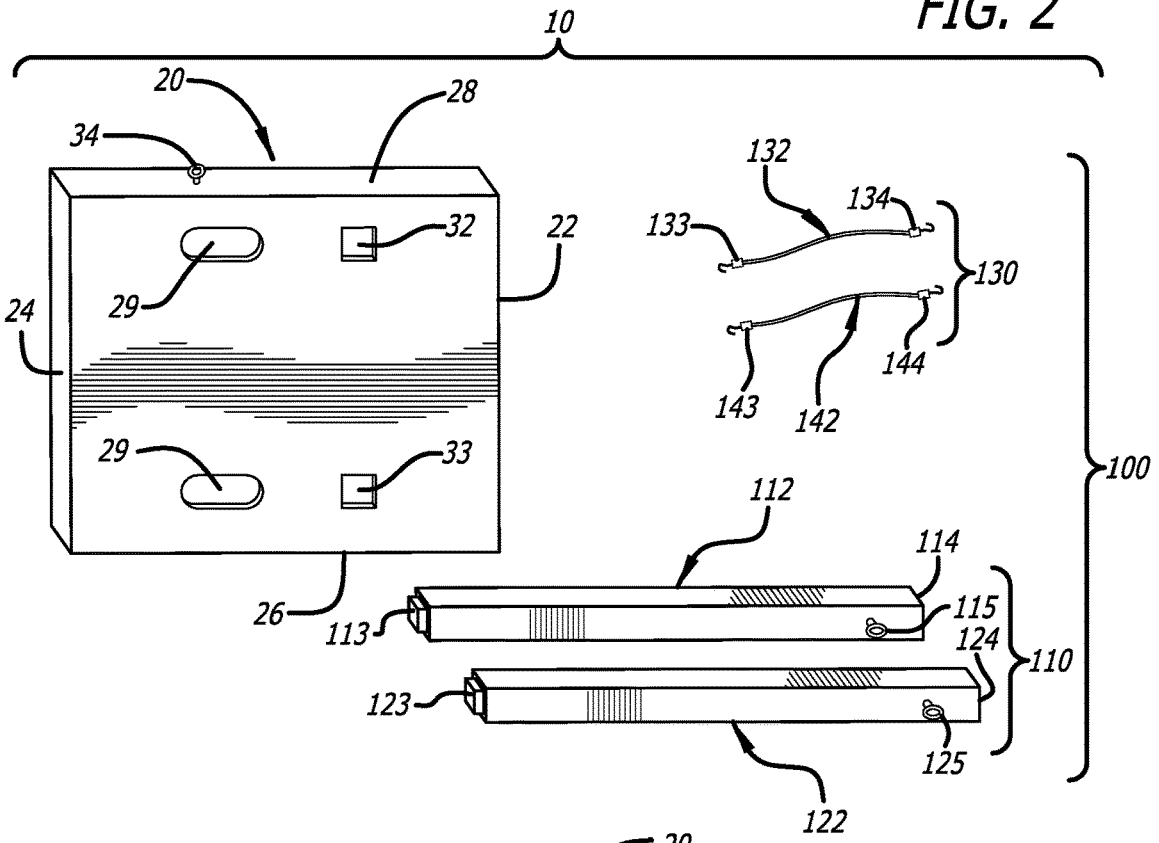
FIG. 2 is a front perspective view of a portable ball play and practice apparatus disclosed herein comprising a board assembly disclosed herein and a stand assembly disclosed herein.

Listing of Reference Numbers Associated with Drawings

| Ref No. | Element |
|---|---|
| 2 | User |
| 4 | Incoming ball (dashed line) |
| 4' | Rebounding ball (solid line) |
| 6 | Predictable incoming path of ball 4 |
| 6' | Predictable rebounding path of ball 4' |
| 6" | Unpredictable rebounding path of ball 4' |
| θ | Angle of play of board assembly 20 |
| $\theta_2$ | Angle of projection 54 |
| $\theta_3$ | Angle of projection 54 |
| 10 | Portable ball play and practice apparatus |
| 20 | Board assembly of apparatus 10 |
| 20' | Hinged board assembly of apparatus 10 |
| 20" | Modular board assembly of apparatus 10 |
| 20"' | Collapsible board assembly of apparatus 10 |
| 20L | Length of board assembly 10 |
| 20W | Width of board assembly 10 |
| 20D | Depth of board assembly 10 |
| 22 | Frame top of board assembly 20, 20', 20" |
| 22' | Frame top of board assembly 20"' |
| 24 | Frame bottom of board assembly 20, 20', 20" |
| 24' | Frame bottom of board assembly 20"' |
| 26 | First frame side of board assembly 20, 20', 20" |
| 26' | First frame side of board assembly 20"' |
| 28 | Second frame side of board assembly 20, 20', 20" |
| 28' | Second frame side of board assembly 20"' |
| 29 | Carry aperture of board assembly 20, 20', 20" |
| 30 | Upper securing rod aperture of first and second frame sides 26', 28', projections 54 |
| 31 | Lower securing rod aperture of first and second frame sides 26', 28', projections 54 |
| 32 | First engagement points of board assembly 20 |
| 32' | First engagement points of board assembly 20, 20', 20" |
| 33 | Second engagement points of board assembly 20, 20', 20" |
| 33' | Second engagement points of board assembly 20, 20', 20" |
| 34 | First attachment point of board assembly 20 |
| 34' | First attachment point of board assembly 20', 20" |
| 35 | Second attachment point of board assembly 20 |
| 35' | Second attachment point of board assembly 20', 20" |
| 37 | Net pole engagement point of board assembly 20, 20', 20" |
| 38 | Net pole engagement point of board assembly 20, 20', 20" |
| 40 | First playing surface of board assembly 20, 20', 20" |
| 42 | First surface of first playing surface 40 |
| 44 | Second surface of first playing surface 40 |
| 46 | First board cord of board assembly 20"' |
| 47 | Second board cord of board assembly 20"' |
| 48 | Third board cord of board assembly 20"' |
| 49 | Fastener of first, second and third board cords 46, 47, 48 |
| 50 | Second playing surface of board assembly 20, 20', 20" |
| 52 | Bottom surface of second playing surface 50 |
| 54 | Projection of second playing surface 50 |
| 54L | Length of projection 54 |
| 54W | Width of projection 54 |
| 54D | Maximum depth of projection 54 |
| 54d | Minimum depth of projection 54 |
| 56 | Top surface of projection 54 |
| 58 | Peg of removeable projection 54 |
| 59 | Hinge of board assembly 20' |
| 60 | Furrow of second playing surface 50 |
| 60L | Length of furrow 60 |
| 60W | Maximum width of furrow 60 |
| 60w | Minimum width of furrow 60 |
| 60D | Maximum depth of furrow 60 |
| 62 | Slot of frame top 22 |
| 64 | Slot of frame bottom 22 |
| 68 | Socket of second playing surface 50 |
| 70 | Recessed portion of top frame 22 |
| 72 | Securing lid of frame top 22 |
| 74 | Securing lid of frame bottom 24 |
| 76 | Hinge of securing lid 72, 74 |
| 77 | First board stabilizing rod of board assembly 20"' |
| 78 | Second board stabilizing rod of board assembly 20"' |
| 79 | Securing hole of first and second board stabilizing rods 77, 78 |
| 80 | Locking element of apparatus 10 |
| 82 | Securing rod of locking mechanism 80 |
| 84 | First holder of locking mechanism 80 |
| 86 | Second holder of locking mechanism 80 |
| 87 | First stabilizing cord of board assembly 20"' |
| 88 | Second stabilizing cord of board assembly 20"' |
| 89 | Securing pin of first and second board stabilizing rods 77, 78 |

-continued

| Listing of Reference Numbers Associated with Drawings | |
|---|---|
| Ref No. | Element |
| 90 | Connector system of modular board assembly 20" |
| 92 | Pin of connector system 90 |
| 93 | Head of pin 92 |
| 94 | Stem of pin 92 |
| 96 | Slot of connector system 90 |
| 97 | Head receiving portion of slot 96 |
| 98 | Channel portion of portion of slot 96 |
| 100 | Stand assembly of apparatus 10 |
| 110 | Support arm assembly of stand assembly 100 |
| 112 | First support arm of support arm assembly 110 |
| 112' | First support arm of support arm assembly 110 |
| 113 | Board assembly engagement portion of first arm support 112 |
| 113' | Board assembly engagement portion of first arm support 112' |
| 114 | Stabilizing pad engagement portion of first arm support 112 |
| 115 | Attachment point of first support arm 112 |
| 122 | Second support arm of support arm assembly 110 |
| 122' | Second support arm of support arm assembly 110 |
| 123 | Board assembly engagement portion of second arm support 122 |
| 123' | Board assembly engagement portion of second arm support 122' |
| 124 | Stabilizing pad engagement portion of second arm support 122 |
| 125 | Attachment point of second support arm 122 |
| 130 | Stabilizing assembly of stand assembly 100 |
| 132 | First tether of stabilizing assembly 130 |
| 133 | Board assembly engagement portion of first tether 132 |
| 134 | Support arm engagement portion of first tether 132 |
| 142 | Second tether of stabilizing assembly 130 |
| 143 | Board assembly engagement portion of second tether 142 |
| 144 | Support arm engagement portion of second tether 142 |
| 150 | First stabilizing pad of stabilizing assembly 130 |
| 152 | Attachment portion of first stabilizing pad 150 |
| 154 | Stabilizing portion of first stabilizing pad 150 |
| 160 | Second stabilizing pad of stabilizing assembly 130 |
| 162 | Attachment portion of second stabilizing pad 160 |
| 164 | Stabilizing portion of second stabilizing pad 160 |
| 210 | Swingable support arm assembly of stand assembly 100 |
| 212 | First swingable support arm of stand assembly 100 |
| 213 | Board assembly engagement portion of first swingable support arm 212 |
| 214 | Stabilizing foot engagement portion of first swingable support arm 212 |
| 215 | Securing bolt aperture of first swingable support arm 212 |
| 218 | Pivot joint of first swingable support arm 212 |
| 222 | Second swingable support arm of stand assembly 100 |
| 223 | Board assembly engagement portion of second swingable support arm 222 |
| 224 | Stabilizing foot engagement portion of second swingable support arm 222 |
| 228 | Pivot joint of second swingable support arm 222 |
| 230 | Stabilizing assembly of stand assembly 100 |
| 250 | First swingable stabilizing foot of stabilizing assembly 130 |
| 255 | Support arm slot of first swingable stabilizing foot 250 |
| 260 | Second swingable stabilizing foot of stabilizing assembly 130 |
| 262 | Board assembly hinge portion of second swingable stabilizing foot 260 |
| 264 | Stabilizing portion of second swingable stabilizing foot 260 |
| 265 | Support arm slot of second swingable stabilizing foot 260 |
| 266 | Securing bolt aperture of second swingable stabilizing foot 260 |
| 268 | Hinge of board assembly hinge portion 262 |
| 269 | Securing bolt of second swingable stabilizing foot 260 |
| 310 | Swingable support arm assembly of stand assembly 100 |
| 312 | First swingable support arm of stand assembly 100 |
| 313 | Board assembly engagement portion of first swingable support arm 312 |
| 314 | Stabilizing platform engagement portion of first swingable support arm 312 |
| 315 | Securing bolt aperture of first swingable support arm 312 |
| 318 | Pivot joint of first swingable support arm 312 |
| 322 | Second swingable support arm of stand assembly 100 |
| 323 | Board assembly engagement portion of second swingable support arm 322 |
| 324 | Stabilizing platform engagement portion of second swingable support arm 322 |
| 325 | Securing bolt aperture of second swingable support arm 322 |
| 328 | Pivot joint of second swingable support arm 322 |
| 330 | Stabilizing assembly of stand assembly 100 |
| 350 | Swingable stabilizing platform of stand assembly 100 |
| 351 | First side of swingable stabilizing platform 350 |
| 352 | Second side of swingable stabilizing platform 350 |
| 353 | Third side of swingable stabilizing platform 350 |
| 354 | Forth side of swingable stabilizing platform 350 |
| 355 | Top surface of swingable stabilizing platform 350 |
| 356 | Bottom surface of swingable stabilizing platform 350 |
| 362 | Board assembly hinge portion of swingable stabilizing platform 350 |
| 364 | Stabilizing portion of swingable stabilizing platform 350 |

-continued

| Listing of Reference Numbers Associated with Drawings | |
|---|---|
| Ref No. | Element |
| 366 | Securing bolt aperture of swingable stabilizing platform 350 |
| 368 | Hinge of board assembly hinge portion 362 |
| 369 | Securing bolt of swingable stabilizing platform 350 |
| 370 | Ballast of swingable stabilizing platform 350 |
| 372 | First net pole engagement point of swingable stabilizing platform 350 |
| 374 | Second net pole engagement point of swingable stabilizing platform 350 |
| 400 | Backstop assembly of apparatus 10 |
| 402 | First net pole of backstop assembly 400 |
| 404 | Net engagement portion of first net pole 402 |
| 406 | Platform engagement portion of first net pole 402 |
| 412 | Second net pole of backstop assembly 400 |
| 414 | Net engagement portion of second net pole 402 |
| 416 | Platform engagement portion of second net pole 402 |
| 420 | Net of backstop assembly 400 |
| 421 | First side of net 420 |
| 422 | Second side of net 420 |
| 423 | Third side of net 420 |
| 424 | Fourth side of net 420 |
| 426 | First net pole pocket of net 420 |
| 428 | Second net pole pocket of net 420 |
| 400' | Backstop assembly of apparatus 10 |
| 430 | Top return panel of backstop assembly 400' |
| 432 | Engagement point of top return panel 430 |
| 440 | First side return panel of backstop assembly 400' |
| 442 | Engagement point of first side return panel 440 |
| 450 | Second side return panel of backstop assembly 400' |
| 452 | Engagement point of second return panel 450 |
| 458 | Hinge top, first and second return panels 430, 440, 450 |
| 460 | Rebound tether of backstop assembly 400' |
| 462 | First engagement portion of first rebound tether 460 |
| 464 | Second engagement portion of first rebound tether 460 |
| 500 | Kit |
| 510 | Container of kit 500 |
| 512 | Handle of container 510 |
| 602 | Covering of second playing surface 50 |
| 610 | First clamp assembly of first frame side 26 |
| 612 | First clamp of first clamp assembly 610 |
| 614 | Second clamp of first clamp assembly 610 |
| 616 | Cup of second clamp 614 |
| 618 | Channel of first frame side 26 |
| 620 | Second clamp assembly of second frame side 28 |
| 622 | First clamp of second clamp assembly 620 |
| 624 | Second clamp of second clamp assembly 620 |
| 626 | Cup of second clamp 624 |
| 628 | Channel of second frame side 28 |
| 630 | Projection base of projection 54 |
| 632 | Base top of projection base 610 |
| 634 | Base bottom of projection base 610 |
| 636 | First base side of projection base 610 |
| 638 | Second base side of projection base 610 |
| 639 | Groove of base top 612 |
| 640 | Projection bumper of projection 54 |
| 642 | Bumper top of projection bumper 620 |
| 644 | Bumper bottom of projection bumper 620 |
| 646 | First bumper side of projection bumper 620 |
| 648 | Second bumper side of projection bumper 620 |
| 649 | Rigid of bumper bottom 622 |
| 650 | Cavity of projection 54 |

DETAILED DESCRIPTION

The present specification discloses a portable ball play and practice apparatus. It will be recognized that the principles of a portable ball play and practice apparatus disclosed herein may be utilized and embodied in many and varied forms, and that various materials, component parts and arrangements of components may be employed in its manufacture and/or use. In order to demonstrate these principles, the invention is described herein by reference to specific exemplary embodiments. The invention, however, is not limited to the specific forms illustrated and described in detail. A portable ball play and practice apparatus can be fabricated in a wide variety of shapes, sizes and colors, and can be used to provide entertainment, practice and drills for people of all ages, and will improve confidence for users of all skill levels.

A portable ball play and practice apparatus disclosed herein includes a board assembly and a stand assembly and optionally a backstop assembly. Although capable of permanent installation, a portable ball play and practice apparatus disclosed herein is sized and dimensioned to be conveniently transportable. This transportability characteristic allows a user to transport a portable ball play and practice apparatus disclosed herein to one location, such as, e.g., by hand, bicycle, or vehicle, where the portable ball play and practice apparatus can be assembled or otherwise setup for use. Once use has ended, a user can then disassemble a portable ball play and practice apparatus disclosed herein and transport it to a different location.

In some embodiments, a portable ball play and practice apparatus disclosed herein is a hand-held ball play and practice apparatus sized and dimensioned to be easily carried or otherwise transported by a single user. In some embodiments, portable ball play and practice apparatus disclosed herein can be used to perform exemplary volleyball drills or exercises, such as, e.g., a pepper sequence, either by a single or by multiple users. In addition, a 3-touch sequence (or double or single-touch sequence) may be employed to replicate the three contacts used in a competitive volleyball game.

A board assembly disclosed herein is double-sided having two opposing surfaces with a first playing surface on a first side and a second playing surface on a second side. Typically, a first playing surface have different playing characteristics relative to a second playing surface. For example, when contacted by a ball, a first playing surface can provide a different rebound effect of the ball relative to a rebounding effect of the ball achieved using a second playing surface. In a first playing position a board assembly disclosed herein is changeably positioned such that a first playing surface is forwardly facing and available for use and a second playing surface is rearwardly facing and available for operational engagement with one or more components of a stand assembly disclosed herein. In a second position a board assembly disclosed herein is changeably positioned such that a second playing surface is now forwardly facing and available for use and a first playing surface is now rearwardly facing and available for operational engagement with one or more components of a stand assembly disclosed herein. As such, a board assembly disclosed herein is changeable or reversable in that a user can select one of two different playing surfaces to use and then when desired switch to the other playing surface.

In some embodiments, a board assembly disclosed herein is configured as a single component (see, e.g., FIGS. 1-6, 10A, & 13-15). In some embodiments, a board assembly disclosed herein is configured as a hinged, two-piece component configured so that one piece can fold over onto the second piece (see, e.g., FIGS. 10B-C & 12). In some embodiments, a board assembly disclosed herein is configured to be modular and enable two or more board assemblies disclosed herein to be connected to each other (see, e.g., FIGS. 11A-B).

A stand assembly disclosed herein is dimensioned and sized to provide a stable support to a board assembly disclosed herein, particularly during use. In some embodiments, a stand assembly disclosed herein is configured to stably support a board assembly disclosed herein when either a first playing surface (see, e.g., FIGS. 1 & 3) or a second playing surface (see, e.g., FIGS. 1 & 4) is positioned for use. A stand assembly disclosed herein further enables a board assembly disclosed herein to be changeably positioned between a first playing position and a second playing surface. Furthermore, a stand assembly disclosed herein operationally positions a board assembly disclosed herein so that a forward-facing playable surface adopts an angle of play. The angle of play is defined by an angle of ninety degrees (90°) or more with respect to the horizon, i.e., the angle of play is measured from the support surface upon which the stand assembly is disposed upon to the forward-facing playable surface upon which a ball is to be rebounded. In some embodiments, a stand assembly disclosed herein is configured to stably support a board assembly disclosed herein on uneven, soft, or shifting ground, such as, e.g., sand. In some embodiments, a stand assembly disclosed herein is configured to stably support a board assembly disclosed herein on even or solid ground, such as, e.g., a floor of a building.

A backstop assembly disclosed herein is dimensioned and sized to prevent errant balls that fail to properly rebound off a board assembly disclosed herein from careening off away from a field of play, thereby minimizing the time required to chase down errant balls. In some embodiments, backstop assembly disclosed herein captures an errant ball to halt it from leaving a field of play such as when the errant ball fails to strike a board assembly disclosed herein or strike the board assembly in a manner that causes the errant ball to deflect away from the field of play (see, e.g., FIG. 14). In some embodiments, backstop assembly disclosed herein redirecting an errant ball back toward a field of play (see, e.g., FIG. 15). In some embodiments, a backstop assembly disclosed herein is configured to be operationally affixed or otherwise attached to other components of a portable ball play and practice apparatus disclosed herein, such as, e.g., a board assembly disclosed herein and/or a stand assembly disclosed herein (see, e.g., FIGS. 14 & 15). In some embodiments, a backstop assembly disclosed herein is configured to function as a stand-alone component unattached to other components of a portable ball play and practice apparatus disclosed herein, such as, e.g., a board assembly disclosed herein and/or a stand assembly disclosed herein.

Turning now to FIG. 1, an exemplary portable ball play and practice apparatus 10 is shown, illustrating its mode of operation and changeable or reversible characteristics. A first playing position shows a board assembly 20 where its forward-facing playing surface is a first playing surface 40 configured for use and providing an angle of play θ. A second playing position shows a board assembly 20 where its forward-facing playing surface is a second playing surface 50 configured for use and providing angle of play θ.

A user 2 may utilize a ball, such as, e.g., a volleyball, for a desired use such as, e.g., for play, exercise, practice, or drills. As shown here, an incoming ball 4 (depicted with a dashed line) represents a ball heading toward a forward-facing playing surface and a rebounding ball 4' (depicted with a solid line) represents a ball heading away from the forward-facing playing surface.

In some embodiments, user 2 engages with portable ball play and practice apparatus 10 in accordance with the teachings disclosed herein when forward-facing playing surface is first playing surface 40, with first playing surface 40 configured to interact with incoming ball 4 in a reasonably predictable manner. In this example, user 2 interacts with a ball, such as, e.g., by hitting, striking, or otherwise engaging the ball, causing the ball, referred to as incoming ball 4, to move toward first playing surface 40 along an incoming path 6 in a manner where incoming ball 4 strikes, hits or otherwise engages first playing surface 40. Such engagement causes incoming ball 4 to rebound away from first playing surface 40, now becoming rebounding ball 4', along a reasonably predicable rebounding path 6'. User 2 may now interact with rebounding ball 4', such as, e.g., by hitting, striking, or otherwise engaging rebounding ball 4', typically before rebounding ball 4' lands on a surface support, by, e.g., digging or setting rebound ball 4' up into the air or striking rebound ball 4' in a manner causing rebounding ball 4', which now once again become incoming ball 4, to move toward first playing surface 40 along incoming path 6. This engagement cycle continues for as long as user 2 desires such engagement or a ball becomes errant, such as, e.g., when incoming ball 4 fails to properly engage first playing surface 40 or when user 2 fails to properly interact with rebounding ball 4'.

In some embodiments, user 2 engages with portable ball play and practice apparatus 10 in accordance with the teachings of the present disclosure when forward-facing playing surface is second playing surface 50, with second playing surface 50 configured to interact with incoming ball 4 in an unpredictable manner. In this example, user 2 causes incoming ball 4, to move toward second playing surface 50 along an incoming path 6 in a manner where incoming ball 4 engages second playing surface 50. Such engagement causes incoming ball 4 to rebound away from second playing surface 50, now becoming rebounding ball 4', along an unpredictable rebounding path 6". User 2 may now engage rebounding ball 4', typically before rebounding ball 4' lands on a surface support, by, e.g., digging or setting rebound ball 4' up into the air or striking rebound ball 4' in a manner causing rebounding ball 4', which now once again become incoming ball 4, to move toward first playing surface 40 along incoming path 6. This engagement cycle continues for as long as user 2 desires such engagement or a ball becomes errant, such as, e.g., when incoming ball 4 fails to properly engage first playing surface 40 or when user 2 fails to properly interact with rebounding ball 4'. In some embodiments, second playing surface 50 can be covered with a flexible cover, such, as, e.g., a fabric or thin flexible material, with opaque characteristics that hides second playing surface 50 from the view of user 2 in order to further reduce the ability of user 2 from anticipating unpredictable rebounding path 6" that rebound ball 4' might travel.

As shown throughout the specification, portable ball play and practice apparatus 10, when in use, is positioned such that whatever playing surface is forward-facing for use, the forward-facing playing surface must be at an angle of play θ of more than 90° so that rebounding path 6', 6" keeps rebounding ball 4' airborne for a sufficient time that user 2 can meaningfully engage rebounding ball 4' in accordance with the teachings disclosed herein.

Figure 3:
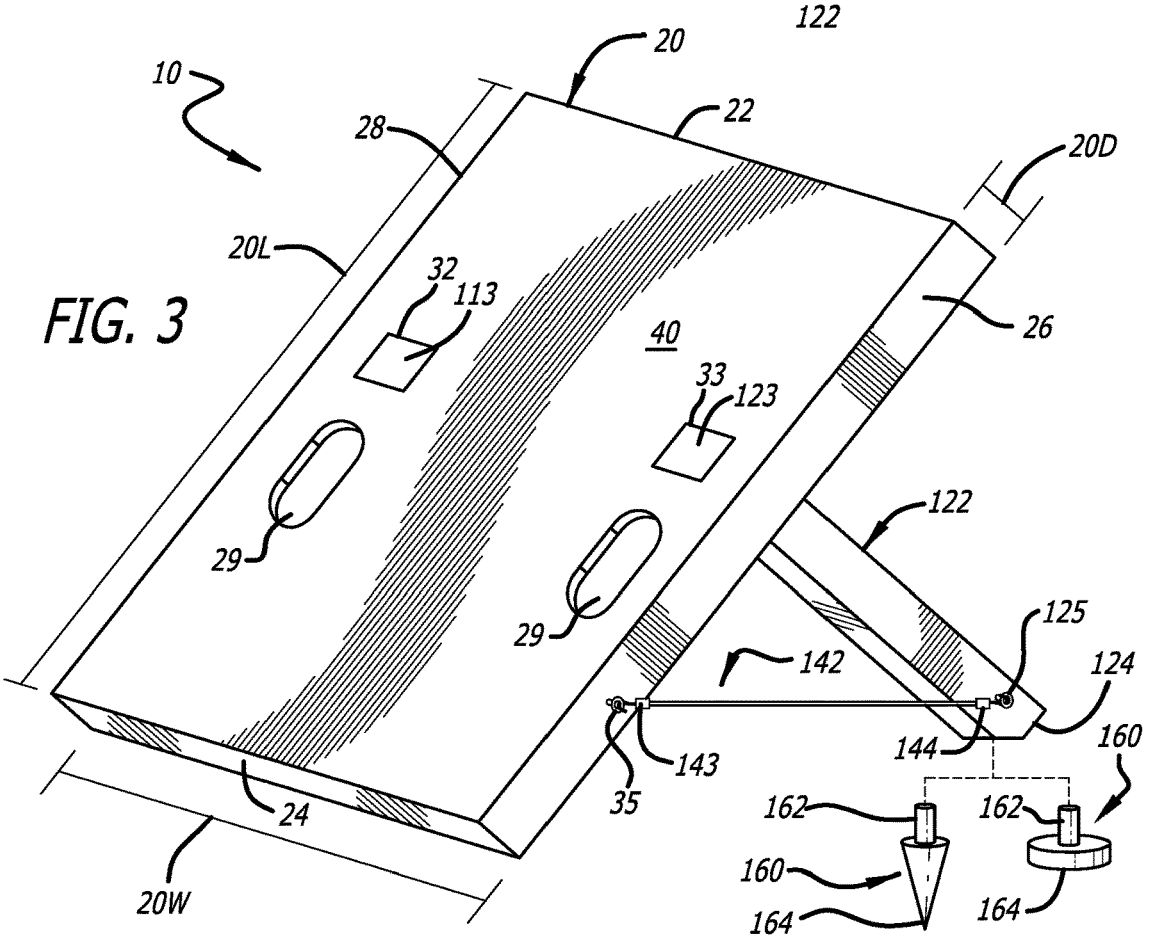
FIG. 3 is a front perspective view of a portable ball play and practice apparatus disclosed herein having its board assembly configured with its first playing surface configured forwardly and in play position.

In some embodiments, and with reference to FIGS. 1,3-5, a portable ball play and practice apparatus 10 comprises a board assembly 20 and a stand assembly 100. A board assembly disclosed herein comprises one or more sides, a first surface and a second surface. In some embodiments, and as shown in FIG. 3, board assembly 20 is configured to have a length 20L, a width 20W and depth 20D that defines a first surface comprising a first playing surface 40 and a second surface comprising a second playing surface 50. First playing surface 40 and second playing surface 50 provide surfaces that are different from one another such that at least one rebound effect on a ball provided by first playing surface 40 and second playing surface 50 are different one from the other. First playing surface 40 and second playing surface 50 may be made of materials different one from the other, or textures different one from the other, or may have surface structures different one from the other, to provide the different rebound effects between the first and second playing surfaces 40, 50. A board assembly disclosed herein is typically composed of ridged and durable materials such as, e.g., wood, metal, fiberglass, hard plastic, and the like.

In some embodiments, and referring to FIGS. 2-6A-C, 10B, 110, 12, 13, 18, 21, & 22-24, board assembly 20 is a four-sided structure with a frame top 22, a frame bottom 24, a first side frame 26 and a second frame side 28. Frame top 22 is opposite to frame bottom 24 and frame top 22 is generally parallel to frame bottom 24. Similarly, first frame side 26 is opposite to second frame side 28 and first frame side 26 is generally parallel to second frame side 28. First and second frame sides 26, 28 span between frame top and bottom 22, 24 and are substantially perpendicular to frame top and bottom 22, 24. In some embodiments, frame top 22, frame bottom 24, first frame side 26 and second frame side 28 are each solid structures while in other embodiments these components can be box-like structures with hollow cavities. For example, as shown in FIGS. 22-25 first and second frame sides 26, 28 are each four-sided structures forming an internal cavity. One advantage of such four-sided first and second frame sides 26, 28 is that these structures provide additional rigidity to board assembly 20 to provide more stability during use.

Figure 25:
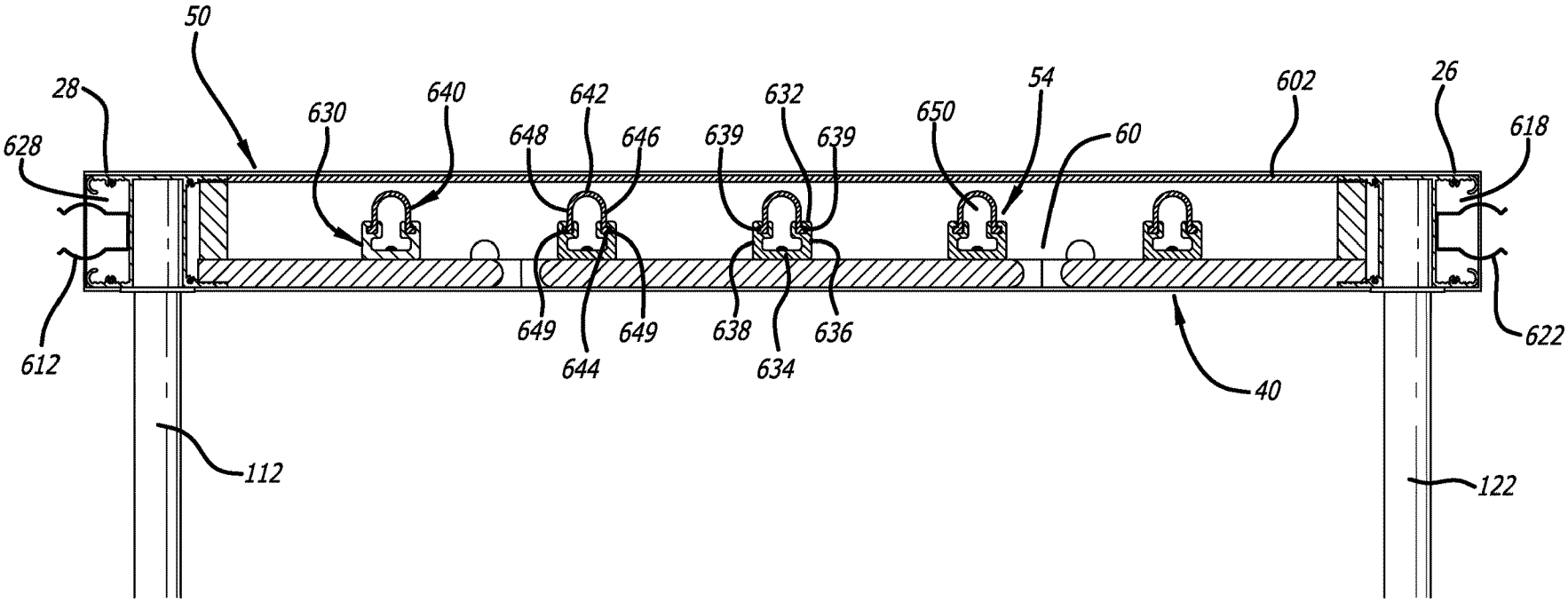
FIG. 25 is cross-sectional view of a board assembly disclosed herein, showing multi-component spaced apart projections.

In some embodiments, first and second frame sides 26, 28 can each comprise a clamp assembly used to secure one or more components of a stand assembly disclosed herein. For example, as shown in FIGS. 22-25, first frame side 26 includes a first clamp assembly 610 and second frame side 28 includes a second clamp assembly 620. In some embodiments, and referring to FIG. 22, first clamp assembly 610 comprises a first clamp 612 and a second clamp 614 while second clamp assembly 620 comprises a first clamp 622 and a second clamp 624. In this example, first and second clamps 612, 614 and used to secure first support arm 112 while first and second clamps 622, 624 and used to secure second support arm 122. In some embodiments, second clamps 614, 624 further include cups 616, 626 respectively, which help properly orientate a component of a stand assembly to ensure quick and correct attachment of the component. In some embodiments, first and second frame sides 26, 28 can form a channel to create a depression or inset that partially or fully contains first and second clamp assemblies 610, 620 as well as one or more components of a stand assembly disclosed herein. For example, as best shown in FIGS. 24 & 25, first frame side 26 comprise channel 618, and second frame side 28 comprise channel 628. Such arrangement provides a useful means to compactly store one or more stand assemblies as well as creates a more clean and aesthetically pleasing appearance to play and practice apparatus 10.

Referring to FIG. 3, board assembly 20 can be provided having any useful dimension and size. In some embodiments, board assembly 20 can have a length 20L of, e.g., at least 20 inches, at least 24 inches, at least 28 inches, at least 32 inches, at least 36 inches, at least 40 inches, at least 48 inches, at least 52 inches, at least 56 inches, or at least 60 inches. In some embodiments, board assembly 20 can have a length 20L of, e.g., at most 20 inches, at most 24 inches, at most 28 inches, at most 32 inches, at most 36 inches, at most 40 inches, at most 48 inches, at most 52 inches, at most 56 inches, or at most 60 inches. In some embodiments, board assembly 20 can have a length 20L of, e.g., about 20 inches to about 30 inches, about 20 inches to about 40 inches, about 20 inches to about 50 inches, about 20 inches to about 60 inches, about 24 inches to about 30 inches, about 24 inches to about 36 inches, about 24 inches to about 42 inches, about 24 inches to about 48 inches, about 24 inches to about 54 inches, about 24 inches to about 60 inches, about 30 inches to about 36 inches, about 30 inches to about 42 inches, about 30 inches to about 48 inches, about 30 inches to about 54 inches, about 30 inches to about 60 inches, about 36 inches to about 42 inches, about 36 inches to about 48 inches, about 36 inches to about 54 inches, about 36 inches to about 60 inches, about 40 inches to about 48 inches, about 40 inches to about 54 inches, about 40 inches to about 60 inches, about 48 inches to about 54 inches, or about 48 inches to about 60 inches.

In some embodiments, and referring to FIG. 3, board assembly 20 can have a width 20W of, e.g., at least 12 inches, at least 16 inches, at least 20 inches, at least 24 inches, at least 28 inches, at least 32 inches, at least 36 inches, at least 40 inches, at least 48 inches, at least 52 inches, at least 56 inches, or at least 60 inches. In some embodiments, board assembly 20 can have a width 20W of, e.g., at most 12 inches, at most 16 inches, at most 20 inches, at most 24 inches, at most 28 inches, at most 32 inches, at most 36 inches, at most 40 inches, at most 48 inches, at most 52 inches, at most 56 inches, or at most 60 inches. In some embodiments, board assembly 20 can have a width 20W of, e.g., about 12 inches to about 24 inches, about 16 inches to about 24 inches, about 16 inches to about 30 inches, about 20 inches to about 30 inches, about 20 inches to about 40 inches, about 20 inches to about 50 inches, about 20 inches to about 60 inches, about 24 inches to about 30 inches, about 24 inches to about 36 inches, about 24 inches to about 42 inches, about 24 inches to about 48 inches, about 24 inches to about 54 inches, about 24 inches to about 60 inches, about 30 inches to about 36 inches, about 30 inches to about 42 inches, about 30 inches to about 48 inches, about 30 inches to about 54 inches, about 30 inches to about 60 inches, about 36 inches to about 42 inches, about 36 inches to about 48 inches, about 36 inches to about 54 inches, about 36 inches to about 60 inches, about 40 inches to about 48 inches, about 40 inches to about 54 inches, about 40 inches to about 60 inches, about 48 inches to about 54 inches, or about 48 inches to about 60 inches.

In some embodiments, and referring to FIG. 3, board assembly 20 can have a depth 20D of, e.g., at least 0.5 inches, at least 0.75 inches, at least 1 inch, as least 1.5 inches, at least 2 inches, at least 2.5 inches, at least 3 inches, at least 3.5 inches, at least 4 inches, at least 4.5 inches, or at least 5 inches. In some embodiments, board assembly 20 can have a depth 20D of, e.g., at most 0.5 inches, at most 0.75 inches, at most 1 inch, as most 1.5 inches, at most 2 inches, at most 2.5 inches, at most 3 inches, at most 3.5 inches, at most 4 inches, at most 4.5 inches, or at most 5 inches. In some embodiments, board assembly 20 can have a depth 20D of, e.g., about 0.5 inches to about 1 inch, about 0.5 inches to about 1.5 inches, about 0.5 inches to about 2 inches, about 0.5 inches to about 2.5 inches, about 0.5 inches to about 3 inches, about 0.5 inches to about 3.5 inches, about 0.5 inches to about 4 inches, about 0.5 inches to about 4.5 inches, about 0.5 inches to about 5 inches, about 1 inch to about 1.5 inches, about 1 inch to about 2 inches, about 1 inch to about 2.5 inches, about 1 inch to about 3 inches, about 1 inch to about 3.5 inches, about 1 inch to about 4 inches, about 1 inch to about 4.5 inches, about 1 inch to about 5 inches, about 1.5 inches to about 2 inches, about 1.5 inches to about 2.5 inches, about 1.5 inches to about 3 inches, about 1.5 inches to about 3.5 inches, about 1.5 inches to about 4 inches, about 1.5 inches to about 4.5 inches, about 1.5 inches to about 5 inches, about 2 inches to about 2.5 inches, about 2 inches to about 3 inches, about 2 inches to about 3.5 inches, about 2 inches to about 4 inches, about 2 inches to about 4.5 inches, about 2 inches to about 5 inches, about 2.5 inches to about 3 inches, about 2.5 inches to about 3.5 inches, about 2.5 inches to about 4 inches, about 2.5 inches to about 4.5 inches, about 2.5 inches to about 5 inches, about 3 inches to about 3.5 inches, about 3 inches to about 4 inches, about 3 inches to about 4.5 inches, about 3 inches to about 5 inches, about 3.5 inches to about 4 inches, about 3.5 inches to about 4.5 inches, about 3.5 inches to about 5 inches, about 4 inches to about 4.5 inches, about 4 inches to about 5 inches, or about 4.5 inches to about 5 inches.

Still referring to FIG. 3, portable ball play and practice apparatus 10 is shown in an assembled configuration where a user can engage with first playing surface 40. In some embodiments, and as shown in FIG. 3, first playing surface 40 is characterized by a substantially flat, planar surface, having no significant projections or depressions, the substantially flat, planar surface being flush or substantially flush with a first surface 42, a second surface 44, frame top 22, frame bottom 24, first frame side 26, and second frame side 28. Second frame surface 44 is opposite first surface 42 and in some embodiments, second surface 44 is a bottom of second playing surface 50. The smooth flat surface provided by first playing surface 40 allows for a substantially predicable rebound effect of a ball interacting with first playing surface 40. This predicable rebound effect is useful for warm-up exercises or practice drills designed to work on ball control and/or consistent body position or movement of a user. In embodiments, as discussed below, first playing surface 40 can be absent.

Figure 4:
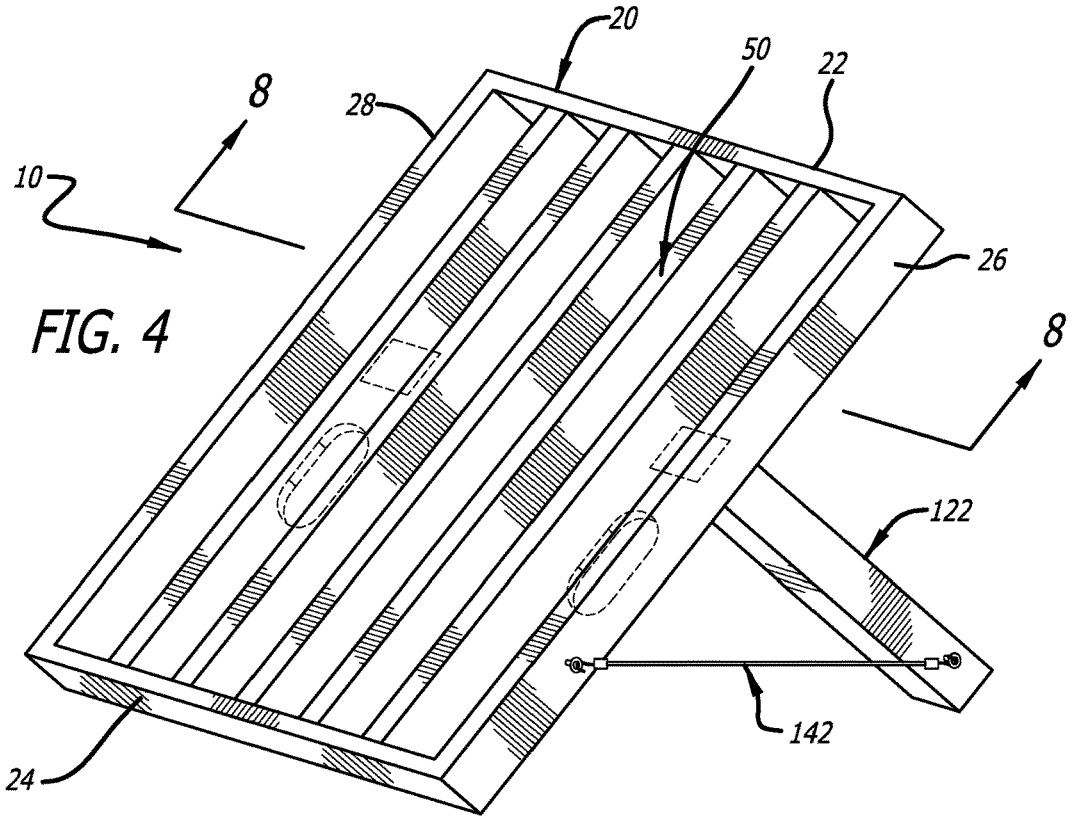
FIG. 4 is a front perspective view of a portable ball play and practice apparatus of FIG. 3 having its board assembly configured with its second playing surface configured forwardly and in play position.
Figure 5:
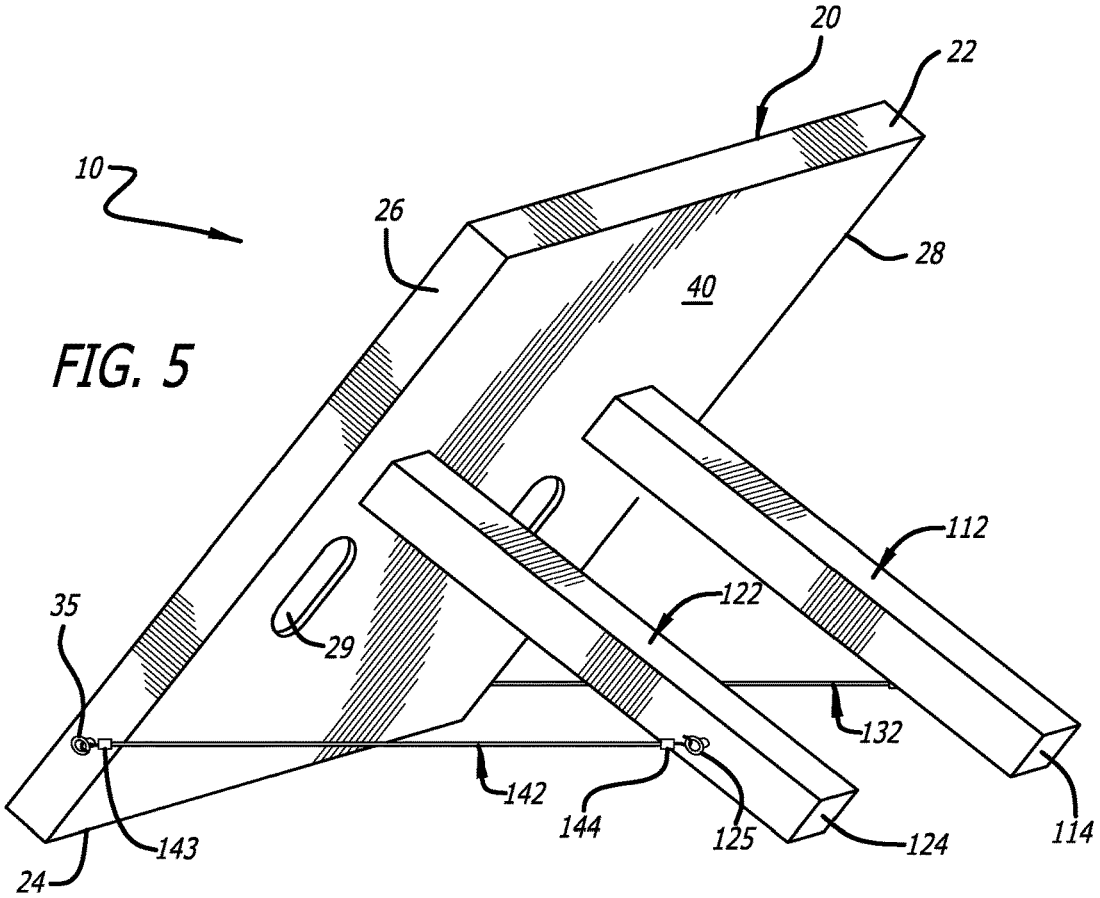
FIG. 5 is a back perspective view of a portable ball play and practice apparatus of FIG. 4, showing its first playing surface in the rearwardly facing position.

Referring to FIG. 4, portable ball play and practice apparatus 10 is shown in an assembled configuration where a user can engage with second playing surface 50. Second playing surface 50 is different from first playing surface 40 in terms of providing a desired different rebound effect relative to first playing surface 40. In some embodiments, and as shown in FIGS. 4 & 6A-C, second playing surface 50 is characterized by plurality of spaced apart projections 54 which, in conjunction with a bottom surface 52 of second playing surface 50 create a plurality of furrows 60. In some embodiments, bottom surface 52 of second playing surface 50 and second surface 44 of first playing surface 40 are the same structure. As shown in FIG. 4, frame top 22, frame bottom 24, first frame side 26, and second frame side 28 each can be configured as a projection 54. The plurality or projections and furrows 54, 60 provided by second playing surface 50 allows for unexpected and unpredictable rebound effect of a ball interacting with second playing surface 50. This unpredictable rebound effect is useful for increasing the skill level of a user or providing one or more users with a more challenging game. For example, a ball could strike a single projection 54 could make contact with a left or right edge of projection 54 causing the ball to rebound at an angle from the direction of the incoming path of the ball causing the user to shift position right or left in order to play the rebounding ball. Alternatively, a ball striking a single projection 54 could make contact with a central portion of projection 54 causing the ball to rebound in a direction similar to the incoming path of the ball but with enhanced speed causing the rebounding ball to return more quickly to the user causing the user to react more quickly than anticipated to play the rebounding ball and/or further away from the user causing the user to shift position backwards in order to play the rebounding ball. As another example, a ball could strike two projections 54 at the same or similar time which would retard the rebounding speed of the ball making the user to quickly travel forward towards portable ball play and practice apparatus 10 in order to play the rebounding ball. As another example, a ball striking furrow 60 would cause the ball to rebound in a direction similar to the incoming path of the ball. While this rebounding effect could be straightforward, the possibility that the rebounding ball could travel in a direction to the left, right, in front of or in back of the users current position, makes it difficult to ascertain which rebounding effect will occur, thereby increasing the unpredictable rebounding effect experienced by the user.

Figure 22:
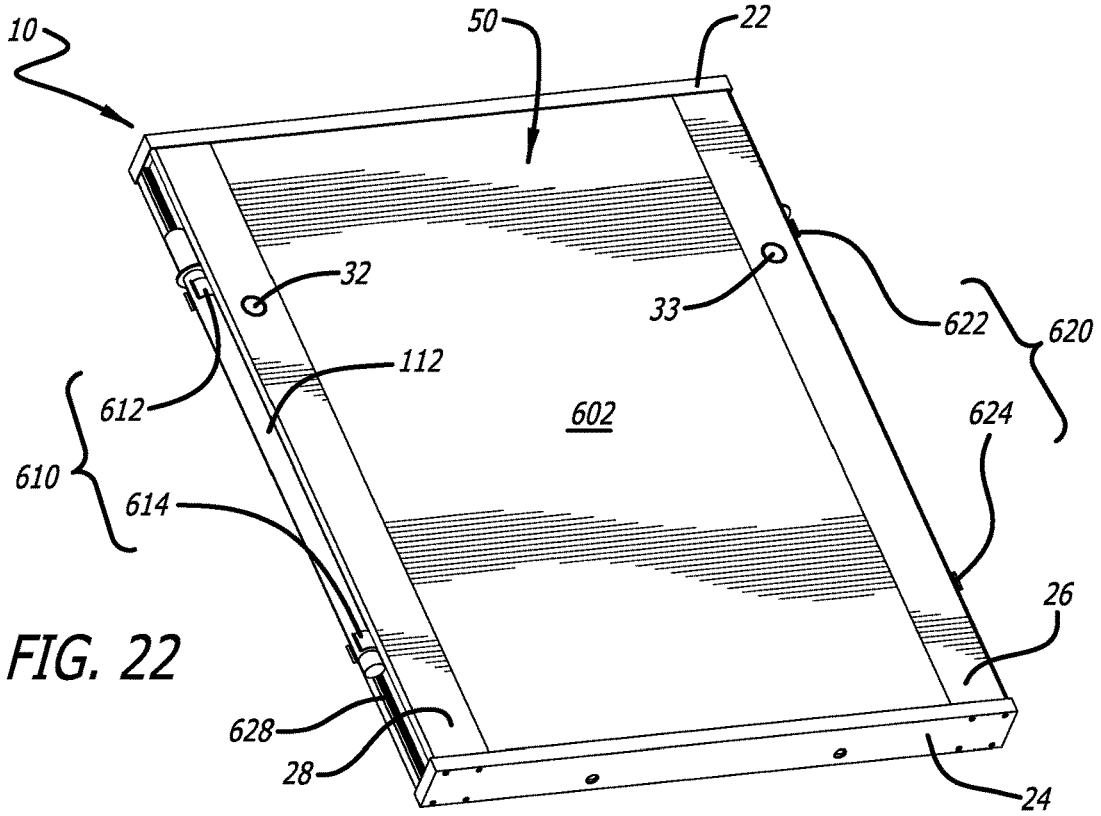
FIG. 22 is a front perspective view of a portable ball play and practice apparatus disclosed herein in a disassembled state.

In some embodiments, and as shown in FIGS. 22, 23 & 25, a second playing surface 50 comprises a pliable covering 602 that conceals or otherwise masks the plurality of spaced apart projections. Such concealment further increases the unpredictability of the rebounding effect on a rebounding ball, further increasing the difficulty by the user in ascertaining which rebounding effect will occur. In aspects of these embodiments, a pliable covering disclosed herein can be any flexible and/or elastic material that can conceal the plurality of spaced apart projections of a second playing surface disclosed herein, including, without limitation, a neoprene or athletic cloth material.

In some embodiments, plurality of projections 54 include, e.g., at least 2 projections, at least 3 projections, at least 3 projections, at least 5 projections, at least 6 projections, at least 7 projections, at least 8 projections, at least 9 projections, at least 10 projections. In some embodiments, plurality of projections include, e.g., at most 2 projections, at most 3 projections, at most 3 projections, at most 5 projections, at most 6 projections, at most 7 projections, at most 8 projections, at most 9 projections, at most 10 projections. In some embodiments, plurality of projections include, e.g., about 2 projections to about 4 projections, about 2 projections to about 5 projections, about 2 projections to about 6 projections, about 2 projections to about 7 projections, about 2 projections to about 8 projections, about 3 projections to about 4 projections, about 3 projections to about 5 projections, about 3 projections to about 6 projections, about 3 projections to about 7 projections, about 3 projections to about 8 projections, about 4 projections to about 5 projections, about 4 projections to about 6 projections, about 4 projections to about 7 projections, about 4 projections to about 8 projections, about 5 projections to about 6 projections, about 5 projections to about 7 projections, about 5 projections to about 8 projections, about 6 projections to about 7 projections, about 6 projections to about 8 projections, or about 7 projections to about 8 projections. In some embodiments, plurality of projections include, e.g., about 5 projections to about 10 projections, about 5 projections to about 15 projections, about 5 projections to about 20 projections, about 10 projections to about 15 projections, about 10 projections to about 20 projections, or about 15 projections to about 20 projections.

Typically, when considering first and second frame sides 26, 28, there will be one more projection 54 relative to furrows 60 on any given second playing surface 50. In some embodiments, plurality of furrows 60 include, e.g., at least 2 furrows, at least 3 furrows, at least 3 furrows, at least 5 furrows, at least 6 furrows, at least 7 furrows, at least 8 furrows, at least 9 furrows, at least 10 furrows. In some embodiments, plurality or furrows 60 include, e.g., at most 2 furrows, at most 3 furrows, at most 3 furrows, at most 5 furrows, at most 6 furrows, at most 7 furrows, at most 8 furrows, at most 9 furrows, at most 10 furrows. In some embodiments, plurality or furrows 60 include, e.g., about 2 furrows to about 4 furrows, about 2 furrows to about 5 furrows, about 2 furrows to about 6 furrows, about 2 furrows to about 7 furrows, about 2 furrows to about 8 furrows, about 3 furrows to about 4 furrows, about 3 furrows to about 5 furrows, about 3 furrows to about 6 furrows, about 3 furrows to about 7 furrows, about 3 furrows to about 8 furrows, about 4 furrows to about 5 furrows, about 4 furrows to about 6 furrows, about 4 furrows to about 7 furrows, about 4 furrows to about 8 furrows, about 5 furrows to about 6 furrows, about 5 furrows to about 7 furrows, about 5 furrows to about 8 furrows, about 6 furrows to about 7 furrows, about 6 furrows to about 8 furrows, or about 7 furrows to about 8 furrows. In some embodiments, plurality or furrows 60 include, e.g., about 5 furrows to about 10 furrows, about 5 furrows to about 15 furrows, about 5 furrows to about 20 furrows, about 10 furrows to about 15 furrows, about 10 furrows to about 20 furrows, or about 15 furrows to about 20 furrows.

Each of the plurality of projections 54 is a linear structure having a polygonal or curvilinear cross-section shape defined by a length 54L, a width 54W, and depth 54D and has a first end, a second end, and a top surface 56. As discussed below, length 54L of each of the plurality of projections 54 will depend on the patterns created and will be defined by the length required to configure a particular projection 54. In some embodiments, and referring to FIGS. 6A-C, a particular projection 54 can be configured to have a length 54L so that its first end will abut frame top 22 and its second end will abut frame bottom 24. In some embodiments, and referring to FIGS. 6A-C, a particular projection 54 can be configured to have a length 54L so that its first end will abut first frame side 26 and its second end will abut frame bottom 24. In some embodiments, and referring to FIGS. 6A-C, a particular projection 54 can be configured to have a length 54L so that its first end will abut second frame side 28 and its second end will abut frame bottom 24. In some embodiments, a particular projection 54 can be configured to have a length 54L so that its first end will abut frame top 22 and its second end will abut first frame side 26. In some embodiments, a particular projection 54 can be configured to have a length 54L so that its first end will abut frame top 22 and its second end will abut second frame side 28.

As best seen in cross-sectional views of the plurality of projections 54 in FIGS. 6A-C, 8, 9A-C, & 10A, each of the plurality of projections 54 will typically have width 54W of about 0.25 inches to about 1 inch as measured from a portion of a particular projection that abuts with bottom surface 52 of second playing surface 50. In some embodiments, each of the plurality of projections 54 can have width 54W as measured from a portion of a particular projection that abuts with bottom surface 52 of second playing surface 50 of, e.g., at least 0.25 inches, at least 0.5 inches, at least 0.75 inches, or at least 1 inch. In some embodiments, each of the plurality of projections 54 can have width 54W as measured from a portion of a particular projection that abuts with bottom surface 52 of second playing surface 50 of, e.g., at most 0.25 inches, at most 0.5 inches, at most 0.75 inches, or at most 1 inch. In some embodiments, each of the plurality of projections 54 can have width 54W as measured from a portion of a particular projection that abuts with bottom surface 52 of second playing surface 50 of, e.g., about 0.25 inches to about 0.5 inches, about 0.25 inches to about 0.75 inches, about 0.25 inches to about 1 inch, about 0.5 inches to about 0.75 inches, about 0.5 inches to about 1 inch, or about 0.75 inches to about 1 inch.

Figure 6A:
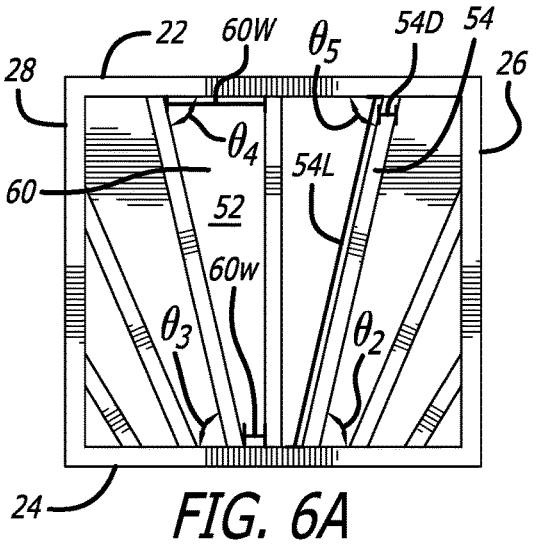
FIGS. 6A-C are each front plan views of a board assembly disclosed herein showing exemplary arrangements of projections in accordance with aspects of the present disclosure with FIG. 6A showing an upward radiating configuration.
Figure 9A:
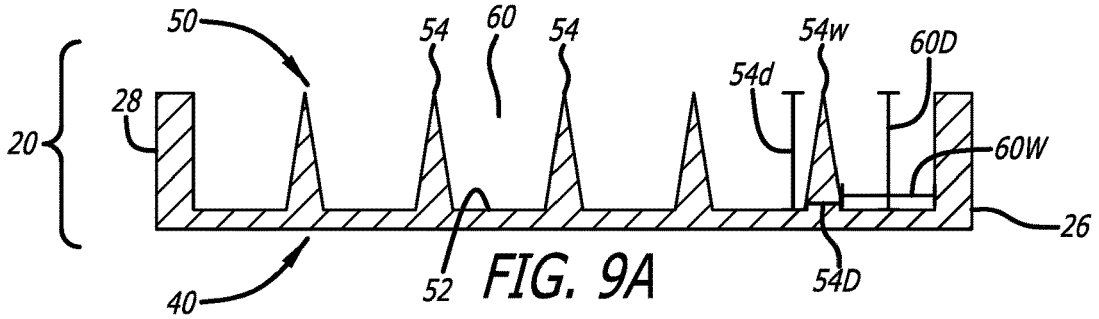
FIGS. 9A-D are each cross-sectional views of a board assembly disclosed herein, showing additional exemplary geometries of spaced apart projections and furrows of its second playing surface useful in accordance with aspects of the present disclosure with FIG. 9A showing projections having a triangular cross-sectional shape.
Figure 9B:
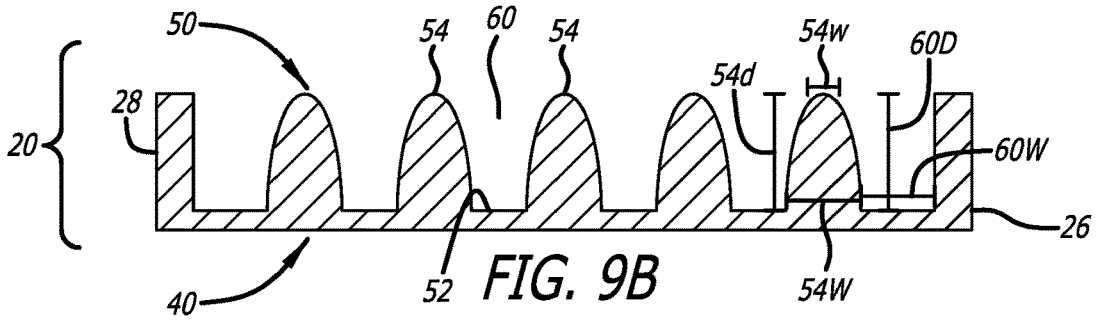
Figure 9C:
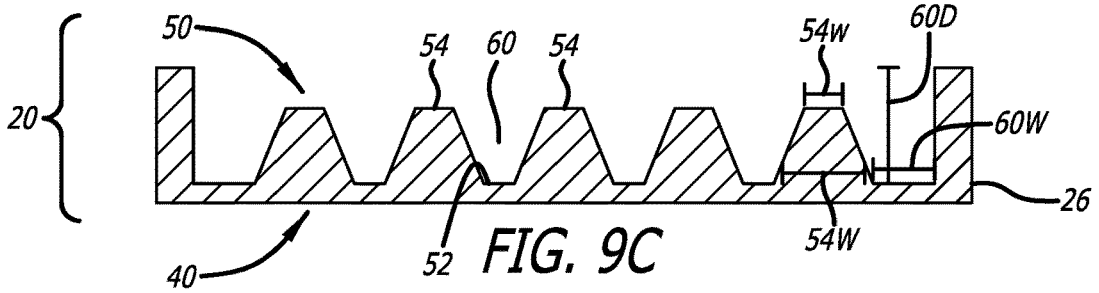
Figure 10A:
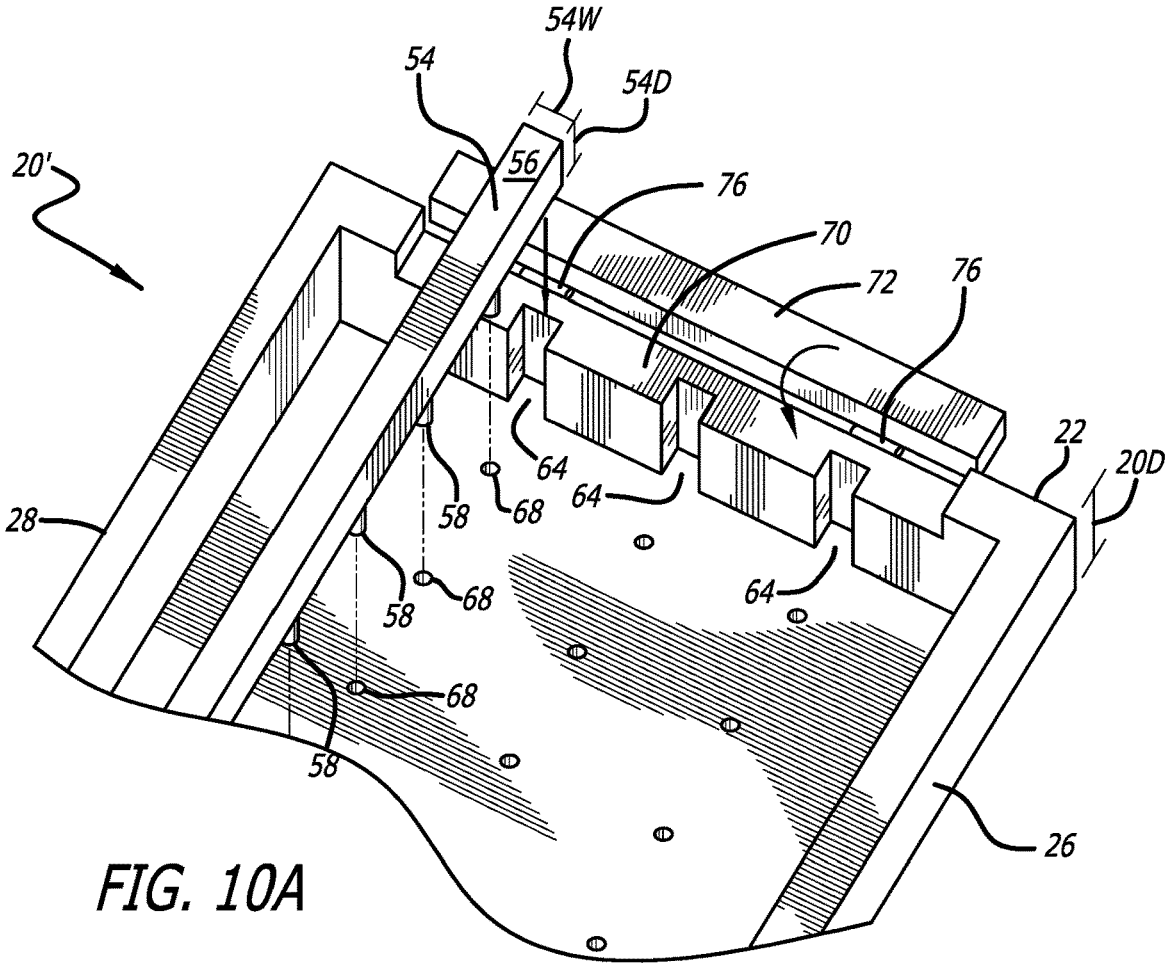
FIGS. 10A-C are views of another exemplary board assembly disclosed herein comprising removeable projections and securing lid closing thereover provided in accordance with aspects the present disclosure with FIG. 10A showing a top perspective view thereof.
Figure 10C:
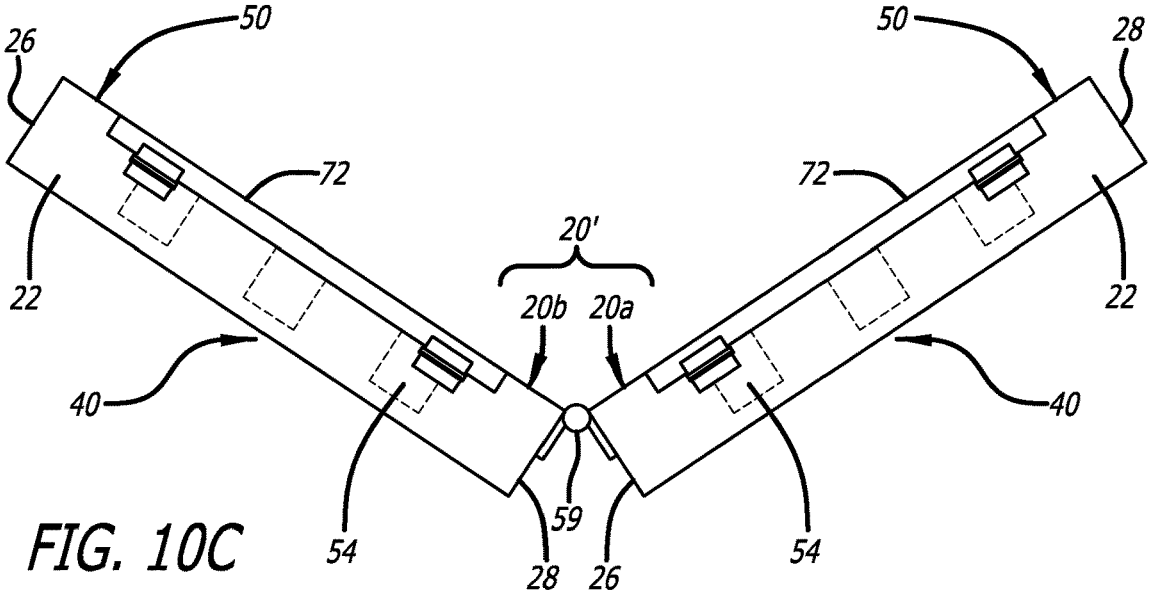

Depth 54D of each of the plurality of projections 54 can depend on a variety of factors including, without limitation, the rebound effect desired by a ball when contacting a projection 54, whether a projection 54 will be flush with, lay below, or extend above a top surface of frame top 22, frame bottom 24, first frame side 26 and/or second frame side 28, and/or whether projections 54 are removeable and a lid as disclosed herein is present. In some embodiments, and as shown in FIGS. 4, 5, & 6A-B, each of the plurality of projections 54 can have depth 54D dimensioned and sized so that top surface 56 is flush or substantially flush with the top surface of frame top and/or bottom 22, 24. In some embodiments, and as shown in FIGS. 9C & 10A, each of the plurality of projections 54 can have depth 54D dimensioned and sized so that top surface 56 lies below the top surface of frame top and bottom 22, 24. In some embodiments, and as shown in FIG. 6D, each of the plurality of projections 54 can have depth 54D dimensioned and sized so that top surface 56 lies above the top surface of frame top and bottom 22, 24.

In some embodiments, and referring to FIGS. 6A-C, 8, 9A-C, & 10A, each of the plurality of projections 54 can have depth 54D of, e.g., at least 0.5 inches, at least 0.75 inches, at least 1 inch, as least 1.5 inches, at least 2 inches, at least 2.5 inches, at least 3 inches, at least 3.5 inches, at least 4 inches, at least 4.5 inches, or at least 5 inches. In some embodiments, each of the plurality of projections 54 can have depth 54D of, e.g., at most 0.5 inches, at most 0.75 inches, at most 1 inch, as most 1.5 inches, at most 2 inches, at most 2.5 inches, at most 3 inches, at most 3.5 inches, at most 4 inches, at most 4.5 inches, or at most 5 inches. In some embodiments, each of the plurality of projections 54 can have depth 54D of, e.g., about 0.5 inches to about 1 inch, about 0.5 inches to about 1.5 inches, about 0.5 inches to about 2 inches, about 0.5 inches to about 2.5 inches, about 0.5 inches to about 3 inches, about 0.5 inches to about 3.5 inches, about 0.5 inches to about 4 inches, about 0.5 inches to about 4.5 inches, about 0.5 inches to about 5 inches, about 1 inch to about 1.5 inches, about 1 inch to about 2 inches, about 1 inch to about 2.5 inches, about 1 inch to about 3 inches, about 1 inch to about 3.5 inches, about 1 inch to about 4 inches, about 1 inch to about 4.5 inches, about 1 inch to about 5 inches, about 1.5 inches to about 2 inches, about 1.5 inches to about 2.5 inches, about 1.5 inches to about 3 inches, about 1.5 inches to about 3.5 inches, about 1.5 inches to about 4 inches, about 1.5 inches to about 4.5 inches, about 1.5 inches to about 5 inches, about 2 inches to about 2.5 inches, about 2 inches to about 3 inches, about 2 inches to about 3.5 inches, about 2 inches to about 4 inches, about 2 inches to about 4.5 inches, about 2 inches to about 5 inches, about 2.5 inches to about 3 inches, about 2.5 inches to about 3.5 inches, about 2.5 inches to about 4 inches, about 2.5 inches to about 4.5 inches, about 2.5 inches to about 5 inches, about 3 inches to about 3.5 inches, about 3 inches to about 4 inches, about 3 inches to about 4.5 inches, about 3 inches to about 5 inches, about 3.5 inches to about 4 inches, about 3.5 inches to about 4.5 inches, about 3.5 inches to about 5 inches, about 4 inches to about 4.5 inches, about 4 inches to about 5 inches, or about 4.5 inches to about 5 inches.

Each of the plurality of projections 54 may have depth 54D that is uniform height which provides a linear top surface 56. For example, as shown in FIGS. 4, 5 & 6A-B, each of the plurality of projections 54 are substantially the same depth 54D along its full length 54L. Alternatively, and as shown in FIGS. 7A-C, a subset or all of the plurality of projections 54 may have a depth 54D that varies in height leading to a top surface 56 having sloped and/or non-linear characteristic, and thus include a maximum depth 54D and a minimum depth 54*d*. For example, the height of a projection may have maximum height at one end tapering to a minimum height at an opposing end, creating a sloped profile. In other embodiments, height of a projection may vary along a length to produce an uneven, undulating or wavy profile to the projection. Projections 54 having such varied depths of can a different and/or increase the unpredictability of a rebound effect of a ball when contacting a particular projection 54 of second playing surface 50, which may be desirable for increasing the skill level of players or providing players with a more challenging game. For example, varied projection depths can provide a linear sloping top surface 56, a curvilinear top surface 56, or other non-uniform projection depths that create high regions and low regions to confer a desired rebound effect of a ball when contacting top surface 56 of a particular projection 54 of second playing surface 50. In some embodiments, and as shown in FIG. 7A, projection 54 comprises a maximum depth 54D at one end tapering to a minimum depth 54*d* at an opposing end and a flat top surface 56 to create a uniformly linear slope. In some embodiments, and as shown in FIG. 7B, projection 54 comprises a maximum depth 54D at one end tapering to a minimum depth 54*d* at an opposing end and a curvilinear top surface 56 to create a curvilinear slope. In some embodiments, and as shown in FIG. 7C, projection 54 comprises a curvilinear top surface 56 with a plurality of maximum and minimum depths 54D, 54*d* to create a linear curvilinear slope defined by spaced apart maximum peaks and spaced apart minimum nodes.

In some embodiments, and referring to FIGS. 7A-C, each of the plurality of projections 54 can have maximum depth 54D of, e.g., at least 0.5 inches, at least 0.75 inches, at least 1 inch, as least 1.5 inches, at least 2 inches, at least 2.5 inches, at least 3 inches, at least 3.5 inches, at least 4 inches, at least 4.5 inches, or at least 5 inches. In some embodiments, each of the plurality of projections 54 can have maximum depth 54D of, e.g., at most 0.5 inches, at most 0.75 inches, at most 1 inch, as most 1.5 inches, at most 2 inches, at most 2.5 inches, at most 3 inches, at most 3.5 inches, at most 4 inches, at most 4.5 inches, or at most 5 inches. In some embodiments, each of the plurality of projections 54 can have maximum depth 54D of, e.g., about 0.5 inches to about 1 inch, about 0.5 inches to about 1.5 inches, about 0.5 inches to about 2 inches, about 0.5 inches to about 2.5 inches, about 0.5 inches to about 3 inches, about 0.5 inches to about 3.5 inches, about 0.5 inches to about 4 inches, about 0.5 inches to about 4.5 inches, about 0.5 inches to about 5 inches, about 1 inch to about 1.5 inches, about 1 inch to about 2 inches, about 1 inch to about 2.5 inches, about 1 inch to about 3 inches, about 1 inch to about 3.5 inches, about 1 inch to about 4 inches, about 1 inch to about 4.5 inches, about 1 inch to about 5 inches, about 1.5 inches to about 2 inches, about 1.5 inches to about 2.5 inches, about 1.5 inches to about 3 inches, about 1.5 inches to about 3.5 inches, about 1.5 inches to about 4 inches, about 1.5 inches to about 4.5 inches, about 1.5 inches to about 5 inches, about 2 inches to about 2.5 inches, about 2 inches to about 3 inches, about 2 inches to about 3.5 inches, about 2 inches to about 4 inches, about 2 inches to about 4.5 inches, about 2 inches to about 5 inches, about 2.5 inches to about 3 inches, about 2.5 inches to about 3.5 inches, about 2.5 inches to about 4 inches, about 2.5 inches to about 4.5 inches, about 2.5 inches to about 5 inches, about 3 inches to about 3.5 inches, about 3 inches to about 4 inches, about 3 inches to about 4.5 inches, about 3 inches to about 5 inches, about 3.5 inches to about 4 inches, about 3.5 inches to about 4.5 inches, about 3.5 inches to about 5 inches, about 4 inches to about 4.5 inches, about 4 inches to about 5 inches, or about 4.5 inches to about 5 inches.

In some embodiments, and referring to FIGS. 7A-C, each of the plurality of projections 54 can have minimum depth 54*d* of, e.g., at least 0.5 inches, at least 0.75 inches, at least 1 inch, as least 1.5 inches, at least 2 inches, at least 2.5 inches, at least 3 inches, at least 3.5 inches, at least 4 inches, at least 4.5 inches, or at least 5 inches. In some embodiments, each of the plurality of projections 54 can have minimum depth 54*d* of, e.g., at most 0.5 inches, at most 0.75 inches, at most 1 inch, as most 1.5 inches, at most 2 inches, at most 2.5 inches, at most 3 inches, at most 3.5 inches, at most 4 inches, at most 4.5 inches, or at most 5 inches. In some embodiments, each of the plurality of projections 54 can have minimum depth 54*d* of, e.g., about 0.5 inches to about 1 inch, about 0.5 inches to about 1.5 inches, about 0.5 inches to about 2 inches, about 0.5 inches to about 2.5 inches, about 0.5 inches to about 3 inches, about 0.5 inches to about 3.5 inches, about 0.5 inches to about 4 inches, about 0.5 inches to about 4.5 inches, about 0.5 inches to about 5 inches, about 1 inch to about 1.5 inches, about 1 inch to about 2 inches, about 1 inch to about 2.5 inches, about 1 inch to about 3 inches, about 1 inch to about 3.5 inches, about 1 inch to about 4 inches, about 1 inch to about 4.5 inches, about 1 inch to about 5 inches, about 1.5 inches to about 2 inches, about 1.5 inches to about 2.5 inches, about 1.5 inches to about 3 inches, about 1.5 inches to about 3.5 inches, about 1.5 inches to about 4 inches, about 1.5 inches to about 4.5 inches, about 1.5 inches to about 5 inches, about 2 inches to about 2.5 inches, about 2 inches to about 3 inches, about 2 inches to about 3.5 inches, about 2 inches to about 4 inches, about 2 inches to about 4.5 inches, about 2 inches to about 5 inches, about 2.5 inches to about 3 inches, about 2.5 inches to about 3.5 inches, about 2.5 inches to about 4 inches, about 2.5 inches to about 4.5 inches, about 2.5 inches to about 5 inches, about 3 inches to about 3.5 inches, about 3 inches to about 4 inches, about 3 inches to about 4.5 inches, about 3 inches to about 5 inches, about 3.5 inches to about 4 inches, about 3.5 inches to about 4.5 inches, about 3.5 inches to about 5 inches, about 4 inches to about 4.5 inches, about 4 inches to about 5 inches, or about 4.5 inches to about 5 inches.

Figure 8:
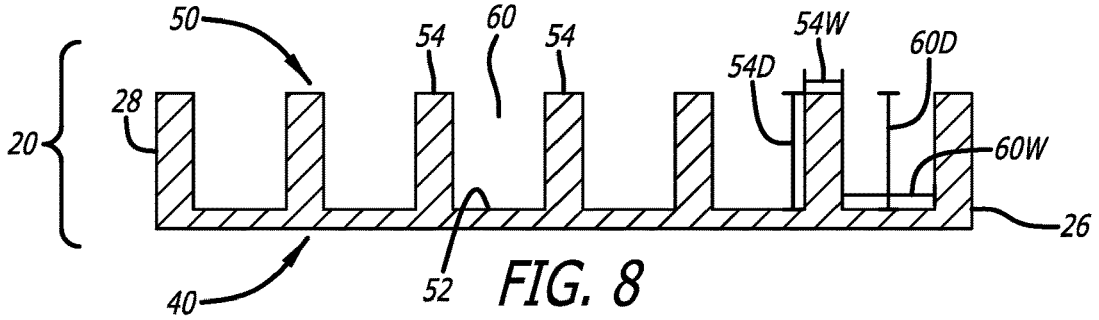
FIG. 8 is a cross sectional view of the board assembly of FIG. 4, taken along line 8-8, showing exemplary cross-sectional geometry of spaced apart projections and furrows of its second playing surface.

In some embodiments, and as shown in FIGS. 8 & 9, each of the plurality of projections 54 may be a single-component, solid structure. In such embodiments, each of the plurality of projections 54 may be composed of wood, plastic, metal, or other composite material. In aspects of these embodiments, each of the plurality of projections 54 can have an resilient material applied to top surface 56 which acts as a cushion in order to enhance the rebounding effect exerted onto a ball when contacted a particular projection 54. Such resilient material includes, without limitation, a natural or synthetic rubber or rubber-like material, or a pliable, flexible or otherwise resilient plastic or composite material.

In some embodiments, each of the plurality of projections 54 may be a multi-component structure that may be solid or include an internal hollow cavity. In some embodiments, and referring to FIG. 25, a projection 54 can comprise a projection base 630 and a projection bumper 640. Projection base 630 is composed of a rigid material such as rigid plastic, metal, or other rigid composite material while projection bumper 640 is composed of a resilient material such as a natural or synthetic rubber or rubber-like material, or a pliable, flexible or otherwise resilient plastic or composite material. In some embodiments, projection base 630 can be secured to bottom surface 52 of second playing surface 50 while in other embodiments, projection base 630 can reversible removeable from second playing surface 50. In some embodiments, projection bumper 640 it an integral part of projection base 630, while in other embodiments, projection bumper 640 can reversible removeable from projection base 630.

In some embodiments, and as shown in FIG. 25, projection base 630 forms a rail comprises a base top 632, base bottom 634, first base side 636, and second base side 638, with first base side 636 opposite second base side 638 and is generally parallel to second base side 638. Base top 632 comprises evenly spaced apart grooves 639 ruing parallel down the length of projection base 630, with grooves 639 configured to receive projection bumper 640. Additionally, and as shown in FIG. 25, base top 632 has an opening running down its length to form a channel where the bottom is formed by base bottom 634 and the two sides are formed by first and second base sides 636, 638.

In some embodiments, and as shown in FIG. 25, projection bumper 640 is an invert U-shape or omicron (Q)-shaped structure comprising a bumper top 642, bumper bottom 644, first bumper side 646, and second bumper side 648, with first bumper side 646 opposite second bumper side 648. At the juncture of bumper bottom 644 and first bumper side 646, as well as at the juncture of bumper bottom 644 and second bumper side 648 a rigid 649 extends perpendicular to first bumper side 646 and second bumper side 648 and is configured to insert into and slidably fit in grooves 639 of base top 632. When assembled, projection base 630 and projection bumper 640 form a cavity 650. In some embodiments, cavity 650 is a hollow space, while in other embodiments cavity 650 can be filled with material that limits the extend of projection bumper 640 can deform inward upon being struck by a force, e.g., a ball during use. Such material includes, without limitation, a foam, an insulation, or a rigid insert.

Referring now to FIGS. 6-A-C, 8, & 9A-C, each of the plurality of furrows 60 has a length 60L, a width 60W, and a depth 60D and has a first end and a second end. Length 60L, width 60W, and depth 60D of a particular furrow 60 is defined by a pair of adjacent projections 54 that define the first and second sides of a particular furrow 60 and bottom surface 52 of second playing surface 50. The first and second ends of a particular furrow 60 is defined by frame top 22, frame bottom 24, first frame side 26, or second frame side 28 depending on the placement of the pair of projections 54 used to define the particular furrow 60.

Spacing between a pair of adjacent projections 54 that define width 60W of a particular furrow 60 is selected and can vary to provide an enjoyable variety of rebounding effects of a ball when contacted a particular projection 54 and/or furrow 60 of second playing surface 50. In some embodiments, and as shown in FIG. 4, plurality of projections 54 are arranged in a vertical projection pattern where each of the plurality of projections 54 is substantially parallel to each other and extend the full length of second playing surface 50. When plurality of projections 54 are provided substantially parallel to each other, each furrow 60 therebetween has a substantially consistent or uniform width 60W of along its full length 60L.

In some embodiments, each of the plurality of furrows 60 can have width 60W of, e.g., at least 3 inches, at least 4 inches, at least 5 inches, at least 6 inches, at least 7 inches, or at least 8 inches. In some embodiments, each of the plurality of furrows 60 can have width 60W of, e.g., at most 3 inches, at most 4 inches, at most 5 inches, at most 6 inches, at most 7 inches, or at most 8 inches. In some embodiments, each of the plurality of furrows 60 can have width 60W of, e.g., about 3 inches to about 4 inches, about 3 inches to about 5 inches, about 3 inches to about 6 inches, about 3 inches to about 7 inches, about 3 inches to about 8 inches, about 4 inches to about 5 inches, about 4 inches to about 6 inches, about 4 inches to about 7 inches, about 4 inches to about 8 inches, about 5 inches to about 6 inches, about 5 inches to about 7 inches, about 5 inches to about 8 inches, about 6 inches to about 7 inches, about 6 inches to about 8 inches, or about 7 inches to about 8 inches.

Figure 6B:
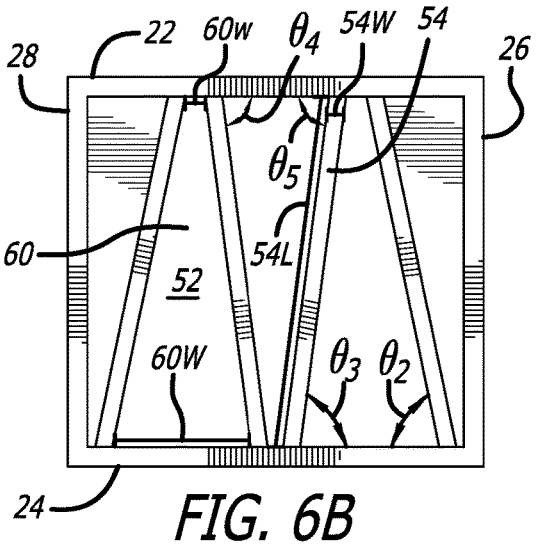
Figure 6C:
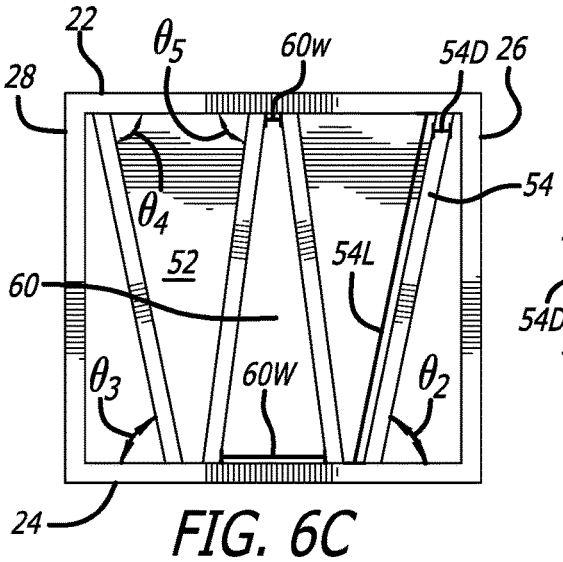
Figure 7A:
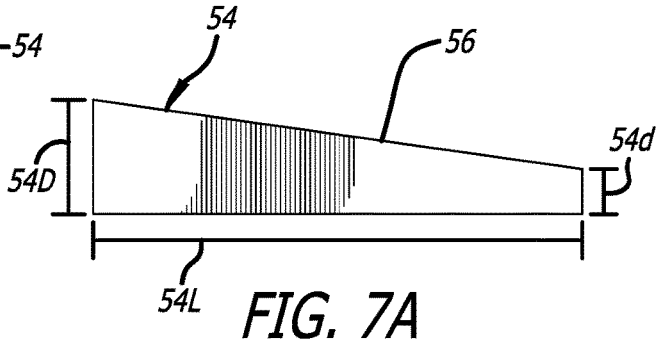
FIGS. 7A-C are each front plan views of a projection disclosed herein showing exemplary top surface height contours of projections in accordance with aspects of the present disclosure with FIG. 7A showing a projection having a generally tapered, linear upper surface.
Figure 7B:
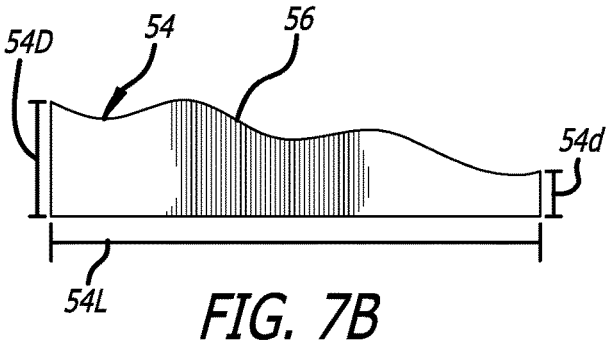
Figure 7C:
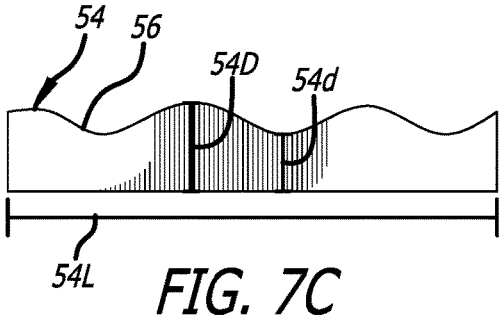

Alternatively, and as shown FIGS. 6A-C, placement of each plurality of projections 54 within second playing surface 50 can form angled projection patterns where a subset or all of projections 54 are not parallel to each other. These angled projection patterns in turn form furrows 60 having a maximum width 60D and a minimum width 60*w* (see, e.g., FIGS. 6A-C). In some embodiments, a minimum spacing of a pair of adjacent projections 54 is about 3 inches apart and a maximum spacing of a pair of adjacent projections 54 is about 8 inches apart.

In some embodiments, each of the plurality of furrows 60 can have maximum width 60W of, e.g., at least 3 inches, at least 4 inches, at least 5 inches, at least 6 inches, at least 7 inches, or at least 8 inches. In some embodiments, each of the plurality of furrows 60 can have maximum width 60W of, e.g., at most 3 inches, at most 4 inches, at most 5 inches, at most 6 inches, at most 7 inches, or at most 8 inches. In some embodiments, each of the plurality of furrows 60 can have maximum width 60W of, e.g., about 3 inches to about 4 inches, about 3 inches to about 5 inches, about 3 inches to about 6 inches, about 3 inches to about 7 inches, about 3 inches to about 8 inches, about 4 inches to about 5 inches, about 4 inches to about 6 inches, about 4 inches to about 7 inches, about 4 inches to about 8 inches, about 5 inches to about 6 inches, about 5 inches to about 7 inches, about 5 inches to about 8 inches, about 6 inches to about 7 inches, about 6 inches to about 8 inches, or about 7 inches to about 8 inches.

In some embodiments, each of the plurality of furrows 60 can have minimum width 60*w* of, e.g., at least 3 inches, at least 4 inches, at least 5 inches, at least 6 inches, at least 7 inches, or at least 8 inches. In some embodiments, each of the plurality of furrows 60 can have minimum width 60*w* of, e.g., at most 3 inches, at most 4 inches, at most 5 inches, at most 6 inches, at most 7 inches, or at most 8 inches. In some embodiments, each of the plurality of furrows 60 can have minimum width 60*w* of, e.g., about 3 inches to about 4 inches, about 3 inches to about 5 inches, about 3 inches to about 6 inches, about 3 inches to about 7 inches, about 3 inches to about 8 inches, about 4 inches to about 5 inches, about 4 inches to about 6 inches, about 4 inches to about 7 inches, about 4 inches to about 8 inches, about 5 inches to about 6 inches, about 5 inches to about 7 inches, about 5 inches to about 8 inches, about 6 inches to about 7 inches, about 6 inches to about 8 inches, or about 7 inches to about 8 inches.

As shown in FIG. 4, plurality of projections 54 are arranged in a vertical pattern where each of the plurality of projections 54 are arranged substantially parallel to each other and extend the full length of second playing surface 50 with a first end of each projection 54 abutting frame top 22 and a second end of each projection 54 abutting frame bottom 24, with each projection 54 being substantially parallel to first and second frame sides 26, 28. However, other alternative arrangements of the plurality of projections 54 are arranged non-parallel to each other. Such alternative arrangements can increase the unpredictability of a rebound effect of a ball when contacting a particular projection 54 and/or furrow 60 of second playing surface 50, which may be desirable for increasing the skill level of players or providing players with a more challenging game. For example, projections may be oriented in a sunburst arrangement, a V-shaped arrangement, an inverted V-shaped arrangement, a double V-shaped arrangement, an inverted double V-shaped arrangement, or other non-parallel arrangements that position the plurality of projections 54 in a pattern that creates a desired rebound effect of a ball when contacting a particular projection 54 and/or furrow 60 of second playing surface 50.

Turning now to FIGS. 6A-C, several such alternative second playing surfaces 50 are shown. In some embodiments, and as shown in FIG. 6A, the plurality of projections 54 are arranged in an upward radiating configuration. In this radiating pattern one or more of the plurality of projections 54 have a first end of each projection 54 abutting first frame side 26 and a second end of each projection 54 abutting frame bottom 24 with each projection 54 being at an angle to first and second frame sides 26, 28, one or more of the plurality of projections 54 have a first end of each projection 54 abutting frame top 22 and a second end of each projection 54 abutting frame bottom 24 with each projection 54 being at an angle to first and second frame sides 26, 28, and one or more of the plurality of projections 54 have a first end of each projection 54 abutting second frame side 28 and a second end of each projection 54 abutting frame bottom 24 with each projection 54 being at an angle to first and second frame sides 26, 28.

In some embodiments, and as shown in FIG. 6B, the plurality of projections 54 are arranged in an inverted double V-shaped configuration. In this inverted double V-shaped pattern each of the plurality of projections 54 extend the full length of second playing surface 50 with a first end of each projection 54 abutting frame top 22 and a second end of each projection 54 abutting frame bottom 24, with each projection 54 being at an angle to first and second frame sides 26, 28. Similarly, and as shown in FIG. 6C, the plurality of projections 54 are arranged in a double V-shaped configuration. In this double V-shaped pattern each of the plurality of projections 54 extend the full length of second playing surface 50 with a first end of each projection 54 abutting frame top 22 and a second end of each projection 54 abutting frame bottom 24, with each projection 54 being at an angle to first and second frame sides 26, 28. When plurality of projections 54 are provided at an angle relative to first and second frame sides 26, 28, the width of furrows 60 therebetween are varied along their length can be defined by a maximum width and minimum width.

Each of the one or more of the plurality of projections 54 have a projection angle. In some embodiments, each of the one or more of the plurality of projections 54 have a projection angle of about 30° to about 90°, the projection angle being an angle formed at the juncture of each projection of the one or more of the plurality of projections 54 and frame bottom 24, referred to as angle $\theta_2$ or an angle $\theta_3$ (see FIGS. 6-A-C). In some embodiments, one or more of the plurality of projections 54 are at an angle $\theta_2$ or an angle $\theta_3$ of, e.g., at least 30°, at least 35°, at least 40°, at least 45°, at least 50°, at least 55°, at least 60°, at least 65°, at least 70°, at least 75°, at least 80°, at least 85°, at least 89°, or at least 90°. In some embodiments, one or more of the plurality of projections 54 are at an angle $\theta_2$ or an angle $\theta_3$ of, e.g., at most 30°, at most 35°, at most 40°, at most 45°, at most 50°, at most 55°, at most 60°, at most 65°, at most 70°, at most 75°, at most 80°, at most 85°, at most 89°, or at most 90°. In some embodiments, one or more of the plurality of projections 54 are at an angle $\theta_2$ or an angle $\theta_3$ of, e.g., about 30° to about 35°, about 30° to about 40°, about 30° to about 45°, about 30° to about 50°, about 30° to about 55°, about 30° to about 60°, about 30° to about 65°, about 30° to about 70°, about 30° to about 75°, about 30° to about 80°, about 30° to about 85°, about 30° to about 89°, about 30° to about 90°, about 35° to about 40°, about 35° to about 45°, about 35° to about 50°, about 35° to about 55°, about 35° to about 60°, about 35° to about 65°, about 35° to about 70°, about 35° to about 75°, about 35° to about 80° about 35° to about 85° about 35° to about 89° about 35° to about 90° about 40° to about 45° about 40° to about 50° about 40° to about 55° about 40° to about 60° about 40° to about 65° about 40° to about 70° about 40° to about 75° about 40° to about 80° about 40° to about 85° about 40° to about 89° about 40° to about 90° about 45° to about 50° about 45° to about 55° about 45° to about 60° about 45° to about 65° about 45° to about 70° about 45° to about 75° about 45° to about 80° about 45° to about 85° about 45° to about 89° about 45° to about 90° about 50° to about 55° about 50° to about 60° about 50° to about 65° about 50° to about 70° about 50° to about 75° about 50° to about 80° about 50° to about 85° about 50° to about 89° about 50° to about 90° about 55° to about 60° about 55° to about 65° about 55° to about 70° about 55° to about 75° about 55° to about 80° about 55° to about 85° about 55° to about 89°, about 55° to about 90°, about 60° to about 65°, about 60° to about 70°, about 60° to about 75°, about 60° to about 80°, about 60° to about 85°, about 60° to about 89°, about 60° to about 90°, about 65° to about 70°, about 65° to about 75°, about 65° to about 80°, about 65° to about 85°, about 65° to about 89°, about 65° to about 90°, about 70° to about 75°, about 70° to about 80°, about 70° to about 85°, about 70° to about 89°, about 70° to about 90°, about 75° to about 80°, about 75° to about 85°, about 75° to about 89°, about 75° to about 90°, about 80° to about 85°, about 80° to about 89°, about 80° to about 90°, about 85° to about 89°, about 85° to about 90°, about 86° to about 90°, about 87° to about 90° about 88° to about 90°, or about 89° to about 90°.

In some embodiments, each of the one or more of the plurality of projections 54 have a projection angle of about 30° to about 90°, the projection angle being an angle formed at the juncture of each projection of the one or more of the plurality of projections 54 and frame top 22, referred to as angle $\theta_4$ or an angle $\theta_5$ (see FIGS. 6-A-C). In some embodiments, one or more of the plurality of projections 54 are at an angle $\theta_4$ or an angle $\theta_5$ of, e.g., at least 30°, at least 35°, at least 40°, at least 45°, at least 50°, at least 55°, at least 60°, at least 65°, at least 70°, at least 75°, at least 80°, at least 85°, at least 89°, or at least 90°. In some embodiments, one or more of the plurality of projections 54 are at an angle $\theta_4$ or an angle $\theta_5$ of, e.g., at most 30°, at most 35°, at most 40°, at most 45°, at most 50°, at most 55°, at most 60°, at most 65°, at most 70°, at most 75°, at most 80°, at most 85°, at most 89°, or at most 90°. In some embodiments, one or more of the plurality of projections 54 are at an angle $\theta_4$ or an angle $\theta_5$ of, e.g., about 30° to about 35°, about 30° to about 40°, about 30° to about 45°, about 30° to about 50°, about 30° to about 55°, about 30° to about 60°, about 30° to about 65°, about 30° to about 70°, about 30° to about 75°, about 30° to about 80°, about 30° to about 85°, about 30° to about 89°, about 30° to about 90°, about 35° to about 40° about 35° to about 45° about 35° to about 50° about 35° to about 55°, about 35° to about 60° about 35° to about 65° about 35° to about 70° about 35° to about 75°, about 35° to about 80° about 35° to about 85° about 35° to about 89° about 35° to about 90°, about 40° to about 45° about 40° to about 50° about 40° to about 55° about 40° to about 60°, about 40° to about 65° about 40° to about 70° about 40° to about 75° about 40° to about 80°, about 40° to about 85° about 40° to about 89° about 40° to about 90° about 45° to about 50°, about 45° to about 55° about 45° to about 60° about 45° to about 65° about 45° to about 70°, about 45° to about 75° about 45° to about 80° about 45° to about 85° about 45° to about 89°, about 45° to about 90° about 50° to about 55° about 50° to about 60° about 50° to about 65°, about 50° to about 70° about 50° to about 75° about 50° to about 80° about 50° to about 85°, about 50° to about 89°, about 50° to about 90°, about 55° to about 60°, about 55° to about 65°, about 55° to about 70°, about 55° to about 75°, about 55° to about 80°, about 55° to about 85°, about 55° to about 89°, about 55° to about 90°, about 60° to about 65°, about 60° to about 70°, about 60° to about 75°, about 60° to about 80°, about 60° to about 85°, about 60° to about 89°, about 60° to about 90°, about 65° to about 70°, about 65° to about 75°, about 65° to about 80°, about 65° to about 85°, about 65° to about 89°, about 65° to about 90°, about 70° to about 75°, about 70° to about 80°, about 70° to about 85°, about 70° to about 89°, about 70° to about 90°, about 75° to about 80°, about 75° to about 85°, about 75° to about 89°, about 75° to about 90°, about 80° to about 85°, about 80° to about 89°, about 80° to about 90°, about 85° to about 89°, about 85° to about 90°, about 86° to about 90°, about 87° to about 90° about 88° to about 90°, or about 89° to about 90°.

Figure 9D:
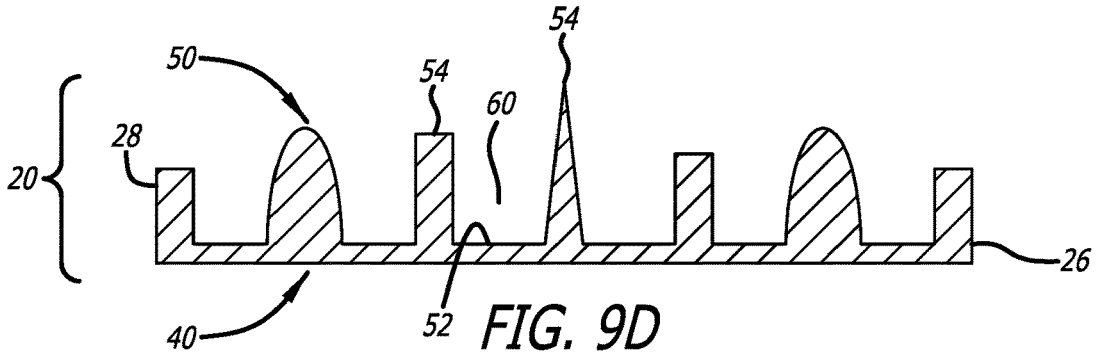

Plurality of projections 54 can be provided having widely varied widths/shapes useful in conferring a desired rebound effect of a ball when contacted a particular projection 54. FIGS. 8 & 9A-D show exemplary cross-sectional geometries of a plurality of projections 54 of second playing surface 50 useful in accordance with aspects of the present disclosure. In some embodiments, and as shown in FIG. 8, which is a cross-section of first and second frame sides 26, 28, plurality of projections 54 resemble rectangular shapes and have a depth 54D where top surface 56 flat and substantially in line with top surface of frame top 22 of board assembly 20. In some embodiments, and as shown in FIG. 9A, which is a cross-section of first and second frame sides 26, 28, plurality of projections 54 resemble triangular shapes having maximum width 54W at the base that tapers to minimum width 54*d* at top surface 56 having an edge that provide a fin-like aspect and in line with top surface of frame top 22 of board assembly 20. In some embodiments, and as shown in FIG. 9B, which is a cross-section of first and second frame sides 26, 28, plurality of projections 54 resemble oblong shapes having maximum width 54W at the base and minimum width 54*d* at top surface 56 having a rounded top portion and are in line with top surface of frame top 22 of board assembly 20. In some embodiments, and as shown in FIG. 9C, which is a cross-section of first and second frame sides 26, 28, plurality of projections 54 resemble trapezoidal shapes having maximum width 54W at the base that tapers to minimum width 54*d* at top surface 56 having a flat top surface. FIG. 9C also depicts top surface 56 of each of the plurality of projections 54 lying below the depth of top surface of first and second frame sides 26, 28 illustrating that a subset or all of top surface 56 (flat or otherwise) of plurality of projections 54 may have depth 54D that is not in line with a top surface of frame top 22, frame bottom 24, first frame side 26, and/or second frame side 28 of second playing surface 50. In some embodiments, and as shown in FIG. 9D, which is a cross-section of first and second frame sides 26, 28, plurality of projections 54 can comprise multiple different geometric shapes and/or varied depths of a plurality of projections disclosed herein.

Figure 10B:
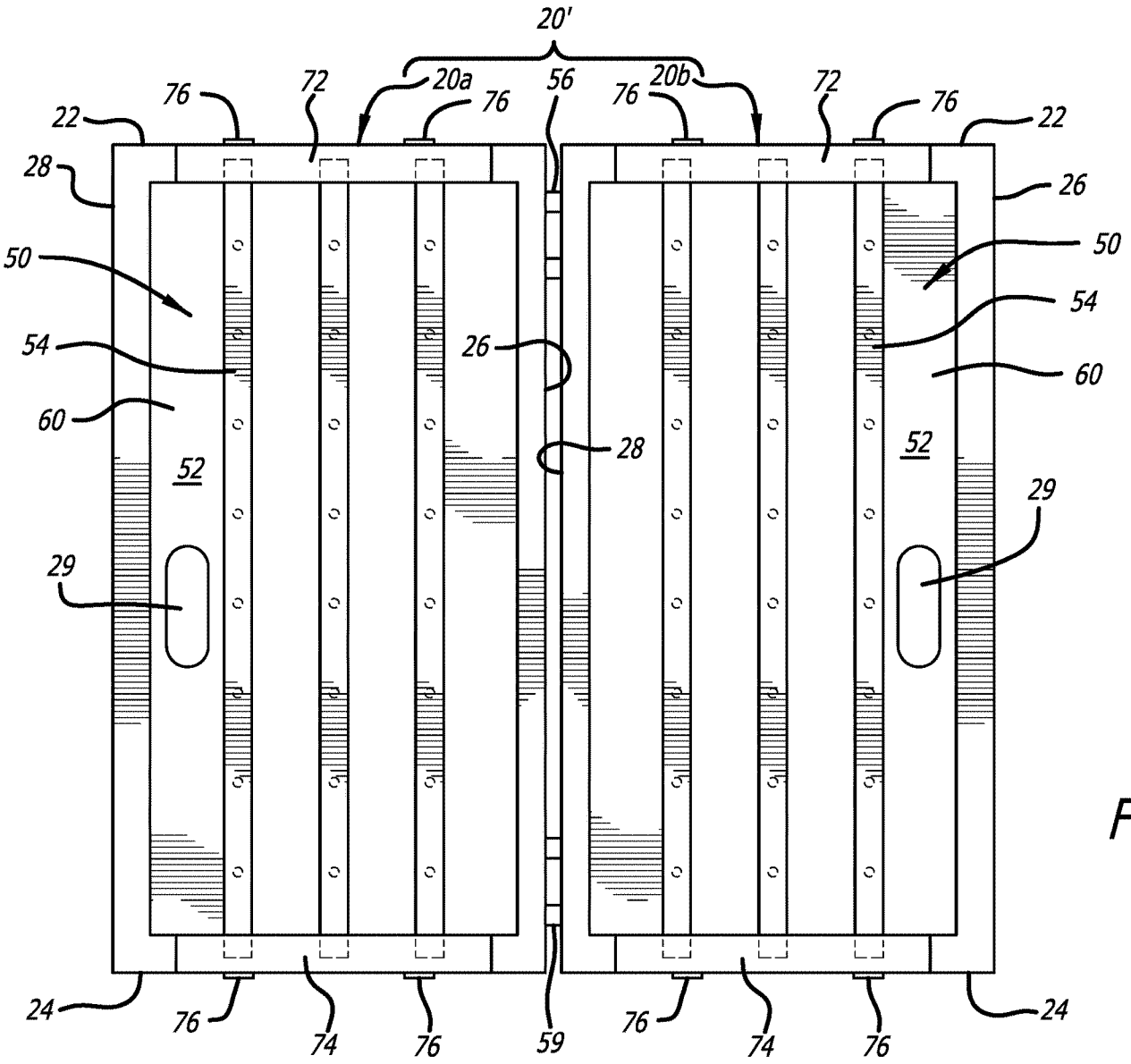

In some embodiments, one or more of the plurality of projections 54 may be reversible removeable from second playing surface 50. The ability to remove one or more of the plurality of projections 54 allows for the selective placement or removal of each of the one or more of the plurality of projections 54 of second playing surface 50 to enable a user to modify and customize the arrangement of the plurality of projections 54. For example, in some embodiments, and referring FIGS. 10A-C, frame top 22 is configured to include one or more slots 62 dimensioned and sized to receive a first end of a removeable projection 54'. Frame bottom 24 is similarly configured with one or more slots 64 dimensioned and sized to receive a second end of removeable projection 54' and each of the one or more slots 64 of frame bottom 24 is aligned with a corresponding slot of the one or more slots 62 of frame top 22 of (as best seen in FIG. 10B where one or more slots 64 are shown as ghosted features). In operation, a first end of removeable projection 54' is inserted into a slot of the one or more slots 62 of frame top 22 and a second end of removeable projection 54' is inserted into a slot of the one or more slots 64 of frame bottom 24. To provide added stability, each removeable projection 54' can optionally include at least one peg 58 on its bottom surface that is sized and positioned along its length to correspondingly fit into at least one socket 68.

Frame top 22 also includes a recessed portion 70 dimensioned and sized to receive a securing lid 72. Frame bottom 24 is similarly configured with a recessed portion dimensioned and sized to receive a securing lid 74 (as best seen in FIG. 10B). Securing lids 72, 74 includes one or more hinges 76 that affix securing lids 72, 74 to frame top and bottom 22, 24 respectively. In operation, one or more hinges 76 enable securing lids 72, 74 to open thereby revealing recessed portions of frame top and bottom 22, 24 and providing access to one or more slots 62, 64 respectively or close, thereby covering recessed portions of frame top and bottom 22, 24 and securing first and second ends of each removeable projections 54' within their respective one or more slots 62, 64.

In some embodiments, removable projections 54' have depth 54D (can also be considered a height) that is less than depth 20D of frame top, frame bottom, first frame side, and second frame side 22, 24, 26, 28. In such a configuration, when as part of a folding exemplary portable ball play and practice apparatus 10 (as shown in FIG. 10B and discussed below), a storage space is formed therein upon folding, into which various components may be stored. For example, the depth 54D can be about 0.25 to about 1 inch less than depth 20D and as such, provides and forms a cavity/storage space having a "thickness" of one inch when portable ball play and practice apparatus 10 is in a folded/closed configuration. Various backstop components and/or other items, such as, e.g., a cover for second board assembly disclosed herein, one or more beach blankets, and/or personal items, may be thereby stored therein.

In some embodiments, portable ball play and practice apparatus 10 comprise a hinged board assembly 20' including a first board component 20*a*' and second board component 20*b*'. For example, and referring to FIGS. 10B-C & 12, hinged board assembly 20' comprises one or more hinges 59 that affix first and second board components 20*a*', 20*b*' to each other where each of the one or more hinges 59 is secured to second frame side 28 of first board component 20*a*' and first frame side 26 of second board component 20*b*'. In some embodiments, first and second board components 20*a*', 20*b*' are identical or substantially similar to board assembly 20. In some embodiments, first and second board components 20*a*', 20*b*' are each a modification of board assembly 20. For example, the side of first board component 20*a*' that abuts the side of second board components 20*b*' (e.g., second frame side 28 of first board component 20*a*' and first frame side 26 of second board component 20*b*') can be dimensioned and sized to form a projection 54 when in the open play position. In operation, one or more hinges 59 enable first and second board components 20*a*', 20*b*' to move into an open play position thereby revealing and providing useable access to second playing surface 50 or to move into closed play position, thereby enclosing second playing surface 50 and optionally creating an internal storage compartment. Closure of portable ball play and practice apparatus 10 comprise hinged board assembly 20' facilitates transport of portable ball play and practice apparatus 10.

Additionally, portable ball play and practice apparatus 10 may be provided having a board assembly that includes at least one hinge mechanism that enables the board to be folded along the at least one hinge mechanism. This foldable configuration provides a folded transportation configuration.

Figure 12:
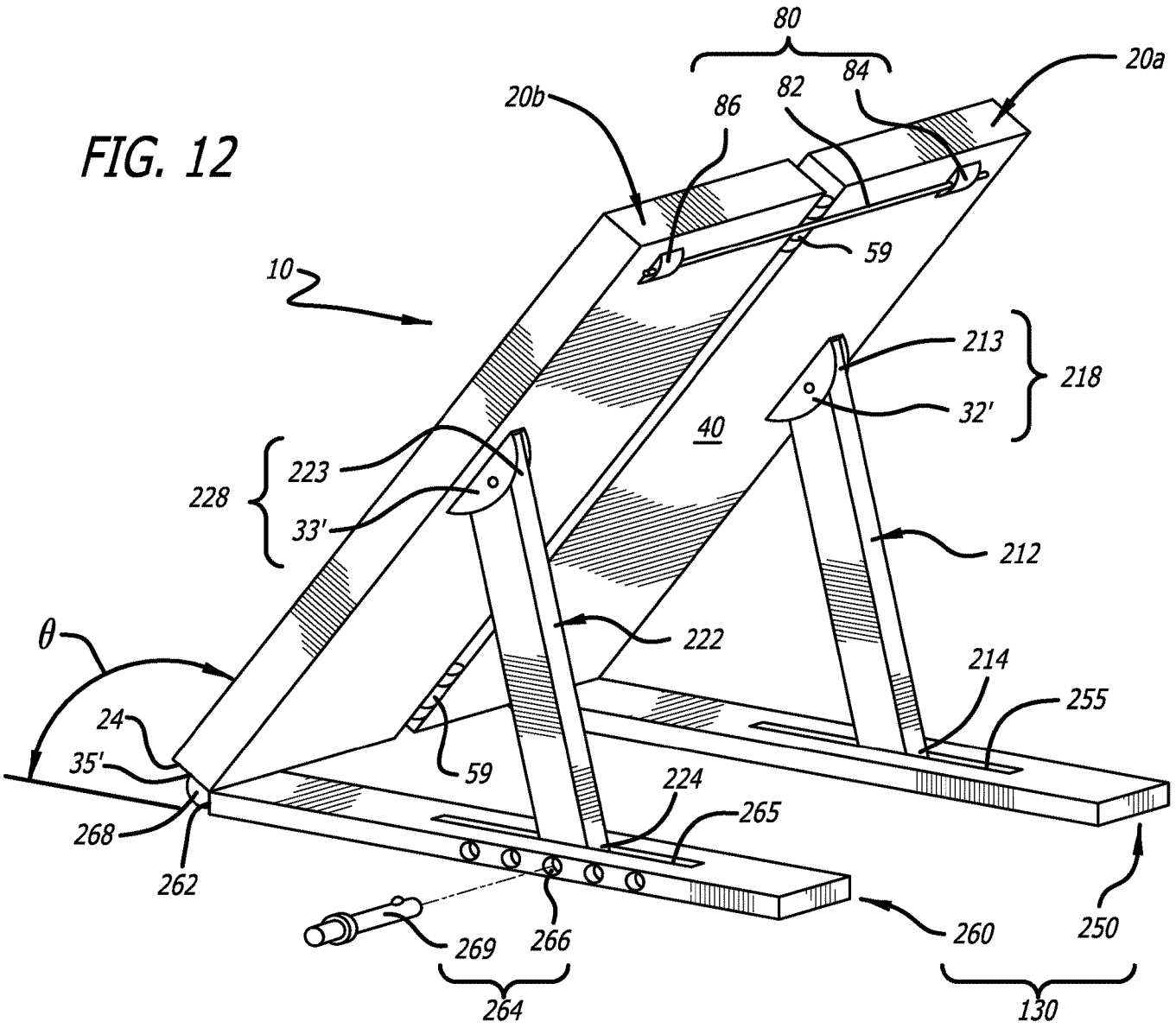
FIG. 12 is a rear perspective view of another exemplary stand assembly, here in conjunction with a hinged board assembly disclosed herein.

In some embodiments, portable ball play and practice apparatus 10 comprise hinged board assembly 20' can optionally further include a locking element that more securely fixes hinged board assembly 20' in the open play position and prevents first and second board components 20*a*', 20*b*' from unwanted give, folding, or closure upon impact by a ball upon the forwardly facing playing surface during use. Hinged board assembly 20' may be provided with and utilize any suitable locking element that can securely fixes hinged board assembly 20' in the open play position and prevents first and second board components 20*a*', 20*b*' from unwanted give, folding, or closure upon impact by a ball upon the forwardly facing playing surface during use. For example, in some embodiments, and referring to FIG. 12, hinged board assembly 20' includes a locking element 80 comprising one or more securing rods 82, one or more first securing rod holders 84, and one or more second securing rod holders 86. One or more securing rods 82 are each linear in shape and have a first end and a second end and is dimensioned and sized to span across first and second board components 20*a*', 20*b*'. Each of the one or more securing rods 82 is secured onto a rearwardly facing playing surface that is not in play (e.g., first playing surface 40 as shown in FIG. 12) in a manner were each of the one or more securing rods 82 spans across first and second board components 20*a*', 20*b*'. Each of the one or more securing rods 82 is held in place by inserting or otherwise reversable affixing a first end of a particular securing rods 82 to one of the one or more first securing rod holders 84 and inserting or otherwise reversable affixing a second end of a particular securing rods 82 to one of the one or more second securing rod holders 86.

In some embodiments, portable ball play and practice apparatus 10 comprise a modular board assembly 20". Modular board assembly 20" provides a system which enables a plurality of modular board assembly 20" as modules of a system that can be connected to each other, thereby providing a customizable playing surface which increases the playable surface area of first or second playing surface 40, 50. In addition, such a modular system allows for one modular board assembly 20" to have its forward facing surface be first playing surface 40, and another modular board assembly 20" to have its forward facing surface be second playing surface 50. In this way a first playing surface can be formed have one or more first playing surfaces 40 and one or more second playing surfaces 50 in any combination or order to create a dynamic forward playing surface having characteristics of both first and second playing surfaces 40, 50.

Figure 11A:
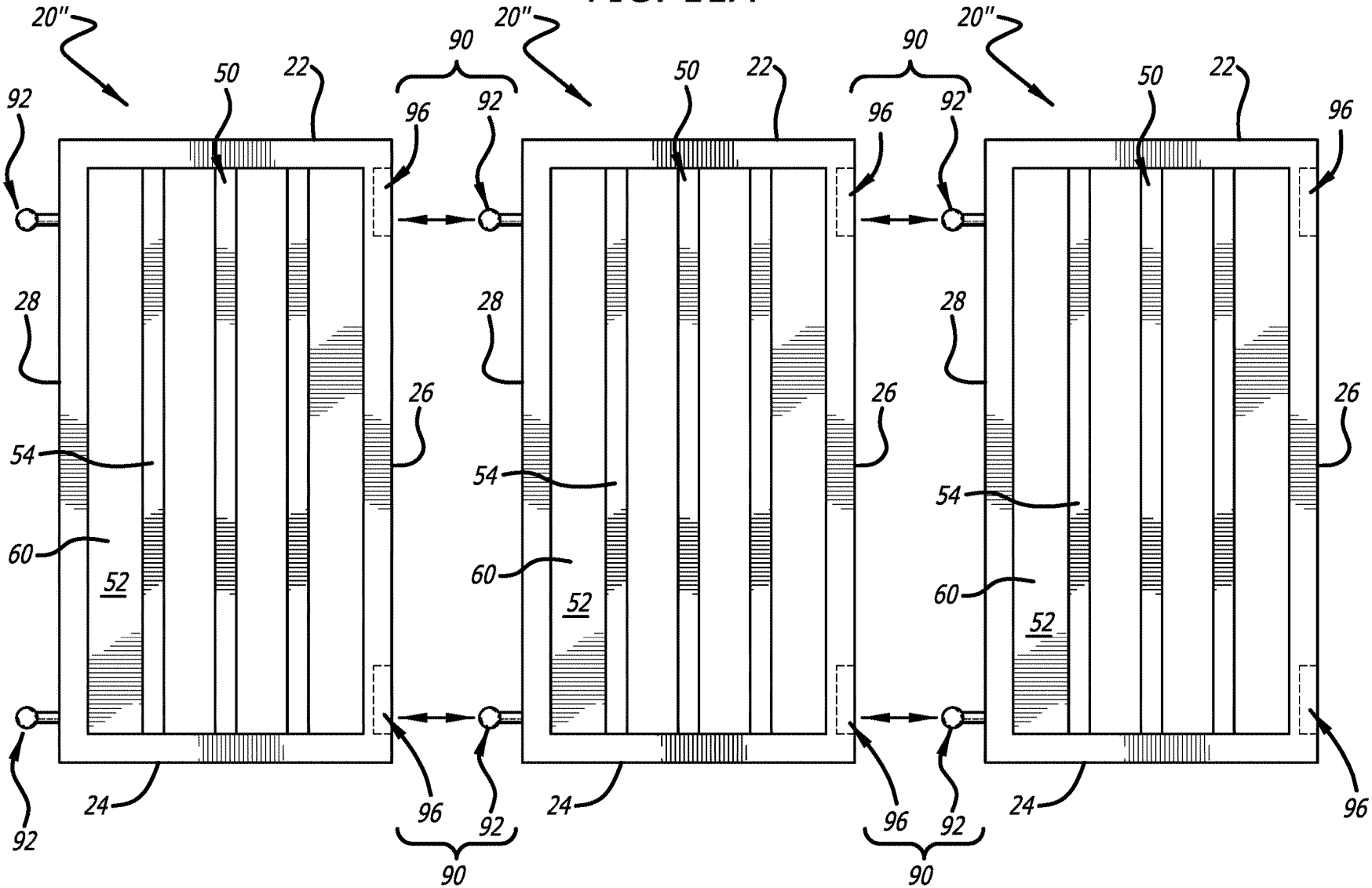
FIGS. 11A-B are views of a modular portable board assembly in accordance with aspects the present disclosure with FIG. 11A being a front plan view thereof.
Figure 11B:
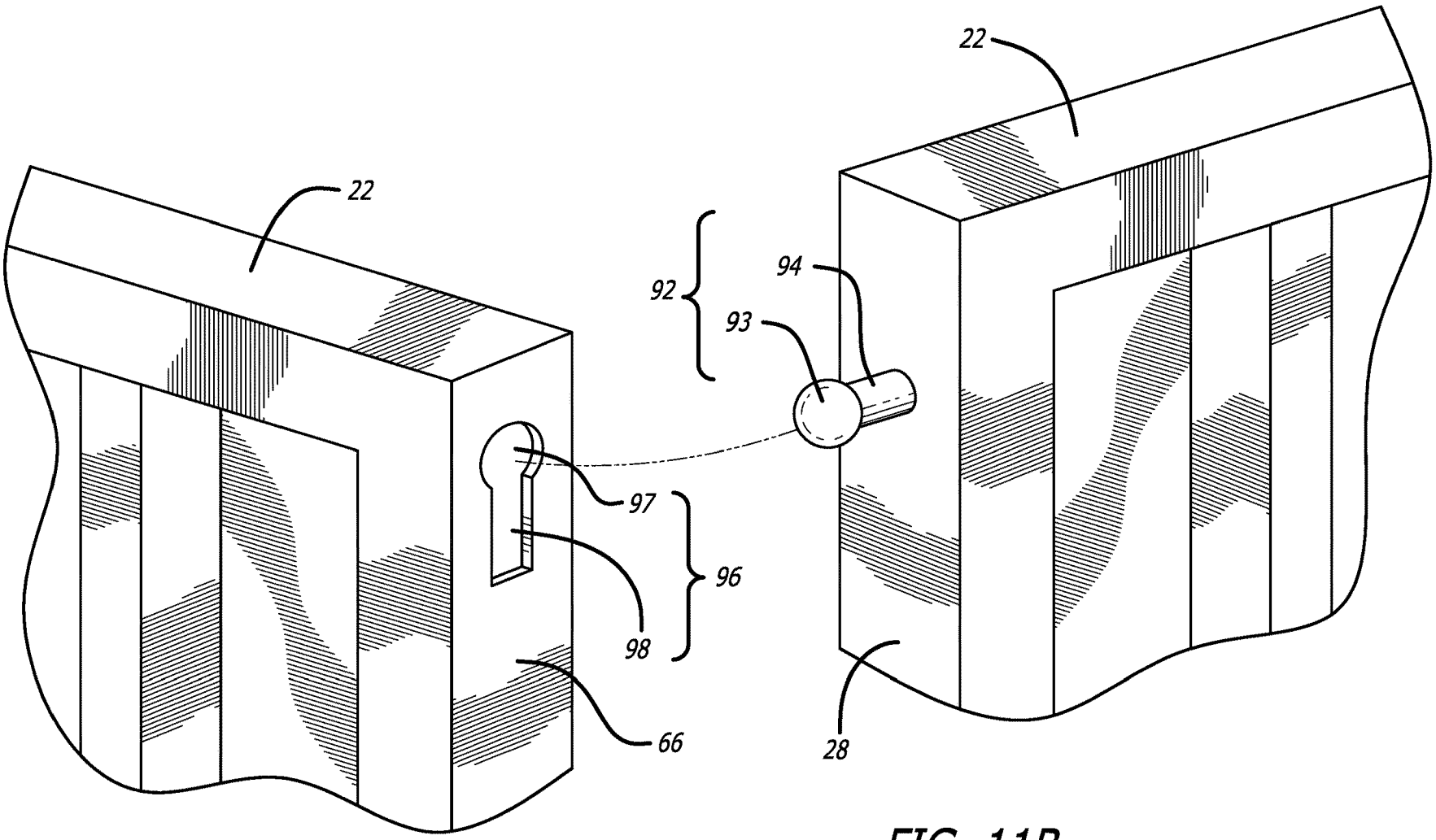

Referring to FIGS. 11A-B, each modular board assembly 20" is affix to another modular board assembly 20" in a manner where second frame side 28 of first modular board assembly 20*a*" abuts first frame side 26 of second modular board assembly 20*b*" and second frame side 28 of second modular board assembly 20*b*" abuts first frame side 26 of third modular board assembly 20*c*". In some embodiments, first, second, and third modular board assemblies 20*a*", 20*b*", 20*c*" are identical or substantially similar to board assembly 20. In some embodiments, first, second, and third modular board assemblies 20*a*", 20*b*", 20*c*" are each a modification of board assembly 20. For example, the side of first modular board assembly 20*a*" that abuts the side of second modular board assembly 20*b*" (e.g., second frame side 28 of first modular board assembly 20*a*" and first frame side 26 of second modular board assembly 20*b*") can be dimensioned and sized to form a projection 54 when in the open play position. Likewise, similar modifications would be incorporated to the side of second modular board assembly 20*b*" that abuts the side of third modular board assembly 20*c*".

While FIG. 11A depicts a system comprising three modular board assemblies 20*a*", 20*b*", 20*c*", any number of modular board assemblies may be provided and connected to each other. In some embodiments, a system can comprise, e.g., at least 2 modular board assemblies 20", at least 3 modular board assemblies 20", at least 4 modular board assemblies 20", at least 5 modular board assemblies 20", at least 6 modular board assemblies 20", at least 7 modular board assemblies 20", at least 8 modular board assemblies 20", at least 9 modular board assemblies 20", or at least 10 modular board assemblies 20". In some embodiments, a system can comprise, e.g., at most 2 modular board assemblies 20", at most 3 modular board assemblies 20", at most 4 modular board assemblies 20", at most 5 modular board assemblies 20", at most 6 modular board assemblies 20", at most 7 modular board assemblies 20", at most 8 modular board assemblies 20", at most 9 modular board assemblies 20", or at most 10 modular board assemblies 20". In some embodiments, a system can comprise about 2 to about 3 modular board assemblies 20", about 2 to about 4 modular board assemblies 20", about 2 to about 5 modular board assemblies 20", about 2 to about 6 modular board assemblies 20", about 2 to about 7 modular board assemblies 20", about 2 to about 8 modular board assemblies 20", about 2 to about 9 modular board assemblies 20", about 2 to about 10 modular board assemblies 20", about 3 to about 4 modular board assemblies 20", about 3 to about 5 modular board assemblies 20", about 3 to about 6 modular board assemblies 20", about 3 to about 7 modular board assemblies 20", about 3 to about 8 modular board assemblies 20", about 3 to about 9 modular board assemblies 20", about 3 to about 10 modular board assemblies 20", about 4 to about 5 modular board assemblies 20", about 4 to about 6 modular board assemblies 20", about 4 to about 7 modular board assemblies 20", about 4 to about 8 modular board assemblies 20", about 4 to about 9 modular board assemblies 20", about 4 to about 10 modular board assemblies 20", about 5 to about 6 modular board assemblies 20", about 5 to about 7 modular board assemblies 20", about 5 to about 8 modular board assemblies 20", about 5 to about 9 modular board assemblies 20", about 5 to about 10 modular board assemblies 20", about 6 to about 7 modular board assemblies 20", about 6 to about 8 modular board assemblies 20", about 6 to about 9 modular board assemblies 20", about 6 to about 10 modular board assemblies 20", about 7 to about 8 modular board assemblies 20", about 7 to about 9 modular board assemblies 20", about 7 to about 10 modular board assemblies 20", about 8 to about 9 modular board assemblies 20", about 8 to about 10 modular board assemblies 20", or about 9 to about 10 modular board assemblies 20".

Modular board assembly 20" comprises one or more connector systems that enables one modular board assembly 20" to another one modular board assembly 20". For example, in some embodiments, and as shown in FIG. 11A, each modular board assembly 20" is shown with two connector systems 90, with one portioned near the top and the other positioned near the bottom. Modular board assembly 20" may be provided with and utilize any suitable connector system that can secure one modular board assembly 20" with the other modular board assembly 20", including, without limitation a mechanical connector, a magnetic connector, a slot and rail connector, a hook and loop fastener.

In some embodiments, and referring to FIG. 11B, each modular board assembly 20" comprises components of one or more connector systems 90. Each of the one or more connector systems 90 comprise a pin 92 a slot 96. Pin 92 includes a head 93 and a stem 94. Slot 96 is an aperture that comprise a head receiving portion 97 that is complementary sized to receive head 93 and a channel portion 98 that is narrower than head receiving portion 97 and has a width to complement and snugly receive stem 94 of pin 92. Slot 96 is dimensioned and sized to operationally receive pin 92 and securely connect one modular board assembly 20" with the other modular board assembly 20". Pin 92 from each of the one or more connector systems 90 is located at a frame side, such as, e.g., first frame side 26 or second frame side 28 with slot 96 from each of the one or more connector systems 90 at the opposite frame side and operationally aligned with a corresponding pin 92. In some embodiments, pin 92 from each of the one or more connector systems 90 is located at first frame side 26 and the corresponding slot 96 from each of the one or more connector systems 90 is located at second frame side 28. In some embodiments, pin 92 from each of the one or more connector systems 90 is located at second frame side 28 and the corresponding slot 96 from each of the one or more connector systems 90 is located at first frame side 26. In some embodiments, one subset of pins 92 from the one or more connector systems 90 is located at first frame side 26 and the corresponding subset slots 96 from the one or more connector systems 90 is located at second frame side 28 and another subset of pins 92 from the one or more connector systems 90 is located at second frame side 28 and the corresponding subset slots 96 from the one or more connector systems 90 is located at first frame side 26. In operation, and referring to FIG. 11B, head 93 of pin 92 is inserted into head receiving portion 97 of slot 96 until stem 94 is aligned with channel portion 98 and then slide thought channel portion 98 to securely engage pin 92 into slot 96.

A board assembly disclosed herein can optionally and further comprise one or more additional components or features that enhance functionality, convenience or playability of a portable ball play and practice apparatus disclosed herein. For example, a board assembly disclosed herein can further comprise one or more carry apertures through which a user may pass their hand when carrying a portable ball play and practice apparatus disclosed herein and/or positioning a board assembly disclosed herein. In some embodiments, and referring now to FIGS. 3, 5, 10B, & 15, board assembly 20 and hinged board assembly 20' are each shown with one or more carry apertures 29. One or more carry apertures 29 are each dimensioned and sized to comfortable allow a user to insert or pass their hand and enable a secure gripping position. In addition, one or more carry apertures 29 are each positioned on board assembly 20 or hinged board assembly 20' in a manner that enables easy gripping and lifting of board assembly 20 or hinged board assembly 20' and/or portable ball play and practice apparatus 10. As such, one or more carry apertures 29 are each typically located near the perimeter of frame top 22, frame bottom 24, first frame side 26, and/or second frame side 28. In addition, with respect to hinged assembly 20' one or more carry apertures 29 are aligned with each other upon folding of portable ball play and practice apparatus 10. Although not shown, modular board assembly 20" may also include one or more carry apertures 29.

As discussed below, a board assembly disclosed herein can optionally and further comprise one or more features required to operationally engage with a stand assembly disclosed herein. In some embodiments, a board assembly disclosed herein comprises one or more support arm apertures, one or more tether anchors, and/or one or more support arm pivots.

Figure 13:
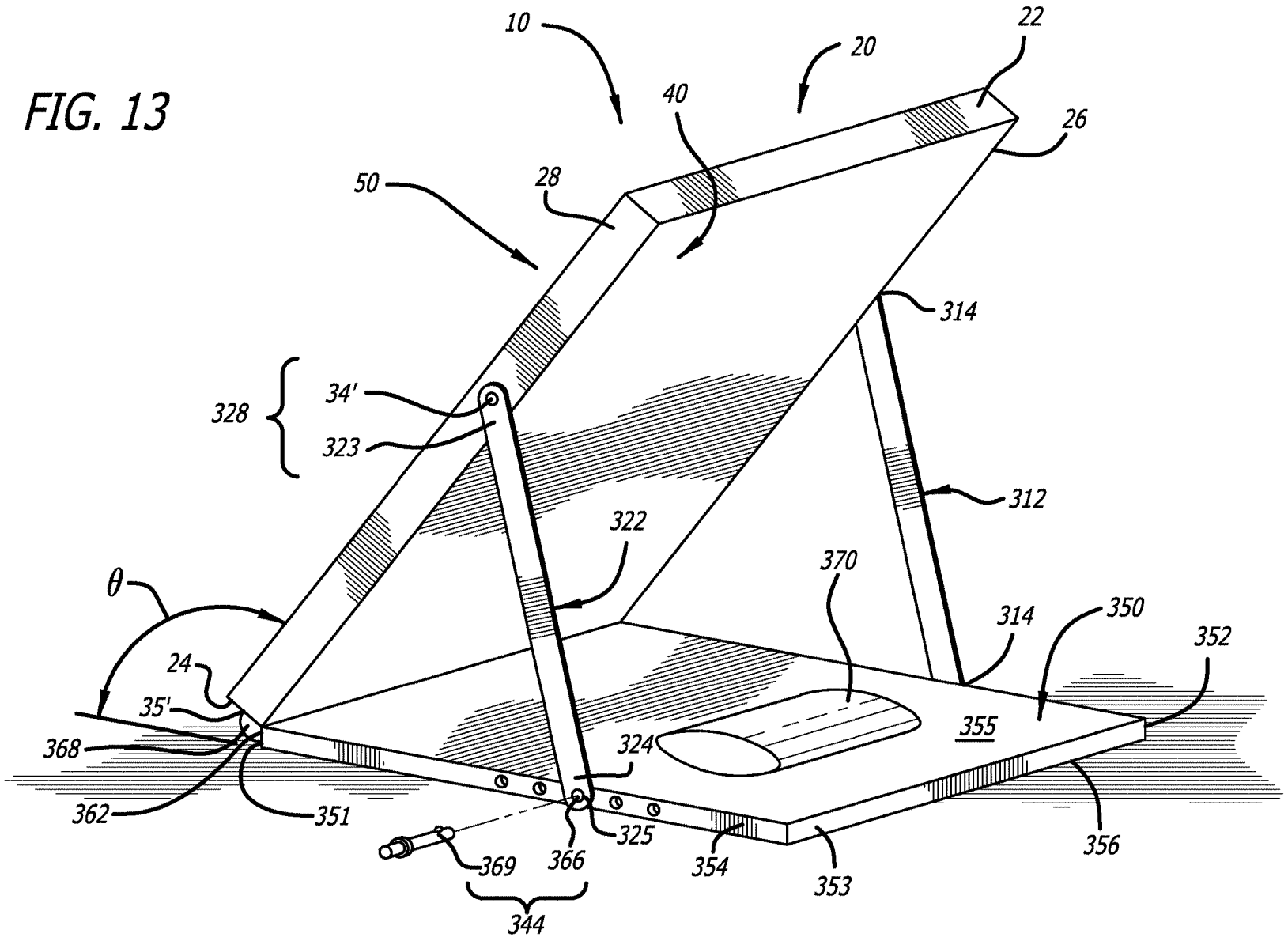
FIG. 13 is a rear perspective view of another exemplary stand assembly in accordance with an aspect of the present disclosure.
Figure 14:
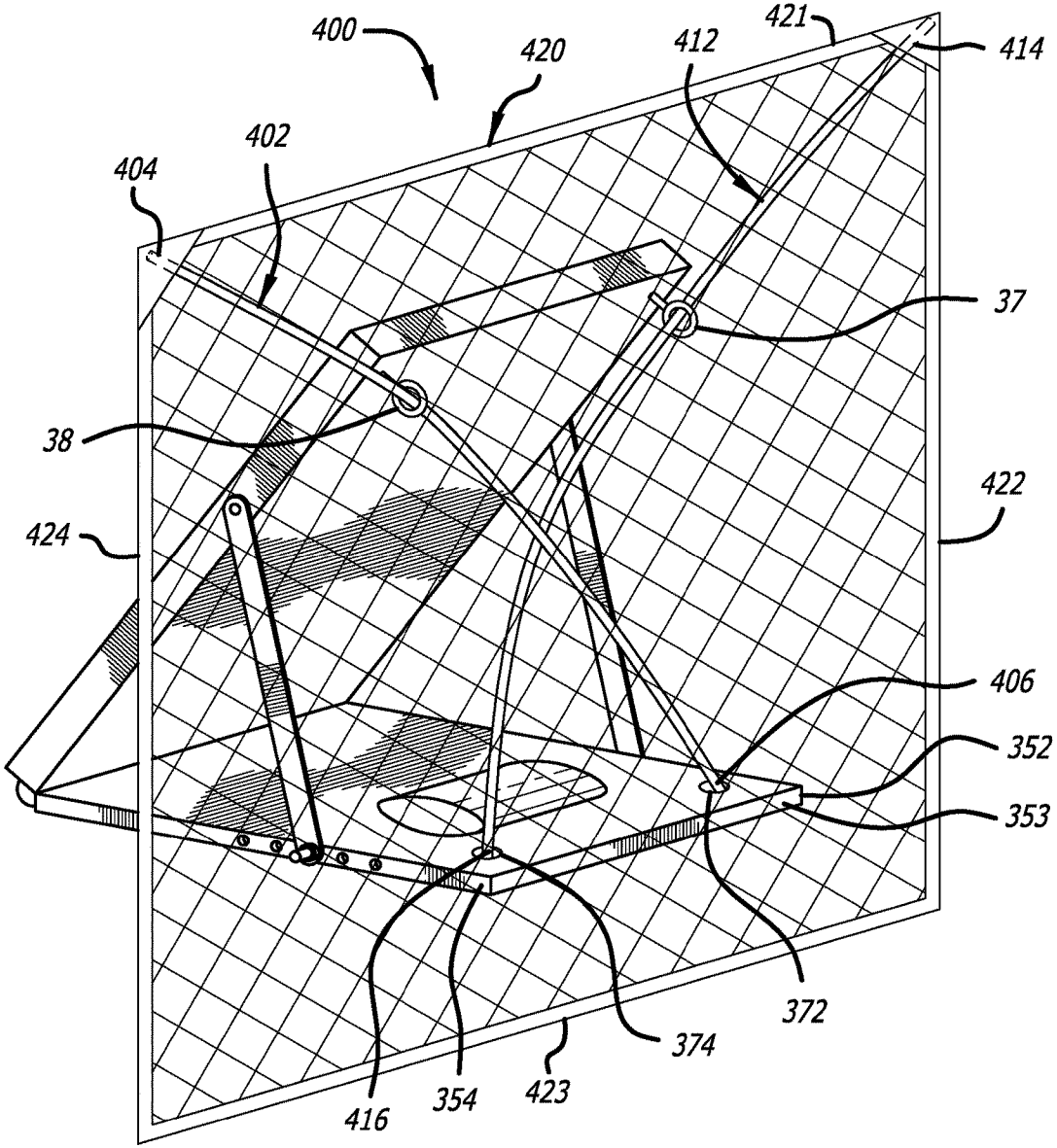
FIG. 14 is a rear perspective view of an exemplary backstop assembly for use with a portable ball play and practice apparatus disclosed herein.

A portable ball play and practice apparatus disclosed herein comprises a stand assembly dimensioned and sized to provide a stable support to a board assembly disclosed herein. A stand assembly disclosed herein is typically composed of ridged and durable materials such as, e.g., wood, metal, fiberglass, hard plastic, and the like. A stand assembly disclosed herein comprises one or more support arm assemblies and one or more stabilizing assemblies. Each of the one or more stabilizing assemblies are spaced apart and placed on either side of a rearward facing surface of a board assembly disclosed herein to provide a stable support of the board assembly. Attachment of one or more stabilizing assemblies to a rearward facing surface of a board assembly occur at one or more engagement points of a board assembly. In some embodiments, one engagement points are positioned at an interior portion a rearward facing surface of a board assembly. As shown in FIGS. 3-5 & 12 such interior portion positioning, as shown by first and second engagement points 32, 33, 32', 33', is typically near first and second frame sides 26, 28 and in the upper half of a board assembly as such positioning provides the required stable support of the board assembly. In some embodiments, and as shown in FIGS. 13 & 14, one or more engagement points, as shown by attachment points 33', 34', are positioned on the upper half of a surface of first and second frame sides 26, 28 of a board assembly disclosed herein. In some embodiments, and as shown in FIGS. 23 & 24, one or more engagement points 32, 33, are positioned within first and second frame sides 26, 28 of a board assembly disclosed herein. Besides providing the requisite stable support of a board assembly such surface positioning enables first and second support arms disclosed herein to more easily set up stand assembly disclosed herein so that the desired playing surface is outwardly facing.

In some embodiments, portable ball play and practice apparatus 10 comprise a collapsible board assembly 20". Collapsible board assembly 20'" provides a system which enables board assembly 20'" to be reversibly expandable to enable collapsible board assembly 20'" to adopt an expanded configuration or a retracted configuration. An expanded configuration of collapsible board assembly 20'" is employed when use of portable ball play and practice apparatus 10 is desired while a retracted configuration is employed when disassembly into a compact profile of collapsible board assembly 20'" is desired for easy transport or storage of portable ball play and practice apparatus 10. Unlike the other board assemblies disclosed herein, collapsible board assembly 20'" lacks first playing surface 40. As collapsible board assembly 20'" lacks first playing surface 40, both surfaces of collapsible board assembly 20'" are each second playing surface 50, and either can be positioned as a forward-facing surface and used as described herein.

Figure 18:
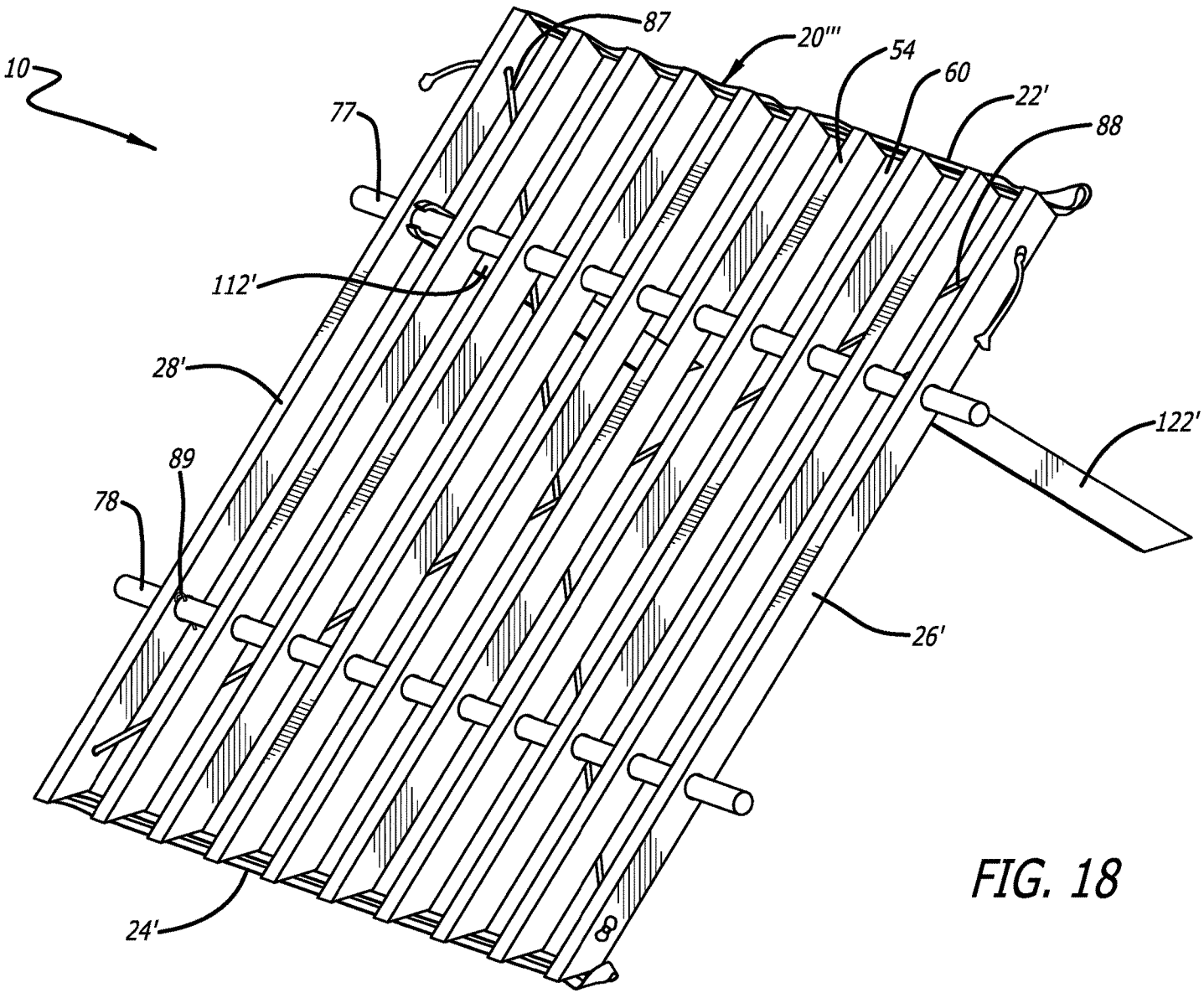
FIG. 18 is a front perspective view of a portable ball play and practice apparatus disclosed herein having a collapsible board assembly disclosed herein.
Figure 20:
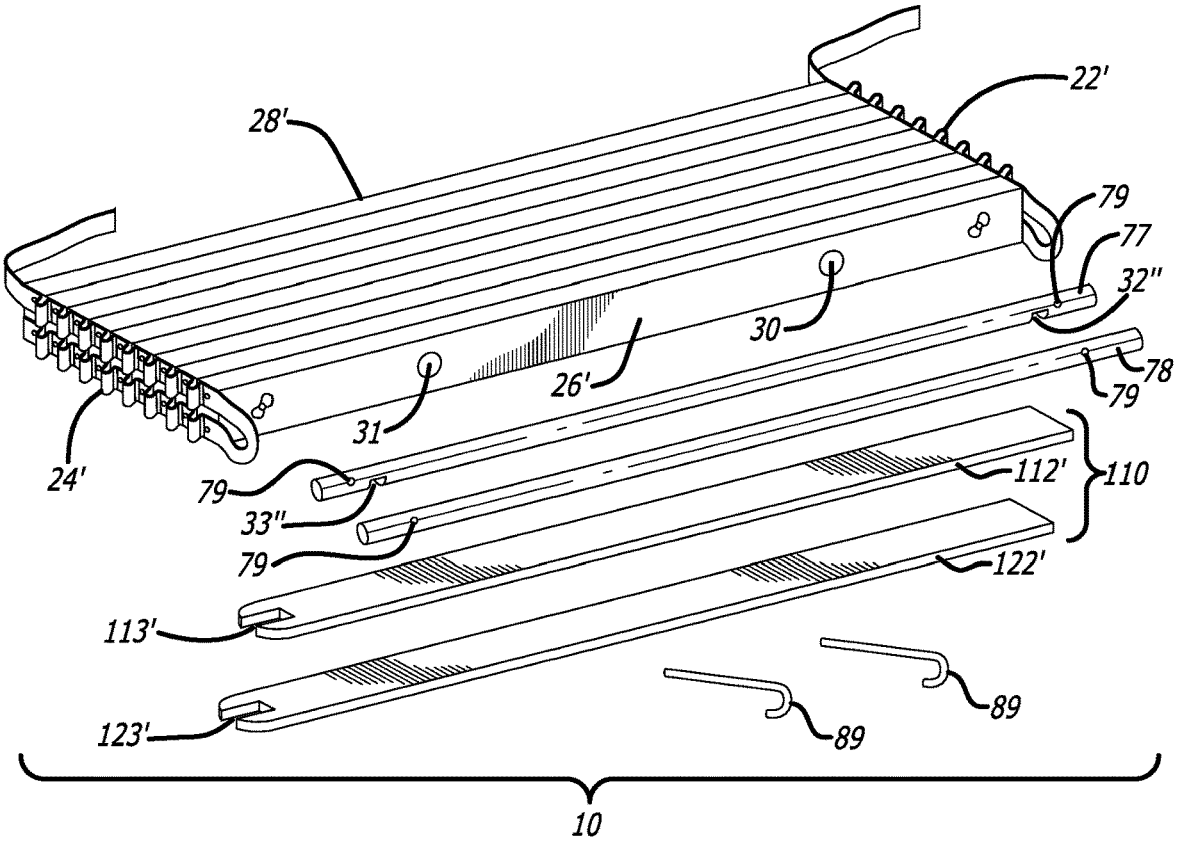
FIG. 20 is a front perspective view of a portable ball play and practice apparatus disclosed herein showing a collapsible board assembly disclosed herein in the retracted configuration along with a stand assembly disclosed herein.

In some embodiments, and referring to FIGS. 18 & 20, collapsible board assembly 20'" comprises a four-sided structure with a frame top 22', a frame bottom 24', a first side frame 26' and a second frame side 28'. Frame top 22' is opposite to frame bottom 24' and frame top 22 is generally parallel to frame bottom 24'. Similarly, first frame side 26' is opposite to second frame side 28' and first frame side 26' is generally parallel to second frame side 28'. First and second frame sides 26', 28' span between frame top and bottom 22', 24' and are substantially perpendicular to frame top and bottom 22', 24'. As shown in FIG. 18, interspaced between first and second frame sides 26', 28' are one or more elongated projections 54 that define spaces which function as one or more furrow 60. Each of the one or more elongated projections 54 have one end attached to frame top 22' and the opposite end attached to frame bottom 24'.

Frame top and bottom 22', 24' are configured to be reversibly expandable to enable first and second frame sides 26, 28 to expand away from each other or retract towards one another. Generally, the distance of expansion of collapsible board assembly 20'" will be defined by the length frame top and bottom 22', 24' can be completely expanded. The distance collapsible board assembly 20'" can be retracted will generally be defined by the physical constrains imposed by first and second frame sides 26', 28' and the number of one or more elongated projections 54 present in collapsible board assembly 20'". In some embodiments, and referring to FIGS. 18 & 20, frame top and bottom 22', 24' are composed of a fabric or other pliable material or an elastic material that enables reversibly expandable of first and second frame sides 26', 28'. In some embodiments, frame top and bottom 22', 24' are a scissor or accordion-style truss composed of a metal or hard plastic that enables reversibly expandable of first and second frame sides 26', 28'.

Figure 21:
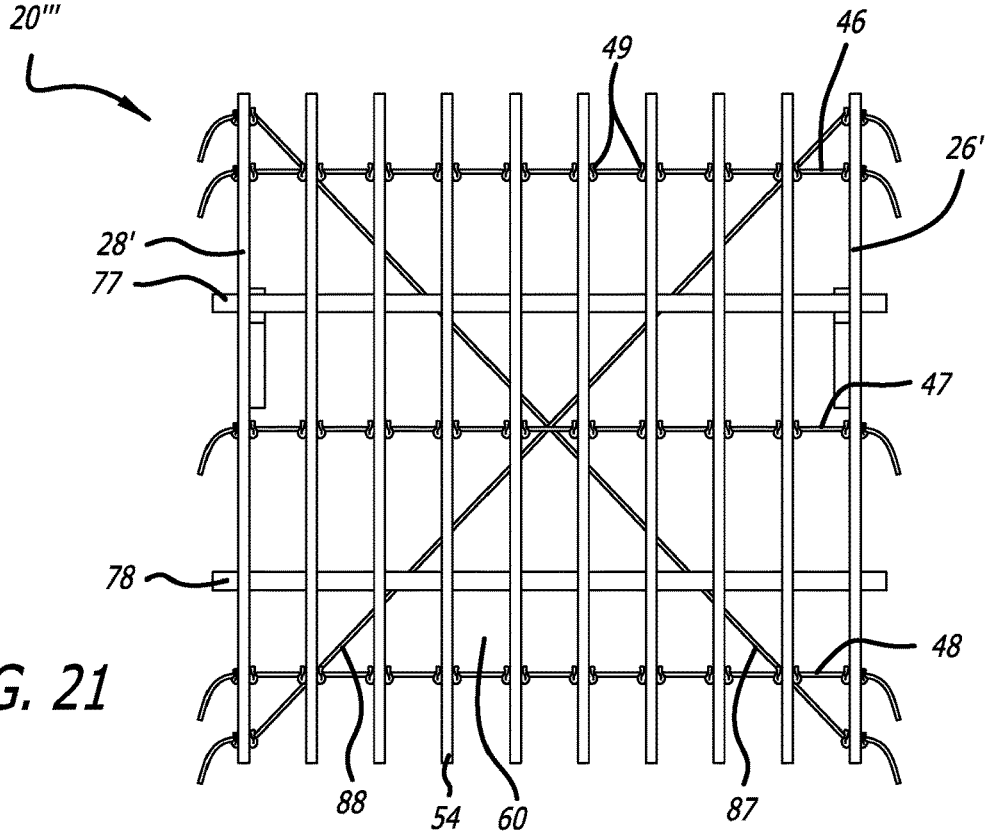
FIG. 21 is a front plan view of a portable ball play and practice apparatus disclosed herein having a collapsible board assembly disclosed herein.

In some embodiments, frame top and bottom 22', 24' are absent and in their place are one or more board cords or ropes, such as, e.g., one board cord, two board cords, three board cored, four board cords, or five board cords. A board cord disclosed herein links together first frame side 26', second frame sides 28' and each of the one or more elongated projections 54 in a manner that enables correct orientation and position of first frame side 26', second frame sides 28' and each of the one or more elongated projections 54 when in the expanded configuration. A board cord disclosed herein is composed of a fabric, rope, or other pliable material or an elastic material that enables reversibly expandable of first and second frame sides 26', 28'. In some embodiments, and referring to FIG. 21, collapsible board assembly 20'" includes a first board cord 46, a second board cord 47, and a third board cord 48. In these embodiments, first frame side 26', second frame side 28', and each of one or more elongated projections 54 includes a first board cord aperture, a second board cord aperture, and a third board cord aperture. Each of first, second, and third cord apertures is a through hole sized and dimensioned to enable insertion therethrough of first board cord 46, second board cord 47, and third board cord 48, respectively. In addition, each first board cord aperture from first frame side 26', second frame side, 28', and each of the one or more elongated projections 54 is aligned with respect to each other to enable first board cord 46 to insert through each first cord aperture in a manner that allows traversal of first board cord 46 across the distance between first and second frame sides 26', 28' when collapsible board assembly 20'" is in the expanded configuration. Similarly, each second board cord aperture from first frame side 26', second frame side, 28', and each of the one or more elongated projections 54 is aligned with respect to each other to enable second board cord 47 to insert through each second cord aperture in a manner that allows traversal of second board cord 47 across the distance between first and second frame sides 26', 28' when collapsible board assembly 20''' is in the expanded configuration. Likewise, each third board cord aperture from first frame side 26', second frame side, 28', and each of the one or more elongated projections 54 is aligned with respect to each other to enable third board cord 48 to insert through each third cord aperture in a manner that allows traversal of third board cord 48 across the distance between first and second frame sides 26', 28' when collapsible board assembly 20''' is in the expanded configuration. The location of first and third board cord apertures will generally be on the upper quarter and lower quarter of collapsible board assembly 20''', respectively as this location generally provides the best stability. In addition, the location of second board cord apertures will generally be centrally located on collapsible board assembly 20''' as this location generally provides the best stability. In some embodiments, first cord apertures are located just above upper rod apertures disclosed herein and third cord apertures are located just below lower rod apertures disclosed herein. The one or more board cords disclosed herein can include one or more fasteners that hold the one or more board cords in place, such as, e.g., a knot, a plug, a clamp, a clasp, or other type fastener. A fastener disclosed herein is typically secured on either side of a cord aperture located on first and second frame sides 26', 28', one or more elongated projections 54, or any combination thereof. In some embodiments, and as shown in FIG. 21, first, second and third board cords 46, 47, 48 are secured to collapsible board assembly 20''' by tying a knot 49 on either side of each of their respective board cord apertures located on first frame side 26', second frame side, 28', and each of the one or more elongated projections 54.

Collapsible board assembly 20''' further includes one or more board stabilizing rods, each having a first end and a second end and having a length sized and dimensioned to traverse the distance between first and second frame sides 26', 28' when collapsible board assembly 20''' is in the expanded configuration. In some embodiments, and referring to FIG. 18, collapsible board assembly 20''' further includes a first board stabilizing rod 77 and a second board stabilizing rod 78. First and second board stabilizing rods 77, 78 have a securing hole 79 near first and second ends, each being a though hole sized and dimensioned to receive a securing pin 89 therethrough. Securing holes 79 are positioned so that when first and second board stabilizing rods 77, 78 are properly positioned within collapsible board assembly 20''' as it adopts the expanded configuration, one securing hole 79 is located on the inside surface of first frame side 26' and another securing hole 79 is located on the inside surface of second frame side 28'. Additionally, first board stabilizing rod 77 has an engagement point 32" near its first end and an engagement point 33" near its second ends, and optionally second board stabilizing rod 78 has engagement point 32" near its first end and engagement point 33" near its second end. Engagement points 32", 33" are located next to securing holes 79 in a manner where securing holes 79 lie in between the first and second ends of first and second board stabilizing rods 77, 78 and engagement points 32", 33". In some embodiments, engagement points 32", 33" are notches cut into one location, or two locations where one is opposite the other, of first and/or second board stabilizing rods 77, 78. First frame side 26', second frame side 28', and each of one or more elongated projections 54 includes an upper rod aperture 30 and a lower rod aperture 31. Each upper and lower rod aperture 30, 31 is a through hole sized and dimensioned to enable insertion therethrough of first and second board stabilizing rods 77, 78 respectively. In addition, each upper rod aperture 30 from first frame side 26', second frame side, 28', and each of the one or more elongated projections 54 is aligned with respect to each other to enable first board stabilizing rod 77 to insert through each upper rod aperture 30 in a manner that allows traversal of first board stabilizing rod 77 across the distance between first and second frame sides 26', 28' when collapsible board assembly 20''' is in the expanded configuration. Similarly, each lower rod aperture 31 from first frame side 26', second frame side, 28', and each of the one or more elongated projections 54 is aligned with respect to each other to enable second board stabilizing rod 78 to insert through each lower rod aperture 31 in a manner that allows traversal of second board stabilizing rod 78 across the distance between first and second frame sides 26', 28' when collapsible board assembly 20''' is in the expanded configuration.

Additionally, one or more board stabilizing cords can optionally be present to provide further stability to collapsible board assembly 20''' when in the expanded configuration. Each of the one or more stabilizing cords disclosed herein have a length sized and dimensioned to traverse the distance between first and second frame sides 26', 28' when collapsible board assembly 20''' is in the expanded configuration. In some embodiments, and referring to FIG. 18, collapsible board assembly 20''' further includes a first stabilizing cord 87 and a second stabilizing cord 88, each having a first end and a second end opposite first end. In some embodiments, as shown in FIG. 18, the first end of first stabilizing cord 87 is attached to second frame side 28' near where frame top 22' attaches to second frame side 28' and the second end of first stabilizing cord 87 is attached to first frame side 26' near where frame bottom 24' attaches to first frame side 26', and the first end of second stabilizing cord 88 is attached to first frame side 26' near where frame top 22' attaches to first frame side 26' and the second end of second stabilizing cord 88 is attached second frame side 28' near where frame bottom 24' attaches to second frame side 28'. In these embodiments, first and second stabilizing cords 87, 88, form an X-structure when collapsible board assembly 20''' is in the expanded configuration. In some embodiments, first and second stabilizing cords 87, 88 can be attached to first and second frame sides 26', 28' by inserting first and second ends through holes present at the location of the attachment points of first and second frame sides 26', 28' and then tying a knot at each end inserted therethrough. Alternatively, first and second stabilizing cords 87, 88 can be attached to first and second frame sides 26', 28' by a fastener such as, e.g., a screw, a staple, a rivet, a tack, or other fastener that can attach first and second stabilizing cords 87, 88 to first and second frame sides 26', 28'.

In operation, collapsible board assembly 20''' is adopted into the expanded configuration by moving first and second frame sides 26', 28' away from each other until fully expanded. Generally, if present, first and second stabilizing cords 87, 88 are until fully expanded at this point as well. First and second board stabilizing rods 77, 78 are then inserted through each upper and lower rod aperture 30, 31, respectively in a manner where first and second board stabilizing rods 77, 78 traverse the distance between first and second frame sides 26', 28'. Once properly positioned, securing pins 89 can be inserted through securing holes 79 of at least second board stabilizing rod 78, although securing pins 89 can also be inserted through securing holes 79 of first board stabilizing rod 77, so as to fix in place and stabilize collapsible board assembly 20''' in the expanded configuration. In this manner, engagement points 32" of first and second board stabilizing rods 77, 78 lie within furrow 60 formed in between second frame side 28' and elongated projection 54 and engagement points 33" of first and second board stabilizing rods 77, 78 lie within furrow 60 formed in between first frame side 26' and elongated projection 54. Once first and second board stabilizing rods 77, 78 are secured, expanded collapsible board assembly 20''' can now receive a stand assembly disclosed herein.

In some embodiments, second playing surface 50 further and optionally comprises a flexible cover, such, as, e.g., a fabric or thin flexible material (not shown). Such, flexible cover is opaque in order to conceal one or more elongated projections 54 and furrows 60 of second playing surface 50. The purpose of flexible cover is to hide second playing surface 50 from the view of a user in order to further reduce the user's ability from anticipating a rebounding path a ball might travel when striking and rebounding from one or more elongated projections 54 and furrows 60 of second playing surface 50. Such concealment is useful for increasing the skill level of a user or providing one or more users with a more challenging game.

In some embodiments, a stand assembly disclosed herein can comprises a support arm assembly including one or more support arms and, optionally, a stabilizing assembly including one or more tethers and optionally one or more stabilizing pads. Each of the one or more support arms is typically a multi-sided or closed-arc linear structure having an attachment, a first end including a board assembly engagement portion and a second end including a stabilizing pad engagement portion. Each of the one or more tethers comprises a first end including a board assembly engagement portion and a second end including a support arm engagement portion. Each tether is typically a flexible material that optionally can be elastic and includes, without limitation, a static cord like a rope, cable, or other static line, or an elastic cord like a bungee cord, rubber cord, or other flexible line. Each of the one or more stabilizing pads comprises at attachment portion operationally configured to affix to a stabilizing pad engagement portion of a support arm and a stabilizing portion. Each stabilizing pad is configured to stability interact with a support surface to provide added stability to a portable ball play and practice apparatus disclosed herein. As assembled, a stabilizing pad is reversibly but securely affixed to a stabilizing pad engagement portion of a support arm and then a board assembly engagement portion of the support arm is reversibly but securely affixed into an engagement portion on a board assembly disclosed herein. To increase stability of a stand assembly, a board assembly engagement portion of a tether is secured to an attachment point located on a board assembly disclosed herein and a support arm engagement portion of the tether is secured to an attachment point located on the support arm.

In some embodiments, and referring to FIGS. 2-5, a stand assembly 100 comprises a support arm assembly 110 including a first support arm 112 and a second support arm 122 and a stabilizing assembly 130 including a first tether 132, a second tether 142, a first stabilizing pad 150 and a second stabilizing pad 160. In some embodiments, and referring to FIGS. 2-4, first and second tethers 132, 142 (depicted as elastic cords) comprise a first end including a board assembly engagement portion 133, 143 and a second end including a support arm engagement portion 134, 144. In some embodiments, and referring to FIGS. 2-5, first and second stabilizing pad 150, 160 comprises at attachment portion 152, 162 and a stabilizing portion 154, 164.

As shown in FIGS. 2-5, first and second support arms 112, 122 are each a four-sided linear structure of rectangular shape defined by a length, width, and height and a first end including an board assembly engagement portion 113, 123, respectively, and a second end including a stabilizing pad engagement portion 114, 124, respectively. First and second support arms 112, 122 are spaced apart and placed on either side of a rearward facing surface to provide stable support of a board assembly disclosed herein, with board assembly 20 being the example in FIGS. 2-5. Attachment of first and second support arms 112, 122 to a rearward facing surface of a board assembly disclosed herein occur at first and second engagement points 32, 33, respectively of a board assembly. In some embodiments, and referring to FIGS. 2-5, first and second engagement points 32, 33 are positioned at an interior portion a rearward facing surface of board assembly 20 nearby first and second frame sides 26, 28 and in the upper half of board assembly 20 as such positioning provides the requires stable support of board assembly 20.

In some embodiments, and still referring to FIGS. 2-5, first and second board assembly engagement portions 113, 123 can be configured as tenons to reversable and securely fit into first and second engagement points 32, 33, respectively of board assembly 20 which are operationally configured as mortises. By utilizing a mortise and tenon joint, in particular a shouldered joint, first and second board assembly engagement portions 113, 123 are operationally configured to precisely engage their respective first and second engagement points 32, 33. First and second board assembly engagement portions 113, 123 as tenons have shoulders that seat when fully entered into first and second engagement points 32, 33 and are wedged in place. Accordingly, such a through tenon and mortise, as a shouldered joint shown here, provides for a flush, strong, stable and removable attachment of first and second support arms 112, 122 of stand assembly 100 to board assembly 20.

A ball and practice apparatus 10 comprising a support arm assembly 110 having first and second support arms 112, 122 results in a board assembly disclosed herein, including board assembly 20, 20' and 20", having a fixed angle of play θ that is static or not adjustable. An angle of play θ disclosed herein is an angle that keeps rebounding ball 4' airborne for a sufficient time that user 2 can meaningfully engage rebounding ball 4' in accordance with the teachings disclosed herein. In some embodiments, a board assembly disclosed herein has a fixed angle of play θ of more than 90° with respect to the horizon, where fixed angle of play θ is the angle measured from the support surface upon which the stand assembly is disposed upon to the forward-facing playing surface. In some embodiments, a board assembly disclosed herein has an angle of play θ of, e.g., about 110°, about 115°, about 120°, about 125°, about 130°, about 135°, about 140°, about 145°, about 150°, about 155°, or about 160° with respect to the horizon.

When stabilizing pads 154, 164 are absent, stabilizing pad engagement portion 114, 124 have squared off ends which contact a support surface upon which portable ball play and practice apparatus 10 is disposed. If disposed upon a soft, giving support surface, such as sand on a beach, squared off ends of stabilizing pad engagement portion 114, 124 can be pushed into and driven into the soft, giving support surface to provide secure placement of portable ball play and practice apparatus 10.

Still referring to FIGS. 2-5, board assembly 20 can further comprise a first attachment point 34 disposed on one of first or second frames sides 26, 28 and a second attachment point 35 disposed on the other of first or second frames sides 26, 28. First attachment point 34 is configured to reversibly receive board assembly engagement portion 133 of first tether 132 and second attachment point 35 is configured to reversibly receive board assembly engagement portion 143 of second tether 142. Also shown in FIGS. 2-5, first support arm 112 can further comprise a first attachment point 115 and second support arm 122 can further comprise a second attachment point 125. First attachment point 115 is configured to reversibly receive support arm engagement portion 134 of first tether 132 and second attachment point 125 is configured to reversibly receive support arm engagement portion 144 of first tether 142. First and second board assembly engagement portion 133, 143 and first and second support arm engagement portion 134, 144 can be configured as, for example, a J-hook, an eye-hook, or lanyard. First and second attachment points 34, 35 and first and second attachment points 115, 125 can be configured as, for example, a peg, a screw, a bolt, a nail, a J-hook, or an eye-hook. As shown in FIGS. 2-5, first and second board assembly engagement portion 133, 143 and first and second support arm engagement portion 134, 144 are configured as a J-hook and first and second attachment points 34, 35 and first and second attachment points 115, 125 are configured as an eye-hook.

Stabilizing assembly 130 includes multiple, different interchangeable stabilizing pads to accommodate various playing conditions and surfaces. As shown in FIG. 3, stabilizing pads 154, 164 can be configured based on the type of support surface stabilizing pads 154, 164 will interact with and provide a stabilizing effect to portable ball play and practice apparatus 10 relative to a support arm assembly 110 without such stabilizing pads. For example, stabilizing portions 154, 164 can be configured as a spike having a base that tapers to a distal point structured to penetrate turf, sand, natural, or other penetrable ground surface, to provide a stabilizing effect to portable ball play and practice apparatus 10 when in use on such surface. As another example, stabilizing portions 154, 164 can be configured as an anti-skid pad having treated and/or textured surface, for example, elastomeric material or other suitable material providing an increased coefficient of friction between portions of stabilizing portions 154, 164. Such anti-skid surface provides a stabilizing effect to portable ball play and practice apparatus 10 when in use on a solid surface, for example, man-made surface, such as a court surface, hardwood flooring, asphalt, tiled surface, paved surface, clay surface, smooth surface, textured surface, rubberized surface, or other solid-like surface.

As assembled, stabilizing pad 150 is reversibly but securely affixed to stabilizing pad engagement portion 114 of first support arm 112 and then board assembly engagement portion 113 of first support arm 112 is reversibly but securely affixed into a first engagement portion 32 on board assembly 20. To increase stability of stand assembly 100, a board assembly engagement portion 133 of first tether 132 is secured to an attachment point 34 located on a board assembly 20 and a support arm engagement portion 134 of first tether 132 is secured to an attachment point 115 located on first support arm 112. Second support arm 122, second stabilizing pad 160 and second tether 142 of support arm assembly 110 are assembled in the same manner as described for first support arm 112, first stabilizing pad 150 and first tether 132.

As shown in FIGS. 1, 3 & 4, by disassembling and reassembling stand assembly 100, portable ball play and practice apparatus 10 can be changeably configured between a first playing position and a second playing position. More specifically, in a first playing position shown in FIG. 3, board assembly 20 is positioned, relative to stand assembly 100, such that first playing surface 40 is forwardly facing and second playing surface 50 is rearwardly facing. In a second position shown in FIG. 4, board assembly 20 is positioned, relative to stand assembly 100, such that second playing surface 50 is forwardly facing and first playing surface 40 is rearwardly facing.

Figure 19:
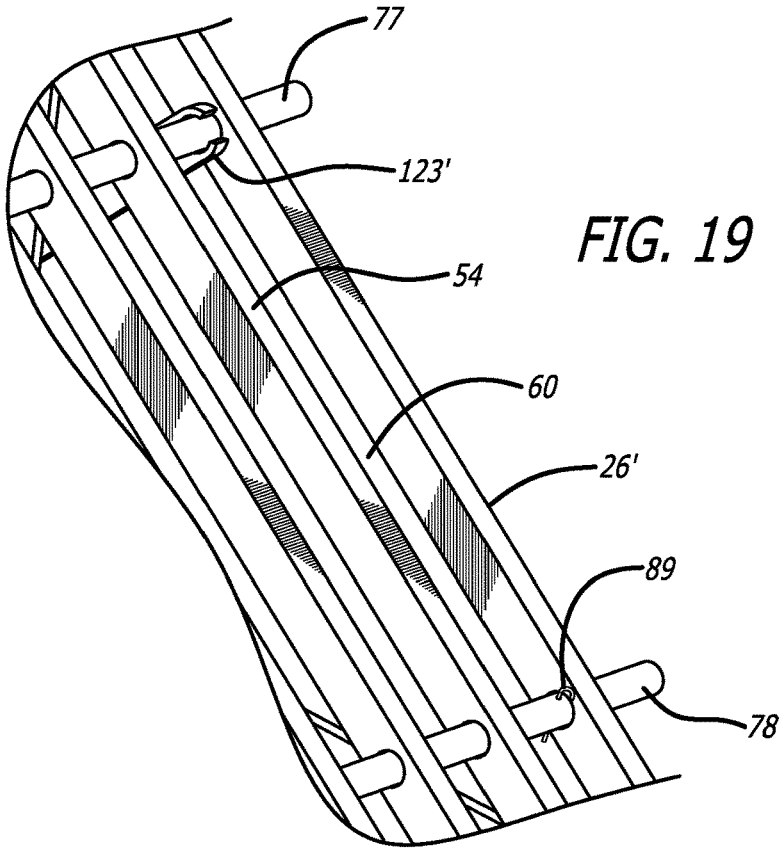
FIG. 19 is a magnified front perspective view of a collapsible board assembly disclosed herein showing an exemplary mechanism for securing the collapsible board assembly in the expanded configuration.

In some embodiments, and referring to FIGS. 18-20, a stand assembly 100 comprises a support arm assembly 110 including a first support arm 112' and a second support arm 122' and, optionally, a stabilizing assembly. As shown in FIG. 20, first and second support arms 112', 122' are each a four-sided linear structure of rectangular shape defined by a length, width, and height and a first end including a board assembly engagement portion 113', 123', respectively, and a second end. As shown in FIGS. 19 & 20, board assembly engagement portions 113', 123' can each be a notch sized and dimensioned to receive engagement points 32", 33" of first board stabilizing rod 77 of collapsible board assembly 20'". First and second support arms 112', 122' are spaced apart and placed on either side of a rearward facing surface to provide stable support of a board assembly disclosed herein, with board assembly 20 being the example in FIGS. 18-20. Although not shown, stand assembly 100 of collapsible board assembly 20'" can further include a stabilizing assembly including a first tether and a second tether similar to stabilizing assembly 130 with first tether 132 and a second tether 142 and attached to first and second frame sides 26', 28' and first and second support arms 112, 122, in a manner similar to that described above for first tether 132 and a second tether 142.

In some embodiments, and referring to FIGS. 22-25, a stand assembly of portable ball play and practice apparatus 10 comprises a support arm assembly including a first support arm 112 and a second support arm 122. First and second support arms 112, 122 are each a cylinder shape defined by a length and diameter. During assembly, first and second support arms 112, 122 are inserted into first and second engagement points 32, 33 respectively, located in first and second frame sides 26, 28. In some embodiments, and as shown in FIG. 24, first and second support arms 112, 122 comprises an outer and inner tube arrangement that enables the length of first and second support arms 112, 122 to be adjusted.

In some embodiments, a stand assembly disclosed herein can comprises a support arm assembly including one or more swingable support arms and a stabilizing assembly including one or more swingable stabilizing feet. Each of the one or more swingable support arms is typically a multi-sided or closed-arc linear structure having a first end including a board assembly engagement portion and a second end including a stabilizing foot engagement portion including a securing pin aperture. Each of the one or more swingable stabilizing feet is typically a multi-sided, open-arc, or closed-arc linear structure having a first end including a board assembly hinge portion and a second region including a hinge, a support arm slot, one or more securing pin apertures, and a securing pin. Each swingable stabilizing foot is configured to stability interact with a support surface to provide added stability to a portable ball play and practice apparatus disclosed herein. As assembled, a board assembly engagement portion for each swingable support arm is secured to an attachment point of a board assembly disclosed herein and each swingable stabilizing foot is affixed to a hinge engagement portion on a board assembly disclosed herein. A stabilizing foot engagement portion of each swingable support arm is then inserted into a support arm slot of a swingable stabilizing foot it is operationally aligned with. A securing pin aperture of for each swingable support arm is then aligned with a securing pin aperture of the one or more securing pin apertures of a swingable stabilizing foot and a securing pin is inserted therethrough reversibly and securely attaching each swingable support arm to its respective swingable stabilizing foot. The movement allowed by both the one or more swingable support arms and one or more swingable stabilizing feet enable a user to adjust the angle a board assembly disclosed herein to one desired for use.

In some embodiments, and referring to FIG. 12, a stand assembly 100 comprises a support arm assembly 110 including a first swingable support arm 212 and a second swingable support arm 222 and a stabilizing assembly 130 including a first stabilizing foot 250 and a second stabilizing foot 260. In some embodiments, and referring to FIG. 12, second stabilizing foot 260 comprises a board assembly hinge portion 262 and a stabilizing portion 264. Similarly, first stabilizing foot 250 comprises a board assembly hinge portion (not shown) and a stabilizing portion (not shown).

As shown in FIG. 12, first and second swingable support arms 212, 222 are each a four-sided linear structure of rectangular shape defined by a length, width, and height. Each of first and second swingable support arms 212, 222 include a first end including an board assembly engagement portion 213, 223, respectively, and a second end including a stabilizing foot engagement portion 214, 224, respectively. First and second swingable support arms 212, 222 are spaced apart and placed on either side of a rearward facing surface to provide stable support of a board assembly disclosed herein, with hinged board assembly 20' being the example in FIG. 12. Attachment of first and second swingable support arms 212, 222 to a rearward facing surface of a board assembly disclosed herein occur at first and second engagement points 32', 33', respectively of a board assembly. In some embodiments, and referring to FIG. 12, first and second engagement points 32', 33' are positioned at an interior portion a rearward facing surface of board assembly 20' nearby first and second frame sides 26, 28 and in the upper half of board assembly 20' as such positioning provides the requires stable support of board assembly 20'. In some embodiments, first and second engagement points 32', 33' are configured include tenons to reversable and securely fit into first and second engagement points 32, 33, respectively of board assembly 20 which are operationally configured as mortises.

In some embodiments, and still referring to FIG. 12, first board assembly engagement portion 213 comprises a pivot through hole and engagement point 32' is configured as a bracket with a through hole that enables rotational movement. A first pivot joint 218 is formed by inserting first board assembly engagement portion 213 into engagement point 32' and reversibly and securely affixing both components by a pin, such as a cotter or a hitch pin clip or the like, for example, inserted through the through holes of first board assembly engagement portion 213 and engagement point 32'. First pivot joint 218 enables first swingable support arms 212 to freely pivot about the pin of first pivot joint 218 enabling first swingable support arm 212 to swing toward or away from board assembly 20. A second pivot joint 228 is similarly formed using second board assembly engagement portion 223 and engagement point 33' as described above for first board assembly engagement portion 213 and engagement point 32'. Both first and second swingable support arms 212, 222 can have the ends rounds, e.g., half-circle shaped, to facilitate movement of their respective swingable support arm about the pin of first and second pivot joint 218, 228.

As shown in FIG. 12, first and second swingable stabilizing feet 250, 260 are each a four-sided linear structure of rectangular shape defined by a length, width, and height and a first end including an board assembly hinge portion and a stabilizing portion including a support arm slot 255, 265, one or more securing bolt apertures, and a securing bolt, respectively. Each of first and second swingable stabilizing feet 250, 260 are reversibly and securely affixed to a board assembly disclosed herein including board assembly 20, 20' and 20". For example, as shown in FIG. 12, second swingable stabilizing foot 260 is reversibly and securely affixed to board assembly 20' securing a second hinge 268 to a second board assembly hinge portion 262 of second swingable stabilizing foot 260 and a second attachment point 34' of board assembly 20' located on frame bottom 24. First swingable stabilizing foot 250 is reversibly and securely affixed to frame bottom 24 of board assembly 20' in the same manner as described for second swingable stabilizing foot 260. In some embodiments, hinges, as shown for second 268 in FIG. 12, are attached in a manner enabling first and second swingable stabilizing feet 250, 260 and a board assembly disclosed herein to be substantially fully rotated about the hinges to enable play on either playing surface of a board assembly disclosed herein. In some embodiments, first and second swingable stabilizing feet 250, 260 and a board assembly disclosed herein may be collapsible about hinges to enable a folded-like, face-to-face configuration, e.g. with first and second swingable stabilizing feet 250, 260 substantially abutting first playing surface 40 or second playing surface 50. Such collapsible positioning allows for ease of transport or storage of portable ball play and practice apparatus 10.

Referring to FIG. 12, each of support arm slots 255, 265 is a narrow channel within first and second swingable stabilizing feet 250, 260, respectively and parallel to the length of its respective stabilizing foot. The placement of support arm slots 255, 265 along its respective stabilizing foot is generally based on the desired angle of a board assembly disclosed herein to be achieved and is typically dimensioned and sized to operationally angle a board assembly disclosed herein between from about 30° to about 75°. As best seen for second securing bolt aperture 266 in FIG. 12, each of one or more securing bolt apertures are holes running perpendicular to and into support arm slots 255, 265, respectively, to form through holes configured to receive securing bolt, as shown in FIG. 12 for securing bolt 269. One or more securing bolt apertures are each spaced apart and aligned along a portion or all of support arm slots 255, 265, respectively. In some embodiments, each securing bolt aperture forms a through hole on either side of its respective support arm slot. In some embodiments, each securing bolt aperture forms a through hole on one side of its respective support arm slot but a corresponding blind hole on the other side of its respective support arm slot. Inserting a securing bolt into one of the one or more securing bolt apertures suitable affixes stabilizing foot engagement portions 214, 224 of first and second swingable support arms 212, 222, to first and second swingable stabilizing feet 250, 260, respectively. As such, securing bolts provided for quick and easy connection between first and second swingable support arms 212, 222 and first and second swingable stabilizing feet 250, 260, respectively. As discussed below, by selectively connecting first and second swingable support arms 212, 222 to first and second swingable stabilizing feet 250, 260, a board assembly disclosed herein can have its angle of play θ adjusted as desired.

Still referring to FIG. 12, stabilizing foot engagement portion 224 of second swingable support arm 222 is inserted into support arm slot 265 of second swingable stabilizing foot 260 in an manner that aligns a securing bolt aperture of second swingable arm 222 with one of the one or more securing bolt apertures 266 of second swingable stabilizing foot 260 and enables securing bolt 269 to be inserted through the securing bolt apertures 266 and securing bolt aperture of second swingable arm 222 to reversibly and securely attach second swingable arm 222 to second swingable stabilizing foot 260. First swingable support arm 212 is reversibly and securely attached to first swingable stabilizing foot 250 in the same manner as described for second swingable arm 222. Once first and second swingable arms 212, 222, are securely attached to first and second swingable stabilizing feet 250, 260, a board assembly disclosed herein is operationally and stably fixed at a certain angle. Since attachment of first and second swingable arms 212, 222 to first and second swingable stabilizing feet 250, 260 are reversable, a user can adjust the angle of a board assembly disclosed herein by removing the securing bolts, aligning securing bolt apertures of first and second swingable arms 212, 222 with a different securing bolt aperture of the one or more securing bolt apertures of first and second swingable stabilizing feet 250, 260, and then reinserting securing bolts.

A ball and practice apparatus 10 comprising a support arm assembly 110 having first and second support arms 212, 222 and first and second swingable stabilizing feet 250, 260, results in a board assembly disclosed herein, including board assembly 20, 20' and 20", that can have its angle of play θ adjusted. In some embodiments, a board assembly disclosed herein has an angle of play θ that can be adjusted from about 110° to about 160° with respect to the horizon, where angle of play θ is the angle measured from the support surface upon which the stand assembly is disposed upon to the forward-facing playing surface. In some embodiments, a board assembly disclosed herein has an angle of play θ that can be adjusted from, e.g., about 110° to about 120°, about 110° to about 130°, about 110° to about 140°, about 110° to about 150°, about 110° to about 160°, about 120° to about 130°, about 120° to about 140°, about 120° to about 150°, about 120° to about 160°, about 130° to about 140°, about 130° to about 150°, about 130° to about 160°, about 140° to about 150°, about 140° to about 160°, or about 140° to about 160° with respect to the horizon. In some embodiments, a board assembly disclosed herein has an angle of play that can be adjusted from, e.g., about 120° to about 160°, about 125° to about 155°, about 130° to about 150°, about 135° to about 145° with respect to the horizon.

In some embodiments, a board assembly disclosed herein can have its angle of play adjusted by a range encompassing, e.g., at least 30°, at least 35°, at least 40°, at least 45°, at least 50°, at least 55°, at least 60°, at least 65°, at least 70°, or at least 75°. In some embodiments, a board assembly disclosed herein can have its angle of play θ adjusted by a range encompassing, e.g., at most 30°, at most 35°, at most 40°, at most 45°, at most 50°, at most 55°, at most 60°, at most 65°, at most 70°, or at most 75°. In some embodiments, a board assembly disclosed herein can have its angle of play θ adjusted by a range encompassing, e.g., about 30° to about 40°, about 30° to about 50°, about 30° to about 60°, about 30° to about 70°, about 35° to about 40°, about 35° to about 50°, about 35° to about 60°, about 35° to about 70°, about 40° to about 50°, about 40° to about 60°, about 40° to about 70°, about 45° to about 50°, about 45° to about 60°, about 45° to about 70°, about 50° to about 60°, about 50° to about 70°, about 55° to about 60°, about 55° to about 70°, or about 60° to about 70°.

In some embodiments, a stand assembly disclosed herein can comprises a support arm assembly including one or more swingable support arms and a stabilizing assembly including a swingable stabilizing platform. Each of the one or more swingable support arms is typically a multi-sided or closed-arc linear structure having a first end including a board assembly engagement portion and a second end including a stabilizing foot engagement portion including a securing pin aperture. A swingable stabilizing platform is typically a four-sided base whose length and width are similar in size and dimension to a board assembly disclosed herein that it is associated with. A swingable stabilizing platform has one side including one or more board assembly hinge portions, and two sides that each including one or more securing pin apertures and a securing pin. Swingable stabilizing platform is configured to stability interact with a support surface to provide added stability to a portable ball play and practice apparatus disclosed herein. As assembled, a board assembly engagement portion of each swingable support arm is secured to an attachment point of a board assembly disclosed herein and a swingable stabilizing platform is affixed to a hinge engagement portion on a board assembly disclosed herein. A securing pin aperture for each swingable support arm is then aligned with a securing pin aperture of the one or more securing pin apertures located on either the second or third sides of a swingable stabilizing platform and a securing pin is inserted therethrough to reversibly and securely attaching the swingable support arm to the swingable stabilizing platform. The movement allowed by both the one or more swingable support arms and the swingable stabilizing platform enable a user to adjust the angle a board assembly disclosed herein to one desired for use.

In some embodiments, and referring to FIG. 13, a stand assembly 100 comprises a support arm assembly 110 including a first swingable support arm 312 and a second swingable support arm 322 and a stabilizing assembly including a swingable stabilizing platform 350. As shown in FIG. 13, first and second swingable support arms 312, 322 are each a four-sided linear structure of rectangular shape defined by a length, width, and height. Each of first and second swingable support arms 312, 322 include a first end including an board assembly engagement portion 313, 323, respectively, and a second end including a stabilizing foot engagement portion 314, 324, respectively. First and second swingable support arms 312, 322 are spaced apart and placed on either side of a rearward facing surface to provide stable support of a board assembly disclosed herein, with board assembly 20 being the example in FIG. 13. Attachment of first and second swingable support arms 312, 322 to a rearward facing surface of a board assembly disclosed herein occur at first and second engagement points, respectively of a board assembly. In some embodiments, and referring to FIG. 13, second engagement point 34' is positioned in the upper half of second frame side 28 and of board assembly 20 as such positioning provides the requires stable support of board assembly 20. Similarly, a first engagement point (not shown) is positioned in the upper half of first frame side 26 and of board assembly 20 as such positioning provides the requires stable support of board assembly 20.

In some embodiments, and referring to FIG. 13, second board assembly engagement portion 323 comprises a pivot through hole and an engagement point 34' of board assembly 20 is configured as a blind hole housing that enables rotational movement and can include a sleaved or ball-bearing socket. A second pivot joint 328 is formed by aligning pivot through hole of second board assembly engagement portion 323 with blind hole housing of engagement point 34' and reversibly and securely affixing both components by a pin, such as a cotter or a hitch pin clip or the like, for example. Second pivot joint 328 enables second swingable support arms 322 to freely pivot about the pin of first pivot joint 328 enabling second swingable support arm 322 to swing toward or away from board assembly 20. Similarly, first board assembly engagement portion 313 comprises a pivot through hole and an engagement point (not shown) of board assembly 20 is configured as a blind hole housing that enables rotational movement and can include a sleaved or ball-bearing socket. A first pivot joint (not shown) is formed using a first board assembly engagement portion 313 and an engagement point (not shown) as described above for second board assembly engagement portion 323 and engagement point 34'. Both first and second swingable support arms 312, 322 can have the ends rounds, e.g., half-circle shaped, to facilitate movement or operational effectiveness of their respective swingable support arm about the pin of first and second pivot joints.

In some embodiments, and still referring to FIG. 13, swingable stabilizing platform 350 is a four-sided structure having a length, width, and height and defined by a first side 351, a second side 352, a third side 353, a fourth side 354, a top surface 355, and a bottom surface 356. First side 351 is opposite to third side 353 and first side 351 is generally parallel to third side 353. Similarly, second side 352 is opposite to fourth side 354 and second side 352 is generally parallel to fourth side 354. Second and fourth sides 352, 354 span between first and third sides 351, 353 and are substantially perpendicular to first and third sides 351, 353. First side 351 of stabilizing platform 350 includes one or more board assembly hinge portions 362 configured to removably receive a hinge 368. Second and fourth sides 352, 354 of swingable stabilizing platform 350 each include a stabilizing portion 364.

Stabilizing portion 364 of second and fourth sides 352, 354 each include one or more securing bolt apertures 366, and a securing bolt 369. Swingable stabilizing platform 350 is reversibly and securely affixed to a board assembly disclosed herein including board assembly 20, 20' and 20". For example, as shown in FIG. 13, swingable stabilizing platform 350 is attached to board assembly 20 by securing hinge 368 to a board assembly hinge portion 362 located at first side 351 of swingable stabilizing platform 350 and an attachment point 35' of board assembly 20 located on frame bottom 24. Although one securing hinge 368 is depicted, more than one hinge 368 is present in order to provide sufficient stability to portable ball paly and practice apparatus 10. In some embodiments, securing hinge 368 is attached in a manner enabling swingable stabilizing platform 350 and a board assembly disclosed herein to be substantially fully rotated about securing hinge 368 to enable play on either playing surface of a board assembly disclosed herein. In some embodiments, swingable stabilizing platform 350 and a board assembly disclosed herein may be collapsible about securing hinge 368 to enable a folded-like, face-to-face configuration, e.g. with top surface 355 of swingable stabilizing platform 350 substantially abutting first playing surface 40 (or second playing surface 50), for ease of transport or storage of portable ball play and practice apparatus 10.

Referring to FIG. 13, second and fourth sides 352, 353 each include one or more securing bolt apertures 366 that are spaced apart. The placement of one or more securing bolt apertures 366 along its respective side is generally based on the desired angle of a board assembly disclosed herein to be achieved and is typically dimensioned and sized to operationally angle a board assembly disclosed herein between from about 30° to about 75°. Each of securing bolt apertures 366 is configured as a blind hole housing that can include a sleaved or ball-bearing socket and is configured to receive securing bolt 369. Inserting securing bolt 369 into one of the one or more securing bolt apertures 366 suitable affixes stabilizing foot engagement portions 314, 324 of first and second swingable support arms 312, 322, to second and fourth sides 352, 353, respectively of swingable stabilizing platform 360. As such, securing bolt 369 provided for quick and easy connection between first and second swingable support arms 312, 322 and swingable stabilizing platform 360. As discussed below, by selectively connecting first and second swingable support arms 312, 322 to swingable stabilizing platform 360, a board assembly disclosed herein can have its angle of play θ adjusted as desired.

Still referring to FIG. 13, a securing bolt aperture 325 of stabilizing platform engagement portion 324 of second swingable support arm 322 is aligned with one of the one or more securing bolt apertures 366 of fourth side 354 of swingable stabilizing platform 350 which enables securing bolt 369 to be inserted through securing bolt aperture 325 of stabilizing platform engagement portion 324 and securing bolt apertures 366 to reversibly and securely attach second swingable arm 322 to swingable stabilizing platform 350. First swingable support arm 312 is reversibly and securely attached to second side 352 of swingable stabilizing platform 350 in the same manner as described for second swingable arm 322. Once first and second swingable arms 312, 322, are securely attached to swingable stabilizing platform 350, a board assembly disclosed herein is operationally and stably fixed at a certain angle. Since attachment of first and second swingable arms 312, 322 to swingable stabilizing platform 350 are reversable, a user can adjust the angle of a board assembly disclosed herein by removing the securing bolts, aligning securing bolt apertures of first and second swingable arms 312, 322 with a different securing bolt aperture of the one or more securing bolt apertures of swingable stabilizing platform 350, and then reinserting securing bolts.

A ball and practice apparatus 10 comprising a support arm assembly 110 having first and second support arms 312, 322 and swingable stabilizing platform 350, results in a board assembly disclosed herein, including board assembly 20, 20' and 20", that can have its angle of play adjusted. In some embodiments, a board assembly disclosed herein has an angle of play θ that can be adjusted from about 110° to about 160° with respect to the horizon, where angle of play is the angle measured from the support surface upon which the stand assembly is disposed upon to the forward-facing playing surface. In some embodiments, a board assembly disclosed herein has an angle of play θ that can be adjusted from, e.g., about 110° to about 120°, about 110° to about 130°, about 110° to about 140°, about 110° to about 150°, about 110° to about 160°, about 120° to about 130°, about 120° to about 140°, about 120° to about 150°, about 120° to about 160°, about 130° to about 140°, about 130° to about 150°, about 130° to about 160°, about 140° to about 150°, about 140° to about 160°, or about 140° to about 160° with respect to the horizon. In some embodiments, a board assembly disclosed herein has an angle of play θ that can be adjusted from, e.g., about 120° to about 160°, about 125° to about 155°, about 130° to about 150°, about 135° to about 145° with respect to the horizon.

In some embodiments, a board assembly disclosed herein can have its angle of play θ adjusted by a range encompassing, e.g., at least 30°, at least 35°, at least 40°, at least 45°, at least 50°, at least 55°, at least 60°, at least 65°, at least 70°, or at least 75°. In some embodiments, a board assembly disclosed herein can have its angle of play θ adjusted by a range encompassing, e.g., at most 30°, at most 35°, at most 40°, at most 45°, at most 50°, at most 55°, at most 60°, at most 65°, at most 70°, or at most 75°. In some embodiments, a board assembly disclosed herein can have its angle of play θ adjusted by a range encompassing, e.g., about 30° to about 40°, about 30° to about 50°, about 30° to about 60°, about 30° to about 70° about 35° to about 40°, about 35° to about 50°, about 35° to about 60°, about 35° to about 70° about 40° to about 50°, about 40° to about 60°, about 40° to about 70°, about 45° to about 50° about 45° to about 60°, about 45° to about 70°, about 50° to about 60°, about 50° to about 70° about 55° to about 60°, about 55° to about 70°, or about 60° to about 70°.

In some embodiments, and as shown in FIG. 13, a ballast 370 or other weighted element can be deposed upon top surface 355 of swingable stabilizing platform 350 may be provided to provide additional stability to portable ball play and practice apparatus 10 when in use.

A portable ball play and practice apparatus disclosed herein can optionally comprise a backstop assembly. A backstop assembly is dimensioned and sized to prevent errant balls that fail to properly rebound off a board assembly disclosed herein from careening off away from a field of play. For example, a ball could fail to strike a board assembly disclosed herein or strike a board assembly disclosed herein in a manner that causes the ball to deflect away from the field of play. A backstop assembly disclosed herein achieves this function by, e.g., capturing a ball to halt it from leaving a field of play, or redirecting the ball by into a field of play, thus minimizing a user's time wasted chasing down errant balls.

In some embodiments, a backstop assembly is a stand-alone component that is typically set up behind a board assembly and stand assembly disclosed herein. In some embodiments, a stand-alone backstop assembly comprises a net, L-shaped connector joints, and stiff or flexible poles to form frame to which a net is attached and having front opening that can be a rectangular or half circle in shape. A stand-alone backstop assembly generally has front openings with a height of about 4 feet to 8 feet and width of about 6 feet to 24 feet. Non-limiting examples of a stand-alone backstop assembly include an ice hockey goal, a field hockey goal, and a soccer goal, each of which is widely available in commerce.

In some embodiments, a backstop assembly affixed to either or both a board assembly and stand assembly disclosed herein. A attachable backstop assembly disclosed herein requires that the associated portable ball play and practice apparatuses 10 further includes additional components to enable reversable attachment of the attachable backstop assembly to either or both a board assembly and stand assembly disclosed herein.

In some embodiments, an attachable backstop assembly comprises one or more net poles and a net. Each of the one or more net poles is typically a multi-sided or closed-arc linear structure defined by a length and width (or diameter) and having a first end including a net engagement portion and a second end including a platform engagement portion. In addition, each net poles can be rigid or flexible and may also be configured as a nesting sectional pole. In some embodiments, a net pole disclosed herein can have a length of, e.g., at least 4 feet, at least 5 feet, at least 6 feet, at least 7 feet, at least 8 feet, at least 9 feet, or at least 10 feet. In some embodiments, a net pole disclosed herein can have a length of, e.g., at most 4 feet, at most 5 feet, at most 6 feet, at most 7 feet, at most 8 feet, at most 9 feet, or at most 10 feet. In some embodiments, a net pole disclosed herein can have a length of, e.g., about 4 feet to about 5 feet, about 4 feet to about 6 feet, about 4 feet to about 7 feet, about 4 feet to about 8 feet, about 4 feet to about 9 feet, about 4 feet to about 10 feet, about 5 feet to about 6 feet, about 5 feet to about 7 feet, about 5 feet to about 8 feet, about 5 feet to about 9 feet, about 5 feet to about 10 feet, about 6 feet to about 7 feet, about 6 feet to about 8 feet, about 6 feet to about 9 feet, about 6 feet to about 10 feet, about 7 feet to about 8 feet, about 7 feet to about 9 feet, about 7 feet to about 10 feet, about 8 feet to about 9 feet, about 8 feet to about 10 feet, or about 9 feet to about 10 feet.

In some embodiments, and as shown in FIG. 14, an attachable attached backstop 400 comprises a first net pole 402, a second net pole 412, and a net 420. Each of first and second net poles 402, 412 is cylindrical in shape defined by a length and diameter, flexible, and includes a net engagement portion 404, 414 and a second end including a platform engagement portion 406, 416, respectively. Net 420 is a four-sided structure having a first side 421, a second side 422, a third side 423, and a fourth side 424. A first net pole pocket 426 is located at the corner of first and fourth sides 421, 424 and second net pole pocket 428 is located at the corner of first and second sides 421, 422. Net pole pockets 426, 428 can be made for either a hard material such as plastic or a flexible material such as, e.g., a nylon fabric.

To enable reversible attachment of backstop assembly 400, portable ball play and practice apparatuses 10 further includes additional components. As shown in FIG. 14, swingable stabilizing platform 350 further include a first net pole engagement point 372 and a second net pole engagement point 374 each shaped and sized to receive therein platform engagement portion 406, 416 of first and second net poles 402 and 404, respectively First and second net pole engagement points 372, 374 are positioned proximate to corners formed by second and third sides 352, 353 and third and fourth sides 353, 354 of swingable stabilizing platform 350. Each of first and second net pole engagement points 372, 374 can be, e.g., a peg configured to be inserted into a hole within first and second platform engagement portions 406, 416, respectively, a threaded blind hole configured to receive a threaded portion of first and second platform engagement portions 406, 416, respectively, or a blind hole configured to receive first and second platform engagement portions 406, 416, respectively.

In addition, and still referring to FIG. 14, board assembly 20 further include a first net pole engagement point 37 and a second net pole engagement point 38 each shaped and sized to reversibly affix therein first and second net poles 402 and 404, respectively. Each of first and second net pole engagement points 37, 38 can be, e.g., a flexible prong configured to be reversibly secure a portion of first and second net poles 402 and 404, respectively, or an eye-hook configured to be reversibly receive a portion of first and second net poles 402 and 404, respectively, inserted therewithin.

To assemble backstop assembly 400 to portable ball play and practice apparatuses 10, first net pole 402 is reversibly secured to second net pole engagement point 374 of swingable stabilizing platform 350 and first net pole engagement point 37 of board assembly 20. Similarly, second net pole 412 is reversibly secured to first net pole engagement point 372 of swingable stabilizing platform 350 and second net pole engagement point 38 of board assembly 20. Net 420 is then secured to the resulting X-shaped frame by reversibly securing first net pole pocket 426 to net first engagement portion 404 and second net pole pocket 428 to second net engagement portion 414. Net 400 is then allowed to drape down behind portable ball play and practice apparatus 10. Net 400 can optionally include weights, e.g., incorporated within third side 423 to increase the tautness of net 400 when assembled.

As portable ball play and practice apparatus 10 can be reversibly configured to have forward playing surface being either first playing surface 40 or second playing surface 50, additional components required to reversibly attach attachable attached backstop 400 are either duplicated or adjustable in order to be operationally configured to affix attachable attached backstop 400 in either orientation. For example, and referring to FIG. 13, since swingable stabilizing platform 350 and board assembly 20 can be substantially fully rotated about hinge 368 to enable play on either first playing surface 40 or second playing surface 50, first and second net pole engagement points 372, 374 of swingable stabilizing platform 350 can be 1) duplicated on both top surface 355 and bottom surface 356 of swingable stabilizing platform 350, or 2) configured to be removably affixed or switchably adjustable so as to enable selectively placement of first and second net pole engagement points 372, 374 to either top surface 355 or bottom surface 356. First and second swingable stabilizing feet 250, 260 can be similarly configured to duplicate or provide for removably affixed or switchably adjustable first and second net pole engagement points 372, 374.

Likewise, first and second net pole engagement points 37, 38 of swingable board assembly 20 can be 1) duplicated on both first playing surface 40 or second playing surface 50, or 2) configured to be removably affixed or switchably adjustable so as to enable selectively placement of first and second net pole engagement points 37, 38 to either first playing surface 40 or second playing surface 50. Such configuration allows backstop assembly 400 to be used with either first or second playing surface 40, 50 to catch balls and prevent them from careening off away from a field of play. Board assemblies 20', 20" can be similarly configured to duplicate or provide for removably affixed or switchably adjustable first and second net pole engagement points 37, 38.

In some embodiments, an attachable backstop assembly comprises one or more return panels. Each of the one or more return panels is sized and configured to reversibly affix to one of a frame top, first frame side or second frame side of a board assembly disclosed herein. Each return panel is so affixed to a board assembly disclosed herein that it extends the surface area of a forward-facing playing surface. In addition, each return panel disclosed herein can optionally be affixed using a spring hinge. In such configuration, each panel adopts a first position that maximizes the surface area covered by the return panels and upon being struck by a ball, the stuck return panel recoils rearwardly and then returns forward to the first position thereby redirecting the ball by into a field of play.

Figure 15:
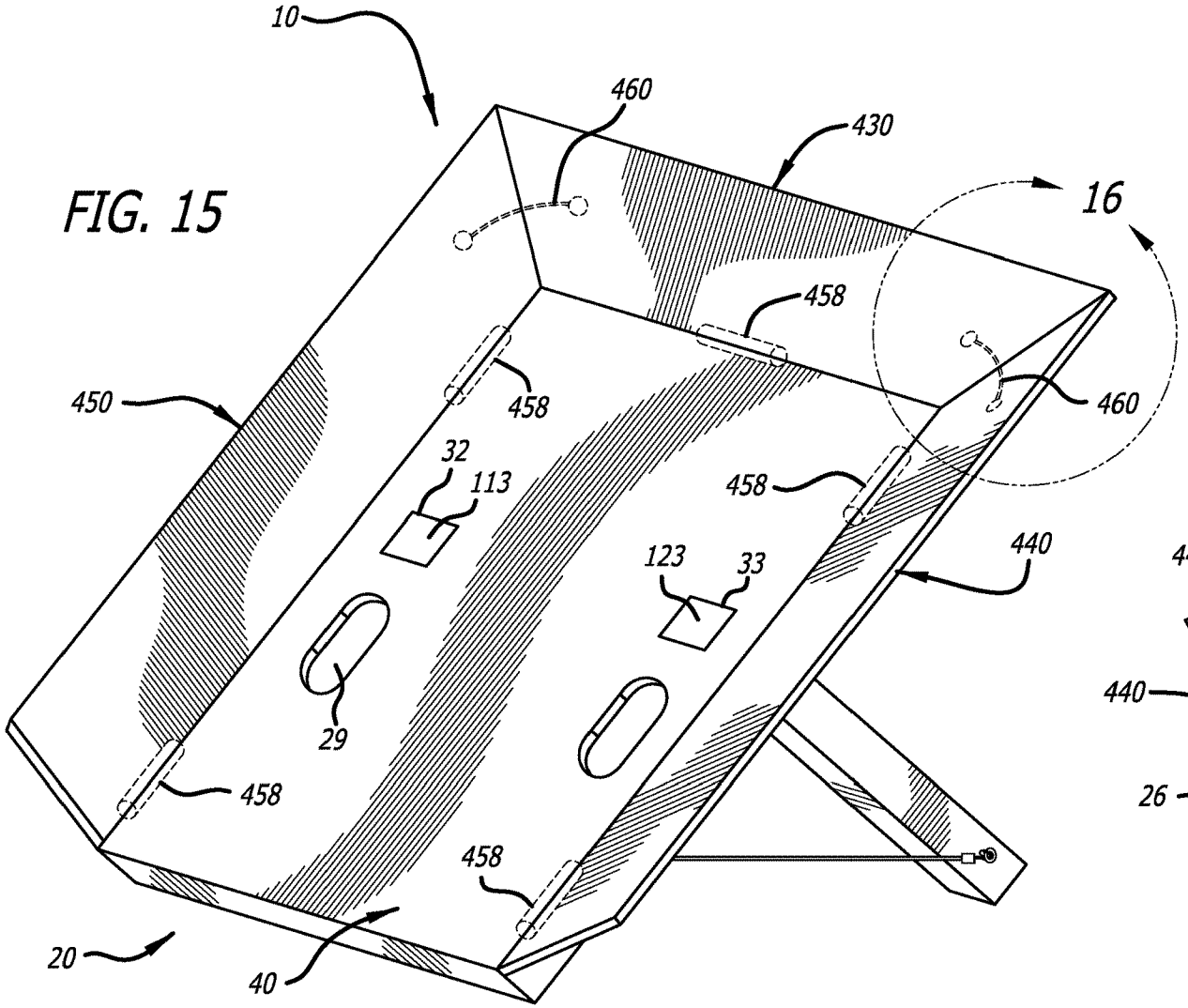
FIG. 15 is a rear perspective view of another exemplary backstop assembly for use with a portable ball play and practice apparatus disclosed herein.
Figure 16:
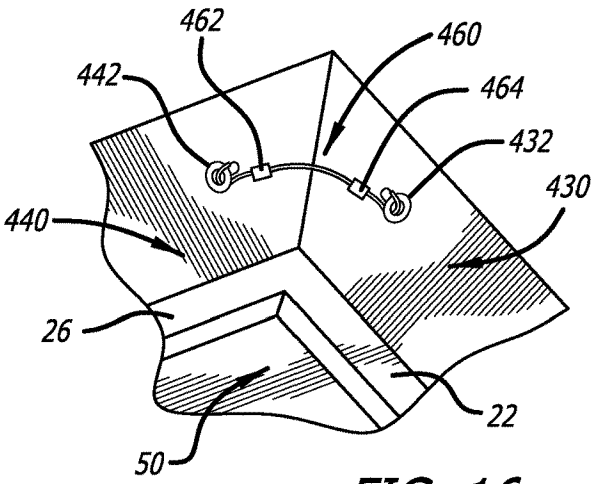
FIG. 16 is an upper rear close-up view of the backstop assembly of FIG. 15 showing return elements in accordance with one aspect of the present disclosure.

In some embodiments, and referring to FIGS. 15 & 16, an attachable backstop assembly 400' comprises a top return panel 430 sized and configured to reversibly affix to frame top 22 of board assembly 20, a first side return panel 440 sized and configured to reversibly affix to first frame side 26 of board assembly 20, a second side return panel 450 sized and configured to reversibly affix to second frame side 28 of board assembly 20, a first rebound tether 460 and a second rebound tether 470. Top return panel 430, first side return panel 440, and second side return panel 450 are each reversibly affixed to frame top 22, first frame side 26, and second frame side 28, respectively using one or more hinges 458, which optionally are spring hinges. Alternatively, each return panel can be reversibly affixed via pegs or gate hinge J-bolt that provide a suitable recoil mechanism.

In some embodiments, and referring to FIG. 15, each of top return panel 430, first side return panel 440, and second side return panel 450 is a four-sided structure having a length, width, and depth and defined by a first side, a second side, a third side, a fourth side, a top surface, and a bottom surface. First side is opposite to third side and first side is generally parallel to third side. Similarly, second side is opposite to fourth side and span between first and third sides. With respect to top return panel 430, this panel is dimensioned and sized as an isosceles trapezoidal shape with second and fourth sides being angles and first side having a greater length than third side. With respect to first side return panel 440, this panel is dimensioned and sized as a right-angled trapezoidal shape with fourth side being angled and first side having a greater length than third side. With respect to second side return panel 450, this panel is also dimensioned and sized as right-angled trapezoidal shape but with second side being angled and first side having a greater length than third side. When assembled, angled second side of second side return panel 450 forms a mitered corner with angled fourth side of top return panel 430. Similarity, angled fourth side of first side return panel 440 forms a mitered corner with angled second side of top return panel 430.

As shown in FIGS. 15 & 16, each mitered corner can be optionally and reversibly secured with a rebound tether 460 0. Tether 460 comprises a first engagement portion 462 and a second engagement portion 464. As best seen in FIG. 16, rebound tether 460 can be affixed to mitered corner formed by second side return panel 450 and top return panel 430 by attaching first engagement portion 462 to an engagement point 452 of second side return panel 450 and second engagement portion 464 to an engagement point 432 of top return panel 430. Similarly, another tether 260 can be affixed to mitered corner formed by first side return panel 440 and top return panel 430 by attaching a first engagement portion 462 to an engagement point 442 of first side return panel 440 and a second engagement portion 464 to an engagement point 432 of top return panel 430. Each rebound tether 460 is typically a flexible and resilient elastic material that includes, without limitation, an elastic cord like a bungee cord, rubber cord, or other elastic line. When elastic, rebound tether 460 can be the sole recoil mechanism that redirects a ball by into a field of play or be used in conjunction with hinge 458 when such hinge is a spring hinge.

Figure 17:
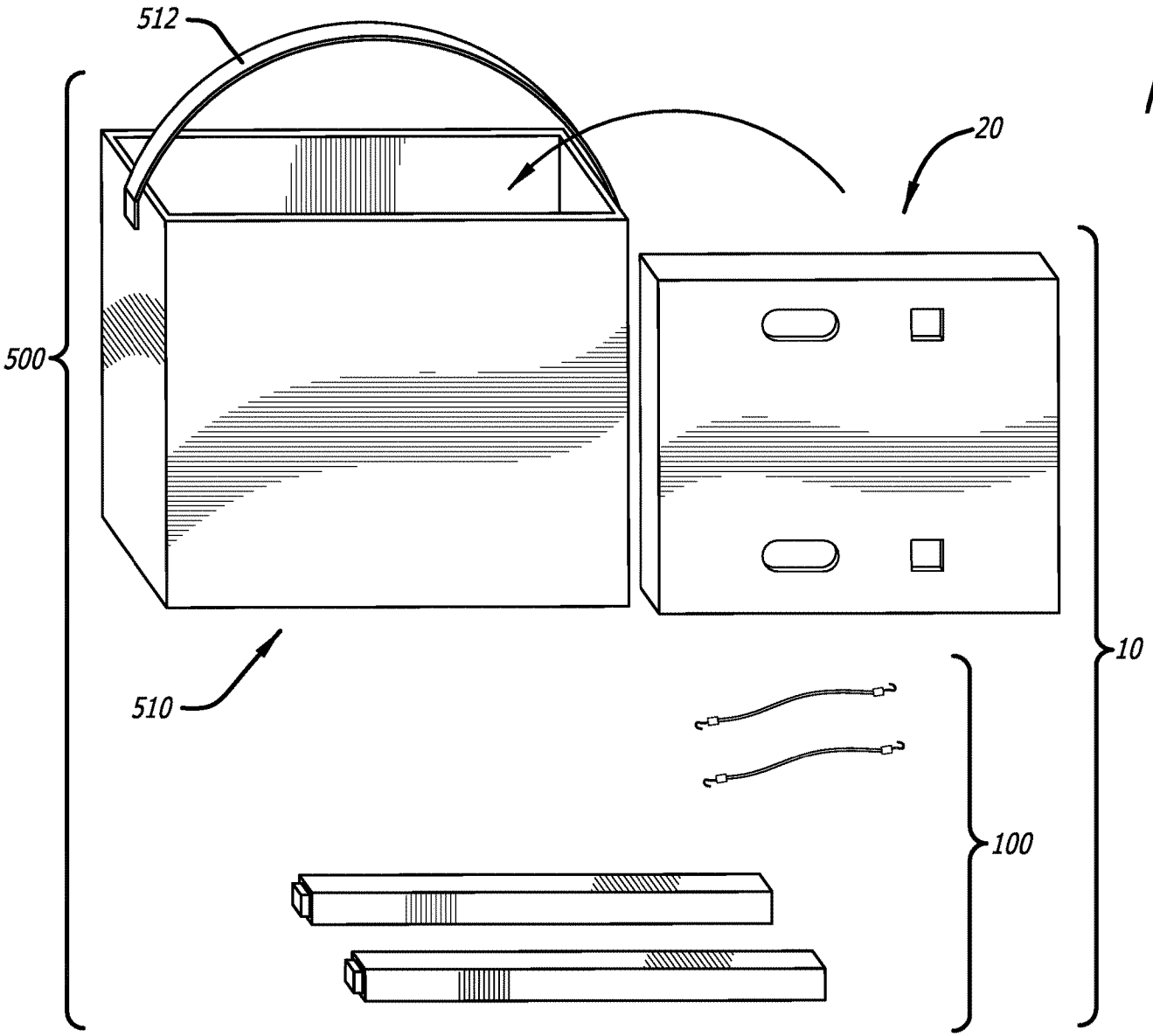
FIG. 17 shows a kit in accordance with one embodiment and including a portable ball play and practice apparatus in accordance with an aspect of present disclosure.

Aspects of the present specification disclose, in part, kits comprising one or more components as disclosed herein. Kits provide a convenient enclosure of components useful to sell, transport or store portable ball play and practice apparatus disclosed herein and its use as disclosed herein to facilitate or enhance a commercial sale. For example, in some embodiments, and as shown in FIG. 17, a kit 500 may comprise portable ball play and practice apparatus 10 comprising board assembly 20 and stand assembly 100, and optionally backstop assembly 400 with, optionally a container 510 and/or one or more instructions provided on suitable media describing instructions useful to assemble portable ball play and practice apparatus 10 and/or practice a method or use employing portable ball play and practice apparatus 10. In some embodiments, kit 500 may comprise portable ball play and practice apparatus 10 comprising board assembly 20' and stand assembly 100, and optionally backstop assembly 400 with, optionally a container 510 and/or one or more instructions provided on suitable media describing instructions useful to assemble portable ball play and practice apparatus 10 and/or practice a method or use for assemble portable ball play and practice apparatus 10. In some embodiments, kit 500 may comprise portable ball play and practice apparatus 10 comprising a plurality of board assemblies 20" and stand assembly 100, and optionally backstop assembly 400 with, optionally a container 510 and/or one or more instructions provided on suitable media describing instructions useful to assemble portable ball play and practice apparatus 10 and/or practice a method or use for assemble portable ball play and practice apparatus 10.

Container 510 is dimensioned and sized to enclose portable ball play and practice apparatus 10 as well as one or more instructions and one or more optional components disclosed herein and is useful for storing, transporting or caring of same. Exemplary containers include, but are not limited to, a box, a bag (for example, a duffel bag), a carrying case (soft or hard sided), crate, cart or any other suitable device sized to contain and/or store and/or transport at least one ball play and practice apparatus as herein disclosed. In some examples, container 510 may have at least one handle 512 for ease of carry, maneuvering and transport. In some embodiments, kit 500 comprises a single container 510 configured to enclose all components portable ball play and practice apparatus 10, and optionally one or more other components, such one or more balls and/or one or more stabilizing pad engagement portions 114, 124, for example. In some embodiments, kit 500 can comprise multiple containers 510, where one container 510 enclose portable ball play and practice apparatus 10 as well as one or more instructions and one or more optional components disclosed herein and the remainder of the multiple containers 510 configured to individually enclose one or more of a board assembly disclosed herein, a stand assembly disclosed herein and/or a backstop assembly disclosed herein as well as or enclose one or more other components, such one or more balls and/or one or more stabilizing pad engagement portions 114, 124, for example.

Kit 500 may include labels or inserts. Labels or inserts include "printed matter" that can be provided as separate material, a packing material (e.g., a box), or attached or affixed to a container containing a kit component. Labels or inserts can additionally include a computer readable medium, such as a disk (e.g., hard disk, flash memory), optical disk such as CD- or DVD-ROM/RAM, DVD, MP3, magnetic tape, or an electrical storage media such as RAM and ROM or hybrids of these such as magnetic/optical storage media, FLASH media or memory type cards. Labels or inserts may include identifying information of one or more components therein, dose amounts, does frequency or timing, information on the individual components. Labels or inserts can include information identifying manufacturer information, lot numbers, manufacturer location and date. Labels or inserts can include information on a condition or situation for which a kit component may be used. Labels or inserts can include instructions for using one or more of the kit components in a method, or use as disclosed herein. Instructions can include dosage amounts, frequency or duration, and instructions for practicing any of the methods or uses, or treatment protocols described herein as well as warnings on potential hazards or situations where it would not be appropriate to use the components of the kit.

Aspects of the present specification can also be described by the following embodiments:

1. A portable ball play and practice apparatus comprising a board assembly, the board assembly comprising one or more sides, a first playing surface, and a second playing surface substantially opposing the first playing surface, the one or more sides including a frame top and a frame bottom with the frame top being opposite to the frame bottom and generally parallel to the frame bottom, and the first playing surface configured to provide a different rebound effect when contacted by a ball relative to the second playing surface; a stand assembly, the stand assembly being dimensioned and sized to provide a stable support to the board assembly and an angle of play, the stand assembly comprising one or more components including a support arm assembly; wherein the apparatus is configured to adopt into a first playing position or a second playing position, wherein in the first playing position the board assembly is changeably positioned such that the first playing surface is forwardly facing and available for use and the second playing surface is rearwardly facing and available for operational engagement with the one or more components of the stand assembly, wherein in the second position the board assembly is changeably positioned such that the second playing surface is forwardly facing and available for use and the first playing surface is rearwardly facing and available for operational engagement with the one or more components of the stand assembly.
2. The apparatus of claim 1, wherein the board assembly further comprises a first frame side, and a second frame side, wherein the first frame side is opposite to second frame side and is generally parallel to second frame side, and wherein the first and second frame sides span between the frame top and the frame bottom and are substantially perpendicular to the frame top and frame bottom.
3. The apparatus of claim 1 or 2, wherein the board assembly is configured as a single component.
4. The apparatus of claim 1 or 2, wherein the board assembly comprises two or more board assembly component.
5. The apparatus of claim 1 or 2, wherein the board assembly comprises a first board assembly component, a second board assembly component, and a hinge mechanism connecting the first and second board assembly components, the hinge mechanism enabling the first and second board assembly components to be foldable onto each other to define a folded configuration.
6. The apparatus of claim 5, wherein when in the folded configuration, the board assembly is in a transportable configuration.
7. The apparatus of claim 5 or 6, wherein when in the folded configuration, the board assembly defined an internal storage compartment.
8. The apparatus of any one of claims 1-3, wherein the board assembly further comprises a connector system that enables the board assembly to be reversibly coupled to another board assembly.
9. The apparatus of any one of claims 1-8, wherein the first playing surface is a flat, planar surface.

10. The apparatus of any one of claims 1-9, wherein the second playing surface comprises a plurality of spaced apart projections that define furrows therebetween.
11. The apparatus of claim 10, wherein each of the plurality of spaced apart projections form a projection angle about 30° to about 90°, the projection angle being an angle formed by the juncture of each of the plurality of spaced apart projections and the frame bottom, or an angle formed by the juncture of each of the plurality of spaced apart projections and the frame top.
12. The apparatus of claim 10, wherein the plurality of spaced apart projections are arranged in a vertical projection pattern where each of the plurality of spaced apart projections are substantially parallel to one another and spaced apart at regular intervals, and each of the plurality of spaced apart projections form a projection angle about 90°, the projection angle being an angle formed by the juncture of each of the plurality of spaced apart projections and the frame bottom.
13. The apparatus of claim 10, wherein the plurality of spaced apart projections are arranged in a vertical projection pattern where each of the plurality of spaced apart projections are substantially parallel to one another and spaced apart at irregular intervals, and each of the plurality of spaced apart projections form a projection angle about 90°, the projection angle being an angle formed by the juncture of each of the plurality of spaced apart projections and the frame bottom.
14. The apparatus of claim 10, wherein the plurality of spaced apart projections are arranged in an angular projection pattern where each of the plurality of spaced apart projections are not parallel to one another.
15. The apparatus of claim 10, wherein the plurality of spaced apart projections are arranged in an angular projection pattern, wherein each of the plurality of spaced apart projections form a projection angle about 30° to about 89°, the projection angle being an angle formed by the juncture of each of the plurality of spaced apart projections and the frame bottom, or an angle formed by the juncture of each of the plurality of spaced apart projections and the frame top.
16. The apparatus of any one of claim 10, 11, 14, or 15, wherein the plurality of spaced apart projections are arranged in a sunburst arrangement, a V-shaped arrangement, an inverted V-shaped arrangement, a double V-shaped arrangement, or an inverted double V-shaped arrangement.
17. The apparatus of any one of claims 10-16, wherein a subset or all of the plurality of spaced apart projections has substantially the same depth.
18. The apparatus of any one of claims 10-16, wherein a subset or all of the plurality of spaced apart projections has a varied depth.
19. The apparatus of claim 18, wherein the varied depth forms a uniformly linear slope or a curvilinear slope.
20. The apparatus of any one of claims 10-19, wherein each of the plurality of spaced apart projections has a top surface.
21. The apparatus of claim 20, wherein the top surface is flat, an edged, or rounded.
22. The apparatus of any one of claims 10-21, wherein each of the furrows defined by the plurality of spaced apart projections have a width of about 3 inches to about 8 inches.
23. The apparatus of any one of claims 1-22, wherein the angle of play of the stand assembly is non-adjustable or adjustable.
24. The apparatus of any one of claims 1-22, wherein the angle of play of the stand assembly is adjustable.
25. The apparatus of claim 24, wherein the angle of play can be adjusted by at least 75°.
26. The apparatus of any one of claims 1-25, wherein the support arm assembly comprises a first support arm and a second support arm.
27. The apparatus of any one of claims 1-25, wherein the support arm assembly is a swingable support arm assembly.
28. The apparatus of claim 27, wherein the swingable support arm assembly comprises a first swingable support arm and a second swingable support arm.
29. The apparatus of any one of claims 1-28, wherein the stand apparatus further comprises a stabilizing assembly.
30. The apparatus of claim 29, wherein the stabilizing assembly comprises a first tether and a second tether.
31. The apparatus of claim 29, wherein the stabilizing assembly is a swingable stabilizing assembly.
32. The apparatus of claim 31, wherein the swingable stabilizing assembly comprises a first singable stabilizing foot and a second swingable stabilizing foot.
33. The apparatus of claim 31, wherein the swingable stabilizing assembly comprises a swingable stabilizing platform.
34. The apparatus of any one of claims 1-33, wherein the second playing surface further comprises a pliable covering that conceals or otherwise masks the plurality of spaced apart projections.
35. The apparatus of any one of claims 1-34, further comprising a backstop assembly.
36. The apparatus of claim 35, wherein the backstop assembly is a separate, stand-alone component or a component integral to the apparatus.
37. The apparatus of claim 35 or 36, wherein the backstop assembly comprises a net.
38. The apparatus of claim 35 or 36, wherein the backstop assembly comprises one or more return panels.
39. A portable ball play and practice apparatus comprising a reversibly expandable board assembly, the reversibly expandable board assembly comprising a four-sided structure defined by a frame top, a frame bottom, a first frame side, a second frame side, and one or more elongated projections, wherein the frame top is opposite to the frame bottom and generally parallel to the frame bottom, wherein the first frame side is opposite to the second frame side and generally parallel to the first frame side, and wherein the first and second frame sides span between the frame top and the frame bottom and each being substantially perpendicular to the frame top and the frame bottom; wherein each of the one or more elongated projections is interspaced between the first and second frame sides; and wherein the reversibly expandable board assembly is configured to adopt an expanded configuration or a retracted configuration, and a stand assembly, the stand assembly being dimensioned and sized to provide a stable support to the reversibly expandable board assembly and an angle of play, the stand assembly comprising a support arm assembly.
40. The apparatus of claim 39, wherein in the expanded configuration, one or more furrows are created, each of the one or more furrows being a space between the first frame side and an elongated projection of the one or more elongated projections adjacent to the first frame side, a space between two adjacent elongated projections of the one or more projections, or a space between the second frame side and an elongated projection of the one or more elongated projections adjacent to the second frame side.

41. The apparatus of claim 39 or 40, wherein each of the furrows has a width of about 3 inches to about 8 inches.
42. The apparatus of any one of claims 39-41, further comprising a first board stabilizing rod, the first board stabilizing rods having a length sized and dimensioned to traverse the distance between the first and second frame sides when the reversibly expandable board assembly is in the expanded configuration, the first board stabilizing rod configured to fix in place and stabilize the reversibly expandable board assembly in the expanded configuration.
43. The apparatus of claim 42, wherein each of the first frame side, the second frame side, and each of the one or more elongated projections further comprise a first rod aperture, wherein the first rod aperture is a through hole sized and dimensioned to enable insertion therethrough the first board stabilizing rod, and wherein each of the first rod apertures of the first frame side, the second frame side, and each of the one or more elongated projections is aligned with respect to each other to enable insertion of the first board stabilizing rod through each of the first rod apertures in a manner that allows traversal of the first board stabilizing rod across the distance defined between the first and second frame sides when the reversibly expandable board assembly is in the expanded configuration.
44. The apparatus of claim 42 or 43, further comprising a second board stabilizing rod, the second board stabilizing rod having a length sized and dimensioned to traverse the distance between the first and second frame sides when the reversibly expandable board assembly is in the expanded configuration, the second board stabilizing rod configured to fix in place and stabilize the reversibly expandable board assembly in the expanded configuration.
45. The apparatus of claim 44, wherein each of the first frame side, the second frame side, and each of the one or more elongated projections further comprise a second rod aperture, wherein the second rod aperture is a through hole sized and dimensioned to enable insertion therethrough the second board stabilizing rod, and wherein each of the second rod apertures of the first frame side, the second frame side, and each of the one or more elongated projections is aligned with respect to each other to enable insertion of the second board stabilizing rod through each of the second rod apertures in a manner that allows traversal of the second board stabilizing rod across the distance defined between the first and second frame sides when the reversibly expandable board assembly is in the expanded configuration.
46. The apparatus of any one of claims 42-45, wherein the first board stabilizing rod further comprises one or more engagement points, each of the one or more engagement points configured to reversibly affix to the support arm assembly.
47. The apparatus of any one of claims 42-45, wherein the first board stabilizing rod further comprises one or more engagement points, wherein one of the one or more engagement points is configured to reversibly affix to a first support arm of the support arm assembly, and another of the one or more engagement points is configured to reversibly affix to a second support arm of the support arm assembly.
48. The apparatus of any one or claims 39-47, wherein the support arm assembly comprises a first support arm and a second support arm.
49. The apparatus of claim 48, wherein the first board stabilizing rod further comprises a first engagement point and a second engagement point, wherein the first engagement point is configured to reversibly affix to the first support arm and the second engagement point is configured to reversibly affix to the second support arm.
50. The apparatus of any one of claims 39-49, further comprising a backstop assembly.
51. The apparatus of claim 50, wherein the backstop assembly is a separate, stand-alone component or a component integral to the apparatus.
52. The apparatus of claim 50 or 51, wherein the backstop assembly comprises a net.
53. The apparatus of claim 50 or 51, wherein the backstop assembly comprises one or more return panels.
54. A kit comprising an apparatus as defined in any one of claims 1-53, the kit optionally comprising instructions, one or more containers, one or more balls, one or more additional components.
55. A system comprising as defined in any one of claims 1-54 and further including one or more balls.
56. The system of claim 55, wherein the one or more ball include a volleyball, a tennis ball, a racquetball, a soccer ball, or a playground ball.

EXAMPLES

The following non-limiting examples of drills, such as volleyball drills, are provided for illustrative purposes only in order to facilitate a more complete understanding of representative embodiments of use now contemplated. These examples should not be construed to limit any of any embodiments described in the present specification, including those pertaining to portable ball play and practice apparatus or methods of their uses as disclosed herein.

Example 1

In volleyball, pepper, usually used as a verb, is an extremely popular warm-up drill, generally involving two players. Variations with more players exist. (Similar to the Law of Hyena). In one example of pepper in accordance with the present disclosure, two players face each other separated by a distance of 5-20 feet (2-6 meters). Distances vary based upon the players' preference. Player 2 starts by hitting or tossing a volleyball toward the portable ball play and practice apparatus 5 disclosed herein, the ball then rebounding off of the forwardly facing surface in play (either first playing surface 40 or second playing surface 50, depending upon the desired configuration of portable ball play and practice apparatus 10, as disclosed herein). Player 1 then either passes the ball back to player 2 starting the drill or can hit the ball back toward the portable ball play and practice apparatus 10. Upon rebounding, Player 2 then can either set the ball back and player 1 can spike the ball back, forcing player 2 to dig the ball where player 1 can set it, allowing player 2 to spike it. Player 1 passes the spiked ball, and the cycle starts over again.

In closing, foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions and sub-combinations as are within their true spirit and scope. Accordingly, the scope of the present invention is not to be limited to that precisely as shown and described by this specification.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps and/or limitations may be made for any one of the elements, steps or limitations in a claim set forth below or that a single element, step or limitation may be substituted for two or more elements, steps and/or limitations in such a claim. Although elements, steps or limitations may be described above as acting in certain combinations and even initially claimed as such, it is to be expressly understood that one or more elements, steps and/or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more or different elements, steps and/or limitations, which are disclosed in above combination even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including", "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. The reference to any prior art in this specification is not, and should not be taken as, an acknowledgement or any form of suggestion that the prior art forms part of the common general knowledge from any country. In addition, nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. A portable ball play and practice apparatus comprising a reversibly expandable board assembly, the reversibly expandable board assembly comprising a frame top, a frame bottom, a first frame side, a second frame side, one or more board stabilizing rods, and at least two elongated projections, wherein the top frame is opposite to the bottom frame and generally parallel to the top frame;

wherein the first frame side is opposite to the second frame side and generally parallel to the first frame side, the first and second frame sides span between the frame top and the frame bottom, and the first and second frame sides are substantially perpendicular to frame top and frame bottom;

wherein each of the at least two elongated projections is interspaced between the first and second frame sides; and wherein the reversibly expandable board assembly is configured to adopt an expanded configuration or a retracted configuration, wherein each of the one or more board stabilizing rods having a length sized and dimensioned to traverse the distance between the first and second frame sides when the reversibly expandable board assembly is in the expanded configuration, and a support arm assembly comprising a first support arm, and a second support arm, the first support arm configured to operationally affix to an engagement point on the first frame side and a second support arm configured to operationally affix to an engagement point on the second frame side.

2. The apparatus of claim 1, wherein in the expanded configuration, one or more furrows are created, each of the one or more furrows being a space between the first frame side and an elongated projection of the at least two elongated projections adjacent to the first frame side, a space between two adjacent elongated projections of the at least two elongated projections, or a space between the second frame side and an elongated projection of the at least two elongated projections adjacent to the second frame side.

3. The apparatus of claim 1, wherein the first board stabilizing rod configured to fix in place and stabilize the reversibly expandable board assembly in the expanded configuration.

4. A kit comprising an apparatus as defined in claim 1, the kit comprising one or more containers and optionally comprising instructions, one or more balls, and/or one or more additional components.

5. The apparatus of claim 1, wherein the reversibly expandable board assembly has a non-adjustable angle of play.

6. The apparatus of claim 1, wherein the reversibly expandable board assembly has an adjustable angle of play.

7. The apparatus of claim 6, wherein the adjustable angle of play is adjustable by at least 30°.

8. The apparatus of claim 6, wherein the adjustable angle of play is from about 110° to about 160° with respect to the horizon.

9. The apparatus of claim 1, wherein the reversibly expandable board assembly comprises about 5 elongated projections to about 20 elongated projections.

10. The apparatus of claim 1, wherein spacing between each of the at least two elongated projections.

11. The apparatus of claim 1, wherein each of the at least two elongated projections is reversible removeable from the reversibly expandable board assembly.

12. The apparatus of claim 1, wherein the at least two elongated projections further comprises a pliable covering that conceals or otherwise masks the at least two elongated projections.

13. The apparatus of claim 11, wherein the pliable covering is composed of a flexible or elastic material.

14. The apparatus of claim 2, wherein the space between each of the two adjacent elongated projections has a width of about 3 inches to about 8 inches.

15. The apparatus of claim 2, wherein the space between each of the two adjacent elongated projections has a width of at most 5 inches.

16. The apparatus of claim 1, wherein the first and second support arms are non-adjustable in length.

17. The apparatus of claim 1, wherein the first and second support arms are adjustable in length.

18. The apparatus of claim 1, wherein the engagement point of the first support arm and the engagement point of the second support arm are each a pivot joint that enable the first and second support arms to freely pivot about their respective pivot joint.

19. The apparatus of claim 1, wherein the first frame side comprises a channel configured to store the first support arm and the second frame side comprises a channel configured to store the second support arm.

20. The apparatus of claim 1, wherein the reversibly expandable board assembly further comprises a connector system that enables the reversibly expandable board assembly to be reversibly coupled to another reversibly expandable board assembly.

* * * * *